US011786799B2

(12) United States Patent
Pfeifer et al.

(10) Patent No.: US 11,786,799 B2
(45) Date of Patent: Oct. 17, 2023

(54) SNOW SKI ASSEMBLIES

(71) Applicants: John Pfeifer, Kirkwood, MO (US); Michael C. Marner, Tucson, AZ (US)

(72) Inventors: John Pfeifer, Kirkwood, MO (US); Michael C. Marner, Tucson, AZ (US)

(73) Assignee: J&M Sports Enterprises LLC, Kirkwood, MO (US)

( * ) Notice: Subject to any disclaimer, the term of this patent is extended or adjusted under 35 U.S.C. 154(b) by 0 days.

(21) Appl. No.: 17/157,612

(22) Filed: Jan. 25, 2021

(65) Prior Publication Data

US 2021/0146228 A1 May 20, 2021

Related U.S. Application Data

(63) Continuation-in-part of application No. 15/891,104, filed on Feb. 7, 2018, now Pat. No. 11,007,421, which (Continued)

(51) Int. Cl.
*A63C 5/04* (2006.01)
*A63C 5/056* (2006.01)

(Continued)

(52) U.S. Cl.
CPC ..... *A63C 5/0405* (2013.01); *A63C 5/02* (2013.01); *A63C 5/056* (2013.01); *A63C 10/14* (2013.01);

(Continued)

(58) Field of Classification Search
CPC ..... A63C 5/0405; A63C 5/02; A63C 5/056; A63C 10/14; A63C 10/04; A63C 10/18; A63C 10/20; A63C 10/24
See application file for complete search history.

(56) References Cited

U.S. PATENT DOCUMENTS 34,949 A 4/1862 Dutton
1,357,940 A * 11/1920 Lennah ..... A47G 19/30 220/574

(Continued)

FOREIGN PATENT DOCUMENTS

RU 2338568 C2 11/2008
RU 118281 U1 7/2012

(Continued)

OTHER PUBLICATIONS

U.S. Appl. No. 14/579,170, filed Dec. 22, 2014.

(Continued)

*Primary Examiner* — Jacob B Meyer
(74) *Attorney, Agent, or Firm* — Harness, Dickey & Pierce, P.L.C

(57) ABSTRACT

A snow ski assembly is provided for use by an individual to slide across a snow covered surface, for example, under the force of gravity. The assembly includes a ski having a bottom wall for engaging the snow covered surface and an upturned peripheral region extending around a perimeter of the bottom wall. The bottom wall of the ski includes at least one control structure extending across at least a portion of the bottom wall, where the at least one control structure is configured to control a movement of the ski on the snow covered surface. The assembly also includes a mounting feature configured to couple a binding to the bottom wall of the ski, such that the individual can position a foot in the binding and use the ski to slide across the snow covered surface.

26 Claims, 26 Drawing Sheets

Related U.S. Application Data is a continuation of application No. 14/579,170, filed on Dec. 22, 2014, now Pat. No. 9,950,241.

(51) Int. Cl.

| | |
|---|---|
| ***A63C 10/14*** | (2012.01) |
| ***A63C 5/02*** | (2006.01) |
| *A63C 10/24* | (2012.01) |
| *A63C 10/04* | (2012.01) |
| *A63C 10/18* | (2012.01) |
| *A63C 10/20* | (2012.01) |

(52) U.S. Cl.

CPC ..... *A63C 10/04* (2013.01); *A63C 10/18* (2013.01); *A63C 10/20* (2013.01); *A63C 10/24* (2013.01)

(56) References Cited

U.S. PATENT DOCUMENTS 2,154,019 A * 4/1939 Frederick ..... A63C 1/00 280/619
2,430,466 A * 11/1947 Hedman ..... A43B 13/20 36/7.8
D163,316 S 5/1951 Paden
D166,120 S 3/1952 Paden
2,756,517 A * 7/1956 Youtz ..... A63B 25/10 36/7.8
2,762,063 A * 9/1956 Harvie ..... B63B 1/041 441/67
2,826,423 A * 3/1958 Erickson ..... B62B 15/00 114/346
2,826,424 A * 3/1958 Erickson ..... B62B 15/00 472/25
2,878,858 A * 3/1959 Winchester ..... A63G 23/00 482/77
2,946,599 A * 7/1960 Hunsbedt ..... A63C 13/001 280/11.3
3,188,087 A * 6/1965 Larson, Jr. ..... A63F 7/386 482/146
3,272,522 A * 9/1966 Kennedy, III ..... A63C 5/126 280/610
3,306,626 A * 2/1967 Kawada ..... A63C 17/24 482/77
3,423,852 A * 1/1969 Smith ..... A43B 13/20 36/7.5
3,586,321 A * 6/1971 Gehrke ..... A63G 23/00 482/146
3,612,520 A * 10/1971 Chang ..... A63B 22/18 482/146
3,635,490 A * 1/1972 Demaree ..... B62B 13/06 280/18
3,716,880 A * 2/1973 Sorenson ..... B63B 1/041 441/67
3,950,808 A * 4/1976 Sorenson ..... B63B 1/041 441/67
3,965,586 A * 6/1976 Roosli ..... A43B 5/0419 36/117.3
4,004,355 A * 1/1977 Koblick ..... A63C 13/005 280/11.3
4,118,050 A * 10/1978 Schnurrenberger ..... A63C 7/06 280/610
4,188,046 A * 2/1980 Fleckenstein ..... A63C 9/083 280/600
D256,604 S 8/1980 Arzoian
4,327,504 A * 5/1982 Welsch ..... A63C 13/001 36/122
4,403,785 A * 9/1983 Hottel ..... A63C 10/00 280/607
4,525,941 A * 7/1985 Ruth, Jr. ..... A43B 5/18 36/116
D286,904 S 11/1986 Kim
4,666,171 A * 5/1987 Sellers ..... B62B 15/00 280/18
4,676,009 A * 6/1987 Davis ..... A43B 5/18 36/7.8
4,687,198 A * 8/1987 Smith ..... A63B 22/14 482/77
4,705,291 A * 11/1987 Gauer ..... A63C 5/025 482/901
4,801,140 A * 1/1989 Bergeron ..... A63B 21/0004 280/87.01
4,836,571 A * 6/1989 Corbisiero ..... A63C 1/36 36/97
4,974,868 A * 12/1990 Morris ..... A63C 5/0405 441/74
5,048,823 A * 9/1991 Bean ..... A63B 22/18 482/146
5,149,117 A * 9/1992 Wilkens, Sr. ..... B62B 13/00 280/30
5,193,839 A * 3/1993 Hannes ..... A63C 13/005 280/600
5,301,441 A * 4/1994 Kownacki ..... A43B 5/18 36/109
5,398,957 A 3/1995 Leighton et al.
5,643,154 A * 7/1997 Awbrey ..... A63B 26/003 482/146
D383,824 S * 9/1997 Mendoza ..... D21/768
5,685,807 A * 11/1997 Tong ..... A63B 25/10 482/77
5,687,983 A * 11/1997 Feketa ..... A63C 5/003 280/610
5,810,703 A * 9/1998 Stack ..... A63B 22/18 482/79
5,868,405 A * 2/1999 Lavecchia ..... B63B 32/60 280/18
5,897,474 A * 4/1999 Romero ..... A63B 22/14 482/79
5,916,071 A * 6/1999 Lee ..... A43B 13/182 482/79
D412,195 S 7/1999 Falconer
D412,353 S 7/1999 Falconer
5,951,403 A * 9/1999 Trzos ..... A63G 23/00 472/102
6,238,325 B1 * 5/2001 Oxford ..... A63B 21/0004 482/79
6,244,615 B1 * 6/2001 Mendoza ..... A63C 5/03 280/607
6,254,111 B1 * 7/2001 Servant ..... A63C 5/03 280/14.22
6,290,249 B1 * 9/2001 Wolf ..... A63C 5/126 280/600
6,551,225 B1 * 4/2003 Romero ..... A63B 22/18 482/79
6,575,885 B1 * 6/2003 Week ..... A63B 21/0004 482/148
6,595,541 B2 * 7/2003 Kuchler ..... A63C 5/025 280/607
6,616,583 B1 * 9/2003 Stack ..... A63C 17/01 482/146
6,729,049 B1 * 5/2004 Hui ..... A43B 3/16 36/7.6
6,923,751 B2 8/2005 Oxford
7,086,654 B2 * 8/2006 Sellers ..... B62B 15/00 280/18
7,159,875 B2 * 1/2007 Seymour ..... A63C 5/03 280/607
7,510,206 B2 * 3/2009 Walker ..... A63C 5/025 280/600
D605,244 S 12/2009 Herkner et al.
8,105,218 B1 * 1/2012 Vayntraub ..... A63B 23/1236 482/141
8,356,822 B2 * 1/2013 McLeod ..... A63C 5/0417 280/14.22
8,397,404 B2 * 3/2013 Kim ..... A43B 13/145 482/79
8,678,985 B2 * 3/2014 Mattox ..... A63B 21/0004 482/148
8,814,768 B1 * 8/2014 Yang ..... A63B 21/068 482/121

(56) References Cited

U.S. PATENT DOCUMENTS

| | | | | |
|---|---|---|---|---|
| 8,939,463 | B2 * | 1/2015 | Mendoza | A63C 5/025 280/600 |
| 9,232,829 | B2 * | 1/2016 | Breach | G09B 19/0038 |
| D748,752 | S | 2/2016 | Nokes | |
| 9,352,766 | B2 * | 5/2016 | Marlow | A63C 5/0422 |
| 9,545,557 | B2 * | 1/2017 | Yi | A63C 9/005 |
| 9,950,241 | B2 * | 4/2018 | Pfeifer | A63C 10/14 |
| D882,009 | S | 4/2020 | Pfeifer et al. | |
| 2001/0019198 | A1 * | 9/2001 | Wolf | A63C 5/03 280/609 |
| 2002/0017771 | A1 * | 2/2002 | McManus | A63C 7/04 280/600 |
| 2003/0151215 | A1 * | 8/2003 | Stief | A63C 5/033 280/609 |
| 2005/0110230 | A1 * | 5/2005 | Seymour | A63C 5/02 280/14.21 |
| 2005/0245372 | A1 * | 11/2005 | Mylrea | A63B 23/1236 482/141 |
| 2006/0097484 | A1 * | 5/2006 | Walker | A63C 5/0422 280/600 |
| 2007/0132199 | A1 * | 6/2007 | Smith | A63C 5/03 280/14.21 |
| 2010/0013191 | A1 * | 1/2010 | McKeever | A63C 5/048 280/600 |
| 2011/0079986 | A1 * | 4/2011 | Gradman | A63C 13/005 280/613 |
| 2013/0015638 | A1 * | 1/2013 | Mendoza | A63C 5/025 280/600 |
| 2014/0021689 | A1 * | 1/2014 | Marlow | A63C 5/0422 280/18 |
| 2016/0175686 | A1 * | 6/2016 | Pfeifer | A63C 5/056 280/607 |
| 2018/0207510 | A1 | 7/2018 | Pfeifer et al. | |

FOREIGN PATENT DOCUMENTS

| | | | |
|---|---|---|---|
| SU | 679214 | A1 | 8/1979 |
| WO | WO-2016106143 | A2 | 6/2016 |

OTHER PUBLICATIONS

U.S. Appl. No. 15/891,104, filed Feb. 7, 2018.
U.S. Appl. No. 14/579,170, filed Dec. 22, 2014, Pfeifer et al.
U.S. Appl. No. 26/608,419, filed Jun. 21, 2017, Pfeifer et al.
U.S. Appl. No. 29/731,797, filed Apr. 17, 2020, Pfeifer et al.
U.S. Appl. No. 15/891,104, filed Feb. 7, 2018, Pfeifer et al.

* cited by examiner

SNOW SKI ASSEMBLIES

CROSS-REFERENCE TO RELATED APPLICATIONS

This application is a continuation-in-part of U.S. patent application Ser. No. 15/891,104, filed Feb. 7, 2018, which is a continuation of U.S. patent application Ser. No. 14/579,170, filed Dec. 22, 2014. The entire disclosure of each of the above applications is incorporated herein by reference.

FIELD

The present disclosure generally relates to snow ski assemblies for use by individuals to slide across snow or ice.

BACKGROUND

This section provides background information related to the present disclosure which is not necessarily prior art.

Snow skis are often used by individuals to slide across snow. Typically, the snow skis are long, narrow and rectangular in shape, and allow for movement in only a generally forward direction. Sides of the snow skis are then formed with edges to help the individuals wearing the snow skis turn and stop.

SUMMARY

This section provides a general summary of the disclosure, and is not a comprehensive disclosure of its full scope or all of its features.

Exemplary embodiments of the present disclosure generally relate to snow ski assemblies for use by individuals to slide across snow covered surfaces, for example, under the force of gravity, etc. In one exemplary embodiment, such a snow ski assembly generally includes a ski and a mounting feature. The ski has a bottom wall for engaging a snow covered surface and an upturned peripheral region extending generally around the bottom wall. The bottom wall of the ski includes at least one control structure extending across at least a portion of the bottom wall, where the at least one control structure is configured to control a movement of the ski on the snow covered surface. And, the mounting feature is configured for coupling a binding to the ski, such that an individual can position a foot in the binding and use the ski to slide across the snow covered surface.

In another exemplary embodiment, a ski of a snow ski assembly generally includes a bottom wall for engaging a snow covered surface, where the bottom wall includes at least one recess extending across at least a portion of the bottom wall and where the at least one recess is configured to control a movement of the snow ski on the snow covered surface. The snow ski also includes an upturned peripheral region extending at least partly around a perimeter of the bottom wall to facilitate sliding movement of the snow ski across the snow covered surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
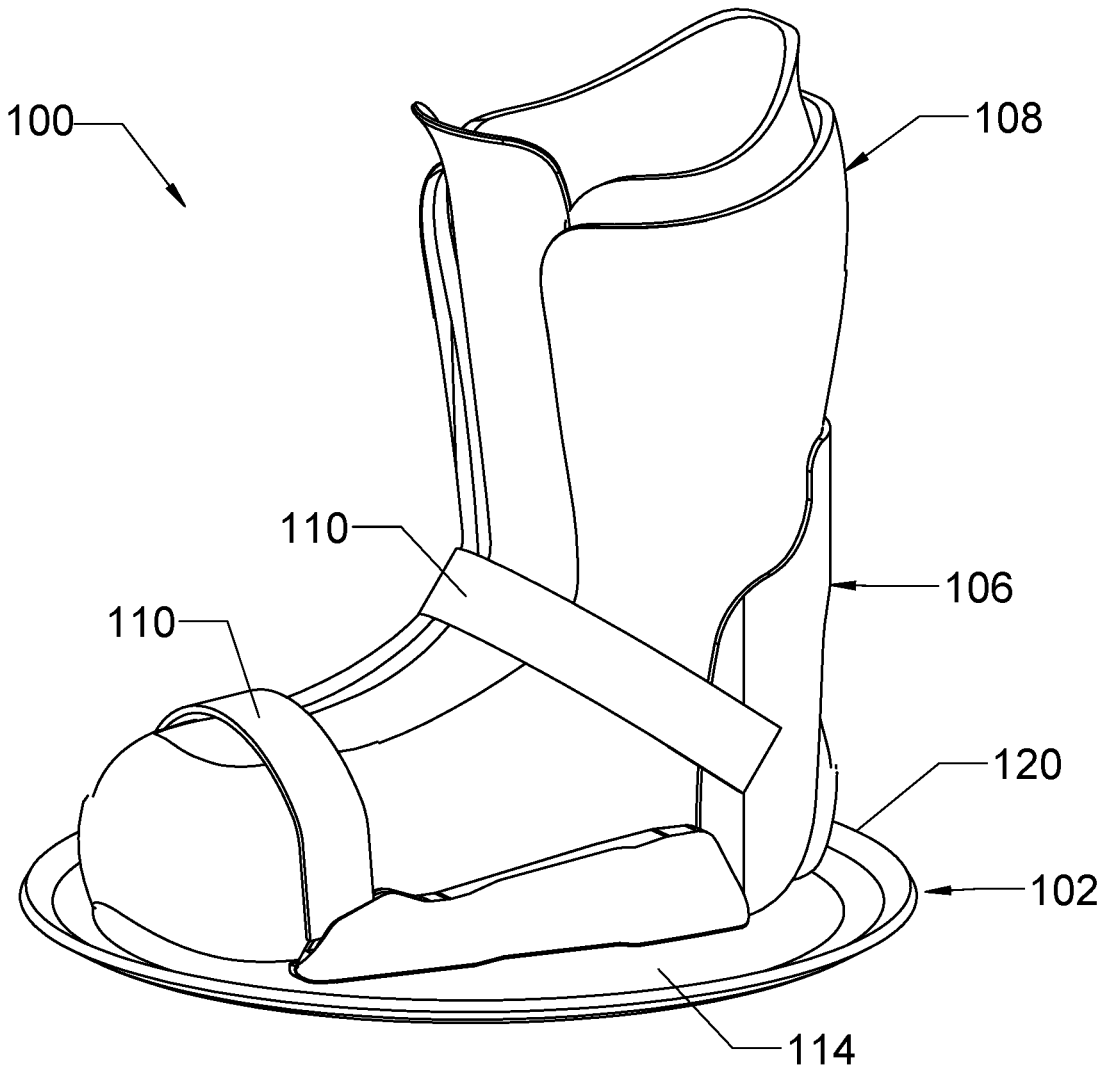
FIG. 1 is an isometric view of an exemplary embodiment of a snow ski assembly according to the present disclosure.
Figure 2:
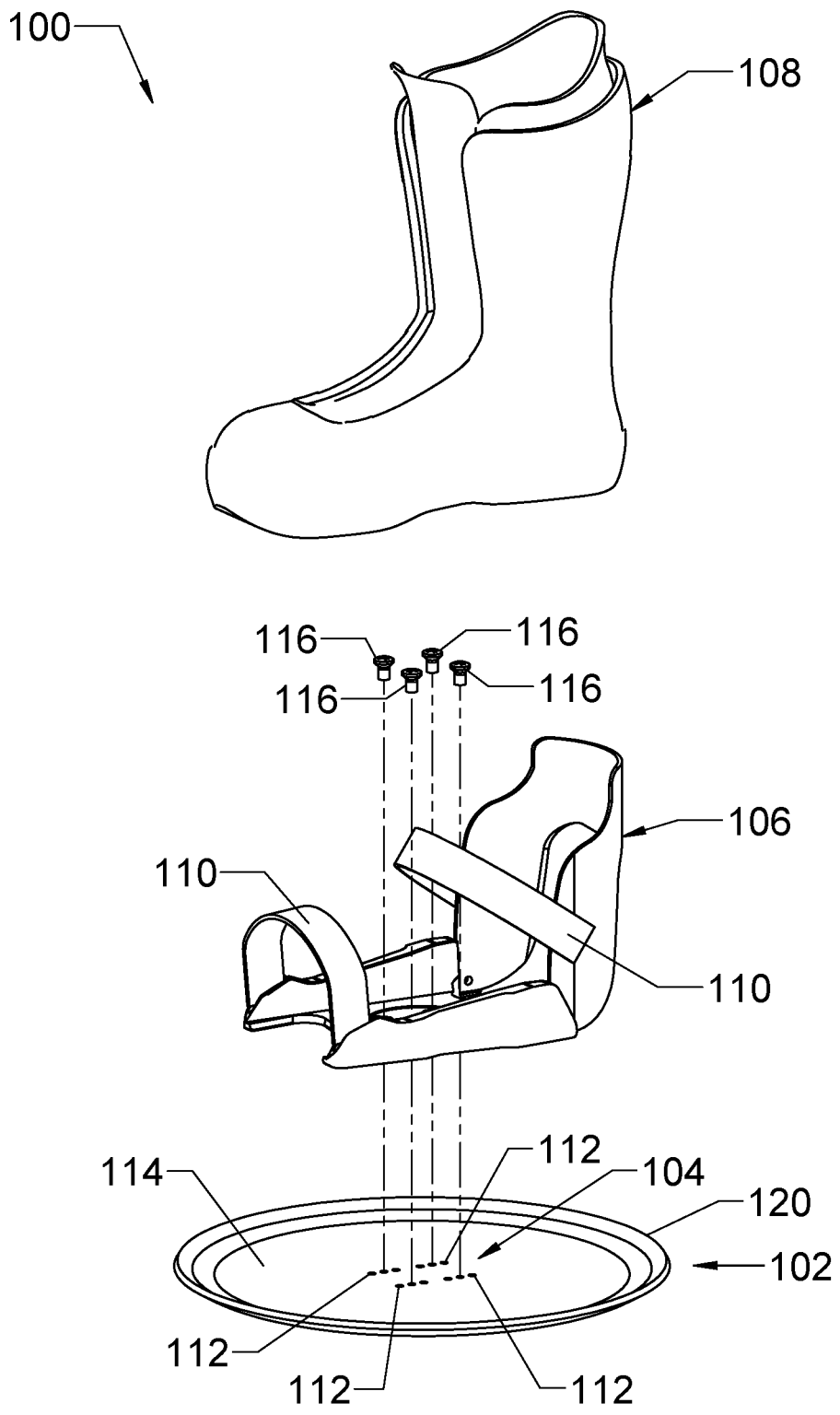
FIG. 2 is an exploded isometric view of the snow ski assembly of FIG. 1.
Figure 3:
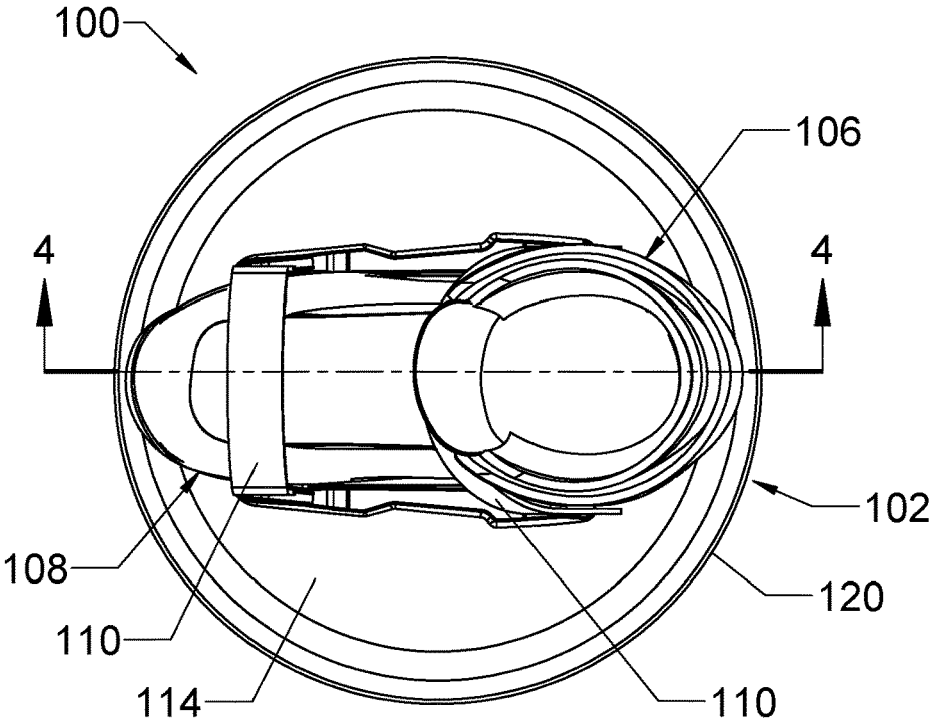
FIG. 3 is a top plan view of the snow ski assembly of FIG. 1.
Figure 4:
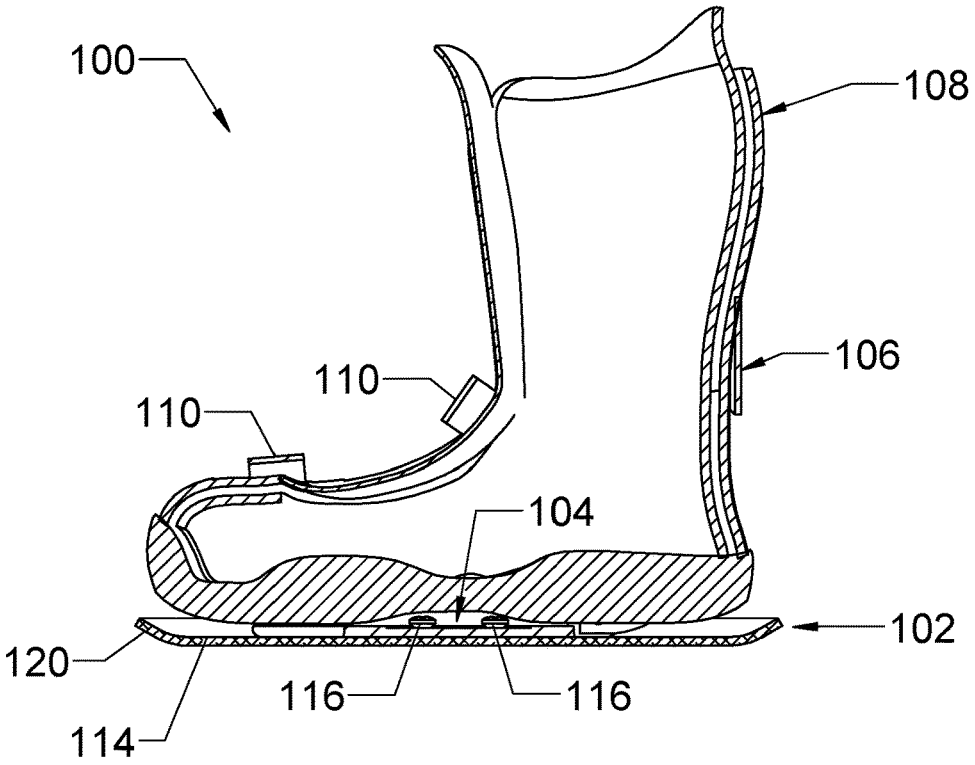
FIG. 4 is a section view of the snow ski assembly of FIG. 1, taken in a plane including line 4-4 in FIG. 3.

The present disclosure generally relates to snow ski assemblies (broadly, transport devices) for use by individuals to travel on snow and/or ice (e.g., move, slide, ski, etc. across the snow and/or ice). The snow ski assemblies are configured to be worn by the individuals on their feet, for example (and without limitation), with one snow ski assembly on each foot (such that two of the snow ski assemblies are used by each of the individuals). The individuals can then use the snow ski assemblies, for example, at a ski slope, etc. to travel across and/or down snow and/or ice on the ski slope under the force of gravity.

Exemplary embodiments of the snow ski assemblies include skis (broadly, bodies) for supporting movement of the individuals wearing the snow ski assemblies. As will be described, in some of these embodiments, the skis, and various features thereof (alone or in combination), facilitate movement of the individuals wearing the snow ski assemblies in any direction (without preference for any one particular direction) across the snow and/or ice (e.g., under the force of gravity, etc.). In other embodiments, the skis, and various features thereof (alone or in combination), allow the individuals to stop the skis and/or control certain movements of (e.g., steer, etc.) the skis while wearing the skis.

In some embodiments, the skis of the snow ski assemblies have generally rounded shapes when viewed in plan. For example, the skis may have generally circular shapes, generally elliptical shapes, etc. The generally rounded shapes of the skis may help facilitate movement of the snow ski assemblies in the multiple different directions (e.g., forward, backward, sideways, etc.). In other embodiments, the skis may have shapes other than rounded shapes, for example, generally octagonal shapes, etc. that may also help facilitate movement of the snow ski assemblies in the multiple different directions. In addition, in some aspects the shapes of the skis may be generally symmetrical, while in other aspects they may be generally asymmetrical or may simply include asymmetries as required or needed to accommodate different movement and acrobatic possibilities.

In some embodiments, the skis of the snow ski assemblies also (or alternatively) include bottom surfaces (e.g., surfaces configured to contact the snow and/or ice when the snow ski assemblies are moving, etc.) with geometries, shapes, etc. that are generally flat (or planar). In these embodiments, the bottom surfaces themselves may be substantially flat, or the bottom surfaces may include portions that are generally flat. In other embodiments, the skis of the snow ski assemblies include bottom surfaces with geometries, shapes, etc. that are generally rounded (or at least partially rounded) (e.g., that have generally rounded cross sections, etc.). In these embodiments, for example, the generally rounded bottom surfaces of the snow ski assemblies may have geometries, shapes, etc. that are generally circular, generally near circular, generally elliptical, generally parabolic, generally hyperbolic, etc. In further embodiments, the skis of the snow ski assemblies may include bottom surfaces with control structures (e.g., recesses, grooves, protrusions, extensions, etc.) configured to control and/or stabilize movement of the skis (e.g., to allow steering, to allow stopping, etc.). It should be appreciated that the various different available geometries, shapes, structures, etc. of the bottom surfaces of the skis of the different embodiments of snow ski assemblies may help accommodate different movements and acrobatic stunts by individuals using the snow ski assemblies. It should also be appreciated that sizes of the bottom surfaces of the skis may vary, for example, to accommodate different movements and acrobatic possibilities by individuals using the skis and/or different sizes of individuals desiring to use the skis.

In some embodiments, the skis of the snow ski assemblies also (or alternatively) include perimeter portions or peripheral regions, extending around the skis, that are upturned (e.g., that transition (e.g., via variable curvature, etc.) from the bottom surfaces, etc.). The upturned portions/regions, for example, may help inhibit, reduce, minimize, etc. interference of the snow and/or ice with movement of the skis and may help accommodate different movement and acrobatic possibilities. In addition, in some embodiments where the upturned portions/regions extend substantially around the skis (e.g., entirely around the skis, at least partly around the skis with one or more discontinuities or voids (e.g., one or more crenellations, etc.), uniformly or non-uniformly around the skis (e.g., with one or more protrusions, etc.), etc.), the upturned portions/regions may further help facilitate movement of the snow ski assemblies in the multiple different directions (e.g., without preference for any one particular direction, etc.). Here, in these embodiments, the skis may be viewed as being free of edges typically used in traditional skis to control and/or stop the skis. However, in some other embodiments, the upturned portions/regions may be used, to various extents, to help control and/or stop the skis. In some aspects, the upturned portions/regions of the skis may be generally flat (e.g., may have portions that are generally flat or generally linear, etc.). In other aspects, the upturned edges of the skis may have geometries, shapes, etc. that are generally rounded or curved (e.g., generally elliptical, generally hyperbolic, etc.). In addition, it should also be appreciated that sizes (e.g., lengths, etc.) of the upturned portions/regions of the skis may vary, for example, to accommodate different movements and acrobatic possibilities by individuals using the skis.

In some embodiments in which the skis of the snow ski assemblies include control structures (e.g., at least one control structure, multiple control structures, etc.) configured to control and/or stabilize movement of the skis, the control structure(s) may define and/or may include one or more edges to engage the snow covered surface to control the movement of the skis on the snow and/or ice covered surface. In addition, in some embodiments, the control structure(s) may extend across bottom surfaces of the skis (e.g. entirely across bottom surfaces of the skis and upturned perimeter portions of the skis, entirely across bottom surfaces of the skis, partially across bottom surfaces of the skis, etc.). Further, in some embodiments the control structure(s) may have generally linear geometries (e.g., grooves and/or protrusions extending across bottom surfaces of the skis in generally linear directions, etc.), generally rounded or curved geometries (e.g., grooves and/or protrusions that are generally circular, generally elliptical, generally S-shaped, etc.), generally symmetrical geometries, nonsymmetrical geometries, other geometries to accommodate different movements and acrobatic possibilities by individuals using the skis, combinations of such geometries, etc. As should be apparent, various control structures may be combined with any other features, embodiments, etc. described herein (such as any skis, bindings, mounting features, bottom walls, upturned portions, etc.), without departing from the scope of the present disclosure.

Exemplary embodiments of the snow ski assemblies also include mounting features for use in coupling bindings to the skis of the snow ski assemblies. The bindings are configured to secure boots to the skis, such that the individuals using the snow ski assemblies can wear the boots on their feet with the skis coupled thereto (via the bindings). In some aspects, the mounting features of the snow ski assemblies may be integral (or monolithic) with the skis (e.g., the mounting features may be integrally formed with upper surfaces of the skis, may be defined by portions of the skis, etc.). In other aspects, the mounting features may be separate components from the skis and configured to couple to the skis (e.g., to the upper surfaces of the skis, etc.). Further, the bindings may include conventional bindings such as those used with skis, snowboards, etc., or the bindings may include unconventional bindings such as straps, magnets, hooks, clamps, etc.

Exemplary embodiments of the snow ski assemblies will now be described more fully with reference to the accompanying drawings.

FIGS. 1-7 illustrate an exemplary embodiment of a snow ski assembly 100 (again broadly, a transport device) according to the present disclosure. The snow ski assembly 100 of this embodiment is configured to be worn by an individual on one of the individual's feet, with a second snow ski assembly (e.g., a second snow ski assembly that is the same as snow ski assembly 100, snow ski assembly 200, snow ski assembly 300, snow ski assembly 400, snow ski assembly 500, etc.) then configured to be worn by the individual on the other one of the individual's feet. As such, the individual uses two of the snow ski assemblies to travel (e.g., move, slide, etc.) across snow and/or ice as desired, for example, at a ski slope under the force of gravity, etc. Uniquely, the snow ski assembly 100 allows the individual to move in any direction across the snow and/or ice without preference for any one particular direction.

As shown in FIGS. 1-4, the snow ski assembly 100 generally includes a ski 102 (broadly, a body), a mounting feature 104 (e.g., a mount, a mounting structure, a mounting portion, etc.), and a binding 106. The binding 106 couples to the ski 102 at the mounting feature 104 and is configured to secure a boot 108 to the ski 102 so that the individual can wear the ski 102, via the boot 108 and binding 106, on one of the individual's feet. The illustrated binding 106 includes straps 110 that secure over, around, etc. the boot 108 to hold the boot 108 (and the individual's foot inside the boot 108) in the binding 106 (and, thus, the ski 102 on the individual's foot). However, other means may be used with the binding 106 for securing the boot 108 in the binding 106 (e.g., friction fittings, clips, other mechanical fasteners, etc.). In addition, it should be appreciated that any suitable binding can be used with the snow ski assembly 100 within the scope of the present disclosure.

The mounting feature 104 of the snow ski assembly 100 includes multiple openings 112 defined in a bottom wall 114 of the ski 102. Fasteners 116 (e.g., screws, etc.) are configured to extend through openings in a lower portion of the binding 106, and into the corresponding openings 112, to couple the binding 106 to the mounting feature 104 (and to the ski 102). The position of the binding 106 on the ski 102 can be adjusted, as desired, by moving the fasteners 116 to different ones, or instances, of the openings 112 (which results in a different positioning of the binding 106 on the ski 102). In the illustrated embodiment, the mounting feature 104 includes twelve openings 112, arranged in four groups of three. And four fasteners 116 are used to couple the binding 106 to the mounting feature 104 (with one of the four fasteners 116 positioned in one of the openings 112 of each group, depending on desired positioning of the binding 106 on the ski 102). It should be appreciated that the mounting feature 104 may include a different number and/or arrangement of openings 112, and/or a different number of fasteners 116 may be used to couple the binding 106 to the mounting feature 104, for example, to accommodate different bindings, etc. In addition, in other exemplary embodiments, snow ski assemblies may include mounting features with structure other than openings (e.g., clips, straps, etc.) for use in coupling bindings to skis.

In the illustrated embodiment, the mounting feature 104 is integrally defined by (e.g., monolithically formed with, etc.) the ski 102 of the snow ski assembly 100. In other exemplary embodiments, snow ski assemblies may include mounting features separate from skis and attached thereto (see, for example, the snow ski assembly 200 illustrated in FIGS. 8-14, etc.).

With continued reference to FIGS. 1-4, the ski 102 of the snow ski assembly 100 is sized to receive the boot 108 generally within a footprint of the ski 102. In particular, the illustrated ski has a diameter dimension of about sixteen inches for receiving the correspondingly sized boot 108. However, the ski 102 may be sized differently as desired (e.g., the ski 102 may have a diameter dimension greater than or less than about sixteen inches, etc.), for example, to permit production of the ski 102 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches or more, etc.

Figure 5:
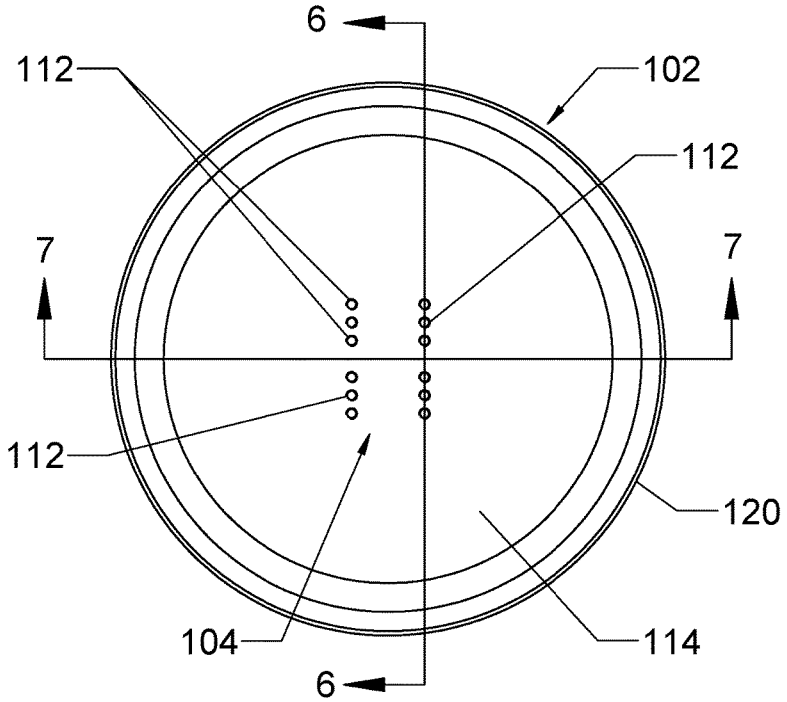
FIG. 5 is a top plan view of a ski of the snow ski assembly of FIG. 1.
Figure 6:
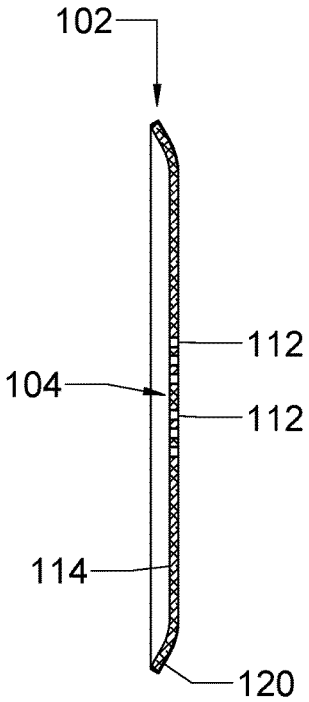
FIG. 6 is a section view of the ski of FIG. 5, taken in a plane including line 6-6 in FIG. 5.
Figure 7:
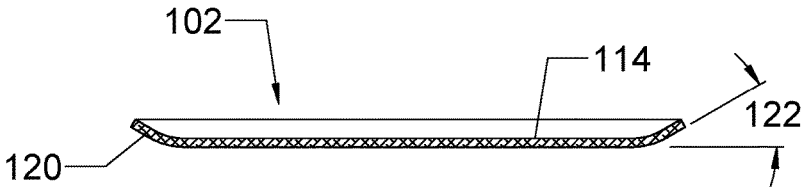
FIG. 7 is a section view of the ski of FIG. 5, taken in a plane including line 7-7 in FIG. 5.
Figure 8:
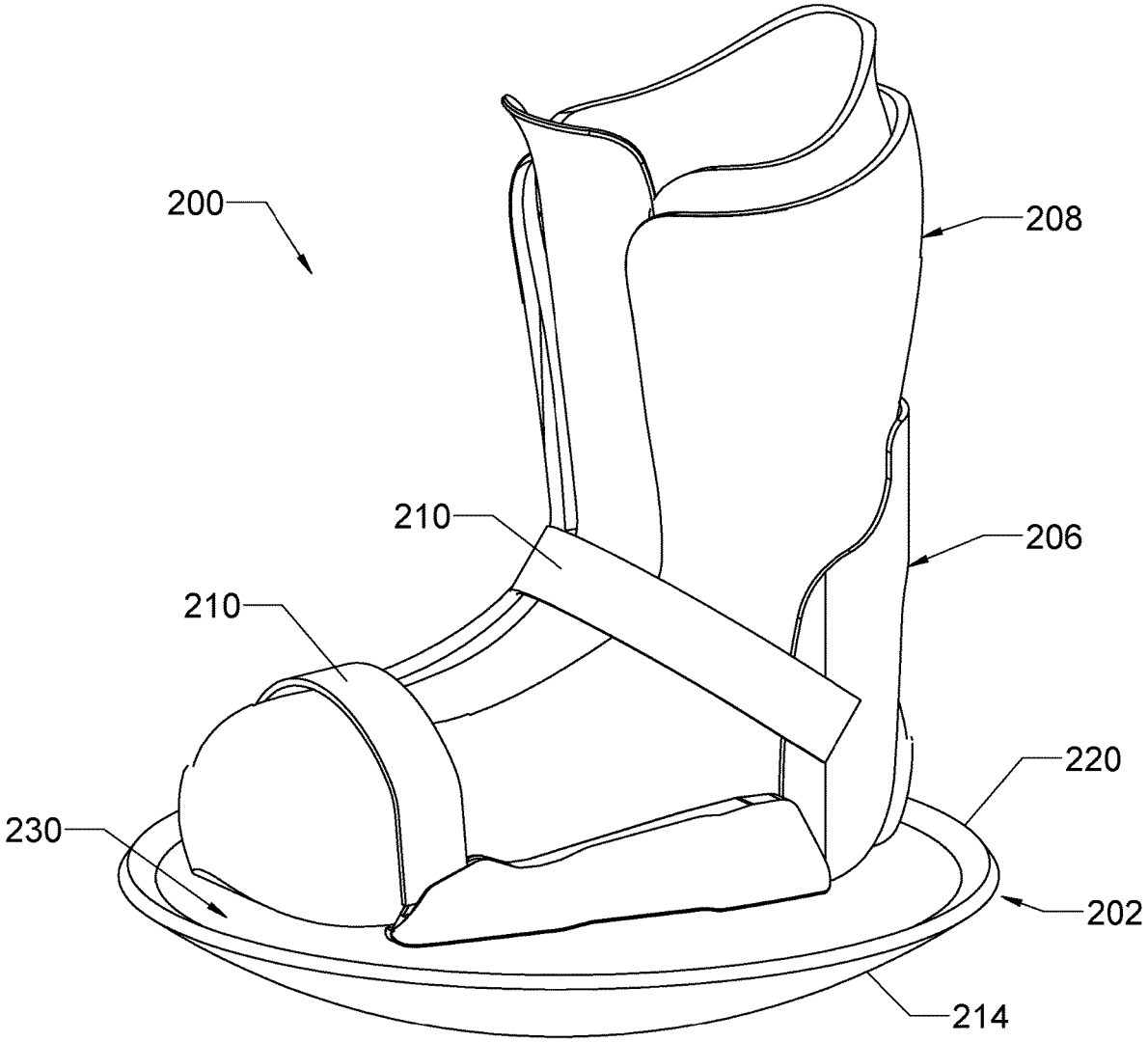
FIG. 8 is an isometric view of another exemplary embodiment of a snow ski assembly according to the present disclosure.
Figure 9:
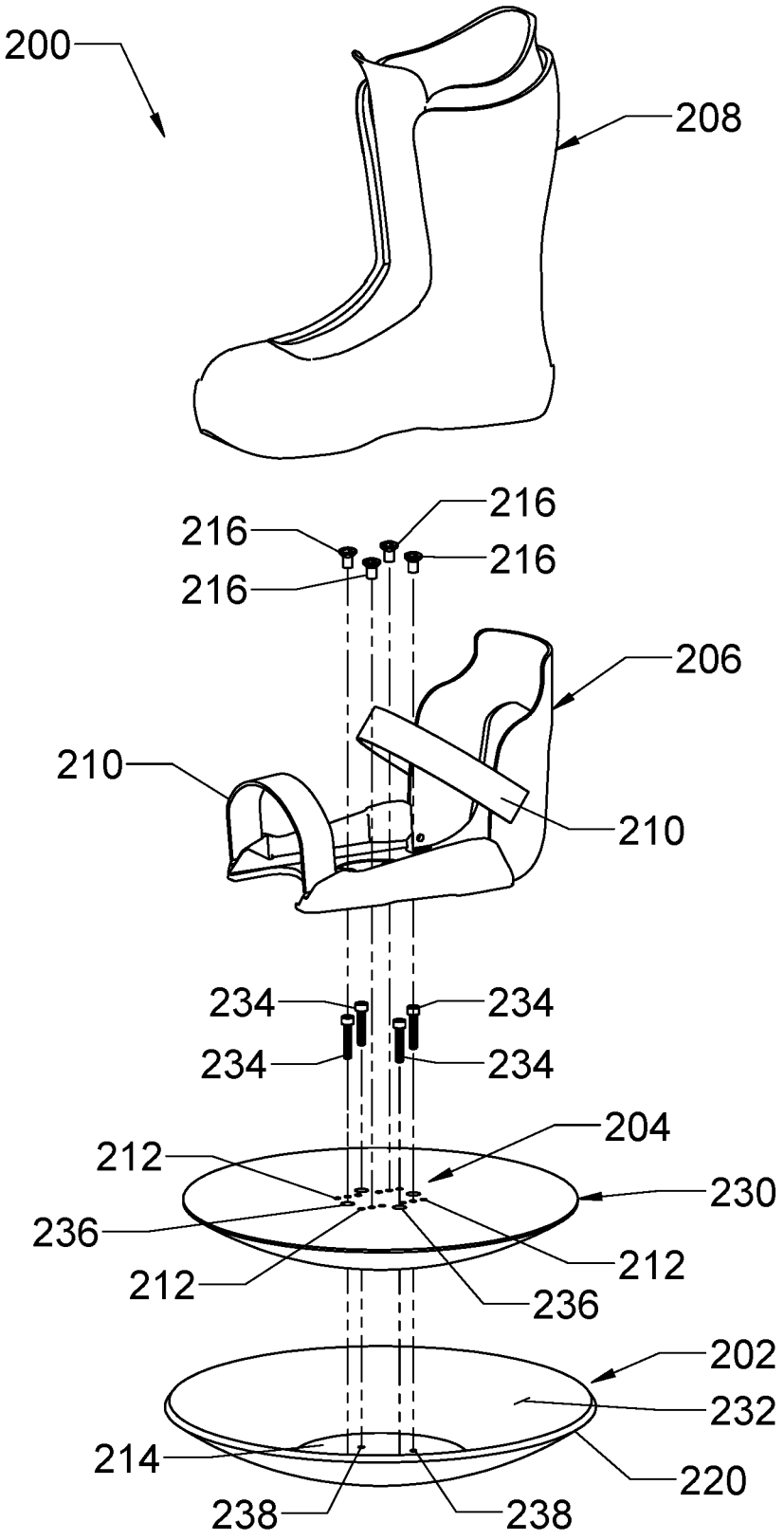
FIG. 9 is an exploded isometric view of the snow ski assembly of FIG. 8.
Figure 10:
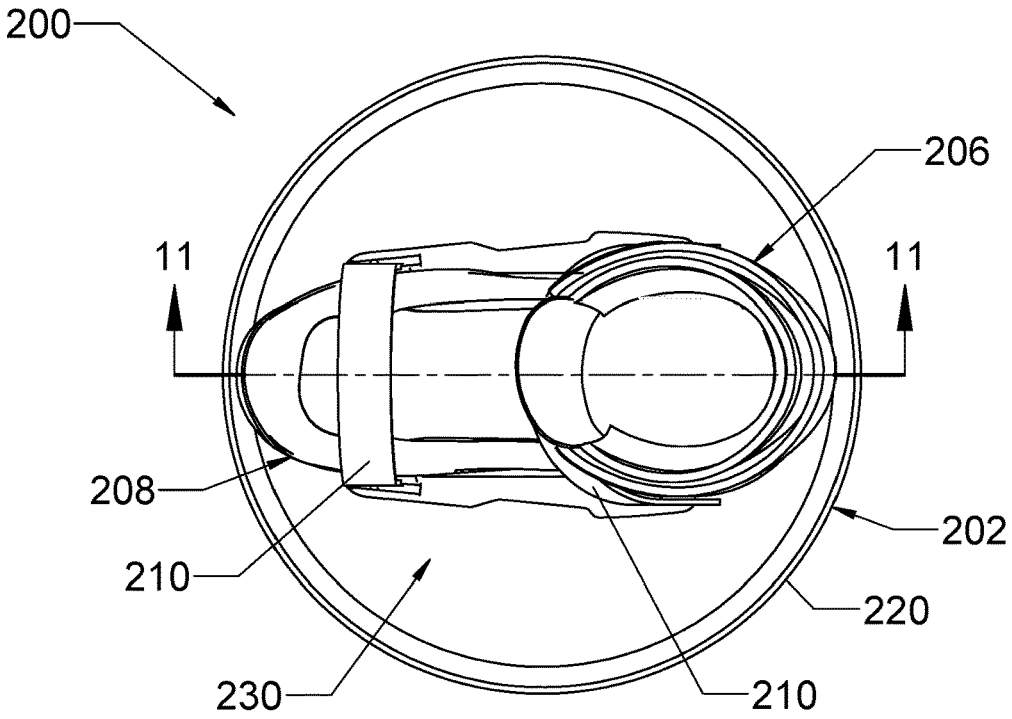
FIG. 10 is a top plan view of the snow ski assembly of FIG. 8.

With additional reference now to FIGS. 5-7, the ski 102 of the snow ski assembly 100 generally includes the bottom wall 114 having an upturned peripheral region 120 (e.g., an upturned lip portion, an upturned peripheral portion located toward a perimeter of the bottom wall 114, an upturned sidewall, etc.). The upturned peripheral region 120 of the ski 102 generally extends around a peripheral portion (or perimeter portion) of the bottom wall 114 (e.g., the upturned peripheral region 120 extends generally continuously around the bottom wall 114 of the ski 102, at least partly around the bottom wall 114 with one or more discontinuities or voids in the upturned peripheral region 120 (e.g., one or more crenellations, etc.), uniformly or non-uniformly (e.g., with one or more protrusions, etc.) around the bottom wall 114, etc.) and is generally free of protrusions and obstructions. And together, the bottom wall 114 and the upturned peripheral region 120 provide the ski 102 with a generally circular (or disk) shape or footprint (when viewed in plan). In the illustrated embodiment, the bottom wall 114 and the upturned peripheral region 120 thereof are integrally formed. However, in other embodiments, the peripheral region 120 may be separate from the bottom wall 114 and attached thereto (e.g., welded thereto, etc.). In addition, in other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 120 may vary, for example, to accommodate different movements and acrobatic possibilities by individuals using the ski.

The bottom wall 114 of the ski 102 (e.g., a central region of the ski 102, etc.) is generally flat (or planar) across a width (e.g., along a diameter dimension, etc.) of the ski 102, and is generally radially symmetric. And, the upturned peripheral region 120 of the ski 102 is generally flat (or generally linear) along a length of the peripheral region 120 from the flat bottom wall 114 to a perimeter edge of the ski 102. In the illustrated embodiment, the upturned peripheral region 120 forms an angle 122 with the flat bottom wall 114 of about thirty degrees (generally consistently around the perimeter of the ski 102). However, the angle 122 may be greater than or less than about thirty degrees, as desired (e.g., depending on desired movement of the ski 102 across snow and/or ice, etc.) (e.g., the angle 122 may include an angle greater than zero degrees, etc.). In addition, in other exemplary embodiments, snow ski assemblies may include skis with bottom walls and/or peripheral regions having geometries, shapes, etc. that are other than generally flat and/or that are asymmetric and/or that include asymmetries (e.g., to help accommodate different movements and/or acrobatic possibilities using the snow ski assemblies, etc.). For example, in such embodiments, the bottom walls and/or the peripheral regions of the skis may include geometries, shapes, etc. that are generally rounded (e.g., generally circular shapes, generally near circular shapes, generally elliptical shapes, generally parabolic shapes, generally hyperbolic shapes, etc.), etc.

That said, it should be appreciated that in some embodiments the geometry of the bottom wall 114 and/or the peripheral region 120 of the ski 102 may vary across the ski 102, such that the bottom wall 114, the peripheral region 120, and/or the ski 102 does/do not have a uniform geometry. For example, the bottom wall 114 may have a generally circular shape while the upturned peripheral region 120 is more elliptical. Or, a front portion of the bottom wall 114 may have a generally circular shape while a back portion of the bottom wall 114 may have a more parabolic shape, etc. Further, a portion of the bottom wall 114 may have a square shape, a triangular shape, or other symmetrical or nonsymmetrical shape. That said, the varying geometries of the bottom wall 114 and/or the upturned peripheral region 120 may affect how the bottom wall 114 of the ski 102 interacts with the snow and/or ice, to accommodate different movements and acrobatic possibilities by individuals using the ski 102.

In addition, in some embodiments a thickness of the bottom wall 114 and/or the upturned peripheral portion 120 may vary. For example, a thickness near a perimeter of the ski 102 (e.g., at the upturned peripheral region 120 or at an outer portion of the bottom wall 114, etc.) may be greater than a thickness near a center of the ski 102 (e.g., a central portion of the bottom wall 114, etc.). In various implementations, a thickness of the upturned peripheral region 120 or outer portion of the bottom wall 114 may be about 0.25 inches (e.g., between about 0.1 inches about 1 inch, etc.), while a thickness of the central portion of the bottom wall 114 may be in a range from about 0.05 inches to about 0.5 inches. Alternatively, a thickness of the ski 102 near a perimeter of the ski 102 (e.g., at the upturned peripheral region 120 or an outer portion of the bottom wall 114, etc.) may be less than a thickness near a center of the ski 102 (e.g., a central portion of the bottom wall 114). In various implementations, a thickness of the upturned peripheral region 120 or outer portion of the bottom wall 114 may be in a range from about 0.05 inches to about 0.5 inches, while a thickness of the central portion of the bottom wall 114 may be about 0.25 inches (e.g., between about 0.1 inches about 1 inch, etc.). As should be apparent, other embodiments/implementations may use or have any other suitable thicknesses and/or differences in thicknesses of the bottom wall 114 and/or peripheral region 120 across the ski 102. In this manner, the thickness of the ski 102 may increase or decrease when moving in a direction from the upturned peripheral region 120 towards the central portion of the bottom wall 114.

In other embodiments, the thickness of the ski 102 may vary in still other manners, such as one side of the ski 102 being thicker than another side, a center portion (e.g., a center strip portion, another center portion, etc.) of the bottom wall 114 being thicker than the rest of the ski 102 (e.g., than the rest of the bottom wall 114, etc.), a center portion of the bottom wall 114 being thinner than the rest of the ski 102 (e.g., the rest of the bottom wall 114, etc.), etc. In any case, the varying thickness of the ski 102 as described herein may affect how the bottom wall 114 and/or the peripheral region 120 of the ski 102 interacts with the snow and/or ice, to accommodate different movements and acrobatic possibilities by individuals using the ski 102. As should be apparent, various bottom wall thicknesses and geometries, and various upturned portion thicknesses and geometries, may be combined with any other features, embodiments, etc. described herein (such as any skis, bindings, mounting features, control structures, etc.), without departing from the scope of the present disclosure.

In use of the snow ski assembly 100 (i.e., when the snow ski assembly 100 is worn by the individual on one of the individual's feet), the bottom wall 114 (e.g., a bottom surface of the bottom wall 114, etc.) engages the snow and/or ice during movement of the snow ski assembly 100.

And, the upturned peripheral region 120 allows the ski 102 to move over the snow and/or ice without interference from the snow and/or ice (e.g., as compared to traditional rectangular-shaped skis that have edges on their long sides that are configured to dig into the snow and/or ice, etc.). Further, the shape of the ski 102 (as described above) and the positioning of the upturned peripheral region 120 around the entire peripheral portion of the bottom wall 114 allows movement of the ski 102 in any direction without such interference from the snow and/or ice (e.g., without the snow and/or ice engaging a side cut or other formed edge of the ski 102 as in traditional snow skis, without the ski 102 digging or biting into the snow and/or ice as in traditional snow skis, etc.). However, it should be appreciated that this does not infer that a user of the snow ski assembly 100 could not, by means of manipulation of his or her body, rotate (e.g., tip, tilt, etc.) the ski assembly 100 such that the upturned peripheral region 120 could be used for control if desired.

As described above, the snow ski assembly 100 is configured to be used in combination with a second snow ski assembly by an individual, such that one snow ski assembly is worn on each foot by the individual. The two snow ski assemblies used by the individual may be the same, for example, both may be the snow ski assembly 100 illustrated in FIGS. 1-7. Alternatively, two different snow ski assemblies may be used. For example, one may be the snow ski assembly 100 illustrated in FIGS. 1-7, and the other may be any one of the other snow ski assemblies described herein (e.g., snow ski assembly 200, etc.), or any other suitable snow ski assembly.

While the above embodiment of the ski assembly 100 is described as being configured to be worn by an individual on one of the individual's feet, with a second snow ski assembly then configured to be worn by the individual on the other one of the individual's feet, in some embodiments, one ski 102 may be adapted to accommodate both feet of an individual. For example, the snow ski assembly 100 may be sized to receive two boots 108 generally within a footprint of the ski 102 (e.g., such that both boots 108 are side-by-side and parallel, such that both boots 108 are side-by-side and not parallel (e.g., one boot is angled relative to the other boot, etc.), such that the boots 108 are offset with one boot generally ahead of the other boot, such that one of the boots 108 is elevated or higher than the other boot, other symmetrical orientations of the boots 108, other nonsymmetrical orientations of the boots 108, etc.). In particular, the ski 102 may have a diameter of about thirty-two inches (or more or less) for receiving two boots 108. However, the ski 102 may be sized differently as desired, for example, to accommodate different users having different foot sizes and, thus, different sizes of the two boots. In addition, the ski 102 may be sized to allow the boots to be positioned symmetrically on the ski 102, for the boots to be positioned offset from one another, for the boots to be spaced apart from one another in a range of narrower distance (e.g., one inch or less apart) to wider distance (e.g., twenty-four inches apart or more). The ski 102 may be sized to allow the mounting features 104 and the bindings 106 to accommodate different positions of the boots. As should be apparent, any suitable embodiments and features described herein (such as any skis, bindings, mounting features, bottom walls, upturned portions, etc.), may be combined with a snow ski assembly sized to receive two boots, without departing from the scope of the present disclosure.

FIGS. 8-14 illustrate another exemplary embodiment of a snow ski assembly 200 according to the present disclosure. The snow ski assembly 200 of this embodiment is similar to the snow ski assembly 100 previously described and illustrated in FIGS. 1-7. For example, the snow ski assembly 200 of this embodiment is again configured to be worn by an individual on one of the individual's feet, with a second snow ski assembly 200 (e.g., another snow ski assembly 200, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 200 allows the individual to move in any direction across the snow and/or ice without preference for any one particular direction.

As shown in FIGS. 8-11, the snow ski assembly 200 of this embodiment generally includes a ski 202, a spacer 230, a mounting feature 204, and a binding 206. The spacer 230 couples to the ski 202 within an interior region 232 defined by the ski 202. Fasteners 234 (e.g., screws, etc.) are configured to extend through openings 236 of the spacer 230, and into corresponding openings 238 in a lower portion of the ski 202, to thereby couple the spacer 230 to the ski 202. And, the binding 206 couples to the ski 202 at the mounting feature 204, via the spacer 230, and is configured to secure a boot 208 to the ski 202 so that the individual can wear the ski 202, via the boot 208 and binding 206, on one of the individual's feet. Straps 210 of the binding 206 then help hold the boot 208 in the binding 206. As can be seen, the spacer 230 provides a generally flat surface on which to mount the boot 208, and is configured to elevate the binding 206 generally above the ski 202 so that the boot 208 can be received in the binding 206 without interference from the ski 202. With that said, it should again be appreciated that any suitable binding can be used with the snow ski assembly 200.

The mounting feature 204 of the snow ski assembly 200 includes multiple openings 212 defined in an upper surface of the spacer 230. Fasteners 216 are configured to extend through openings in a lower portion of the binding 206, and into the corresponding openings 212, to couple the binding 206 to the mounting feature 204 (and to the spacer 230 and ski 202). The position of the binding 206 on the ski 202 (and on the spacer 230) can be adjusted, as desired, by moving the fasteners 216 to different ones, or instances, of the openings 212 (which results in a different positioning of the binding 206 on the ski 202). In the illustrated embodiment, the mounting feature 204 includes twelve openings 212, arranged in four groups of three. And four fasteners 216 are used to couple the binding 206 to the mounting feature 204 (with one of the four fasteners 216 positioned in one of the openings 212 of each group, depending on desired positioning of the binding 206 on the ski 202). It should be appreciated that the mounting feature 204 may include a different number and/or arrangement of openings 212, and/or a different number of fasteners 216 may be used to couple the binding 206 to the mounting feature 204, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 204 of the snow ski assembly 200 is separate from the ski 202. The mounting feature 204 is integrally defined by (e.g., monolithically formed with, etc.) the spacer 230 of the snow ski assembly 200 and then coupled, via the spacer 230, to the ski 202. In other exemplary embodiments, snow ski assemblies may include mounting features separate from spacers and coupled thereto. In addition, in other exemplary embodiments, snow ski assemblies may include spacers (and, in some embodiments, mounting features) integrally defined by (e.g., monolithically formed with, etc.) skis.

With continued reference to FIGS. 8-11, the ski 202 and spacer 230 of the snow ski assembly 200 are sized to receive the boot 208 generally within a footprint of the ski 202. In particular, the illustrated ski 202 has a major diameter dimension of about sixteen inches for receiving the correspondingly sized spacer 230 in the interior region 232 of the ski 202, and the correspondingly sized boot 208 thereon. In addition, the spacer 230 is sized such that the upper surface of the spacer 230 is positioned generally below an upper edge of the ski 202 by a distance 224 (FIG. 14) (e.g., about 0.25 inches, about 0.5 inches, about 1 inch, distances therebetween, other distances such as distances greater than about 1 inch or less than about 0.25 inches, etc.). However, the ski 202 and/or the spacer 230 may be sized differently as desired (e.g., the ski 202 may have a diameter dimension greater than or less than about sixteen inches, etc.), for example, to permit production of the ski 202 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches or more, etc., and spacers configured to fit within interior regions of the skis.

Figure 12:
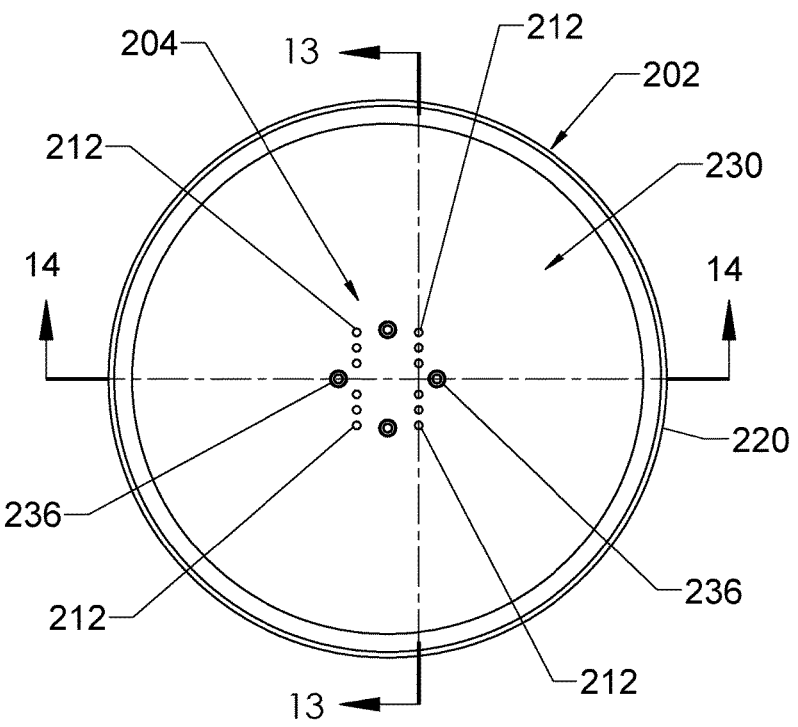
FIG. 12 is a top plan view of a ski of the snow ski assembly of FIG. 8.
Figure 13:
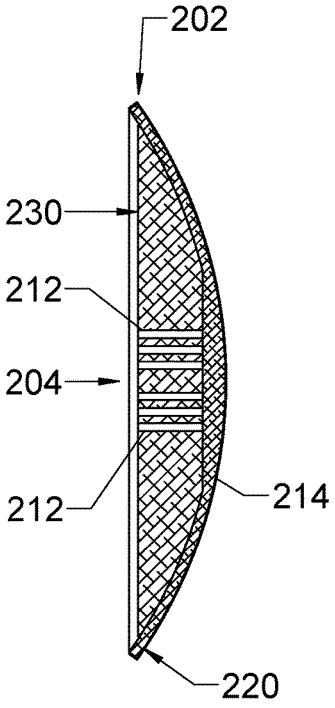
FIG. 13 is a section view of the ski of FIG. 12, taken in a plane including line 13-13 in FIG. 12.
Figure 14:
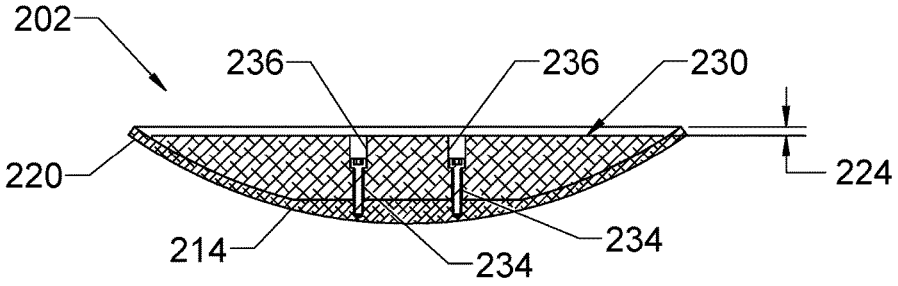
FIG. 14 is a section view of the ski of FIG. 12, taken in a plane including line 14-14 in FIG. 12.
Figure 15:
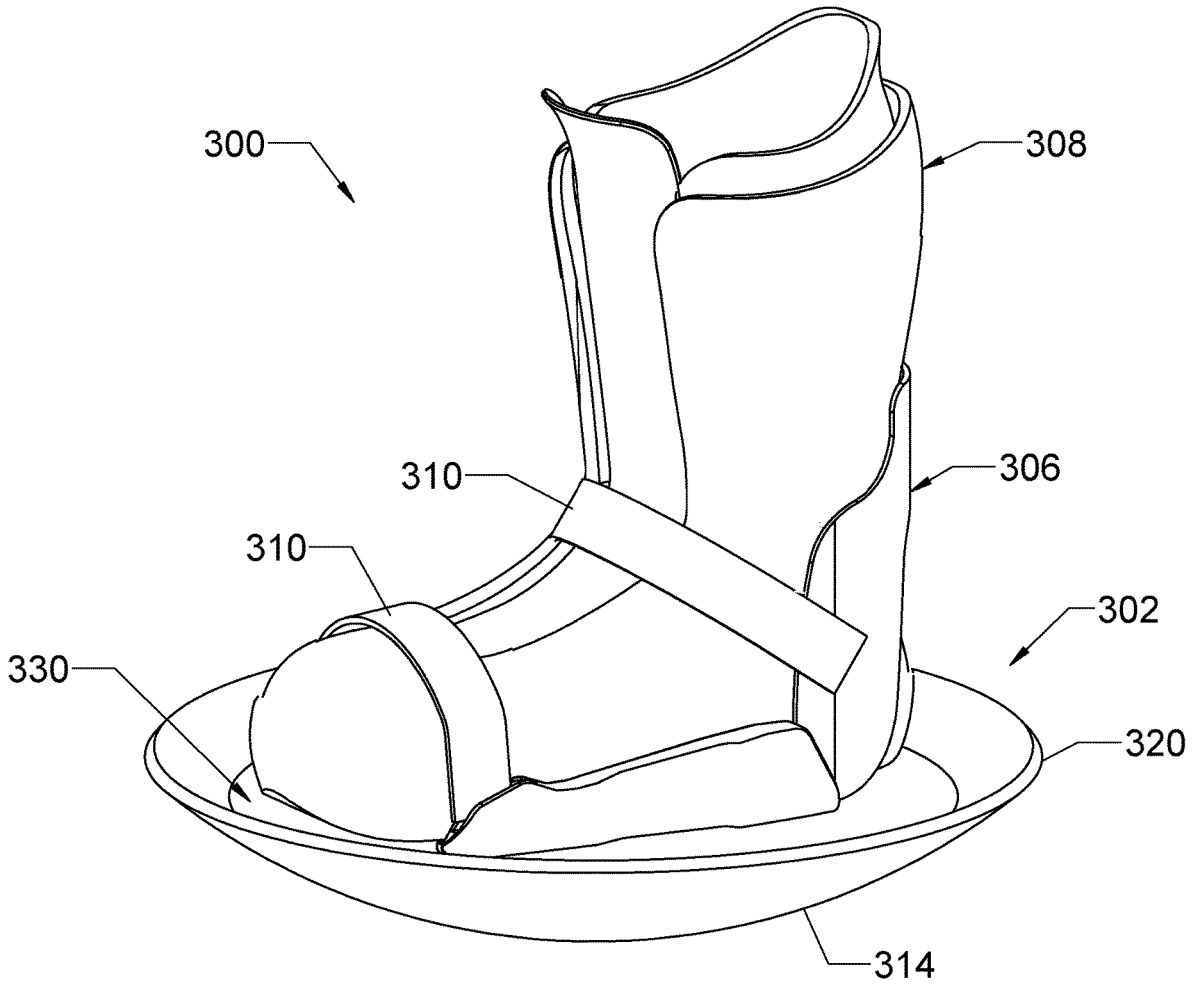
FIG. 15 is an isometric view of another exemplary embodiment of a snow ski assembly according to the present disclosure.
Figure 16:
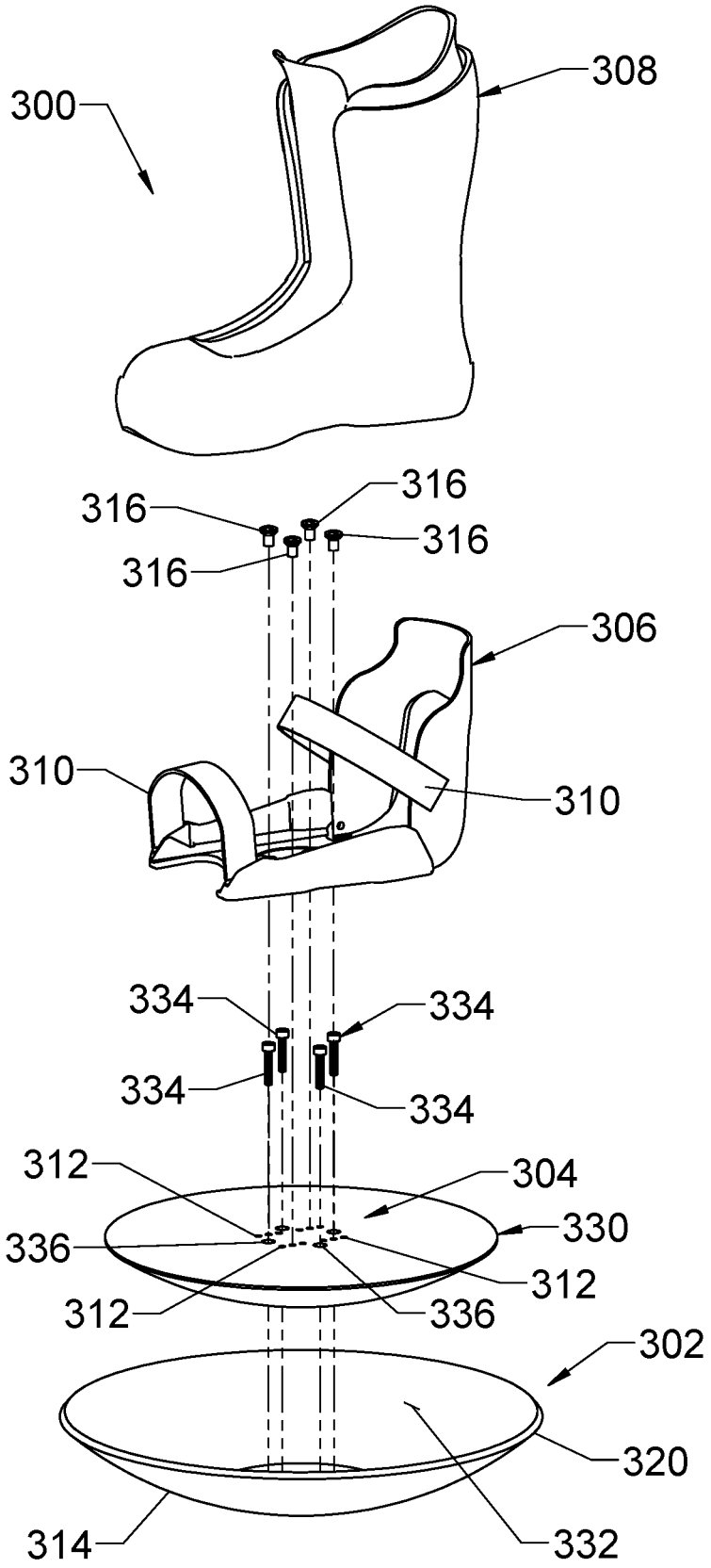
FIG. 16 is an exploded isometric view of the snow ski assembly of FIG. 15.
Figure 17:
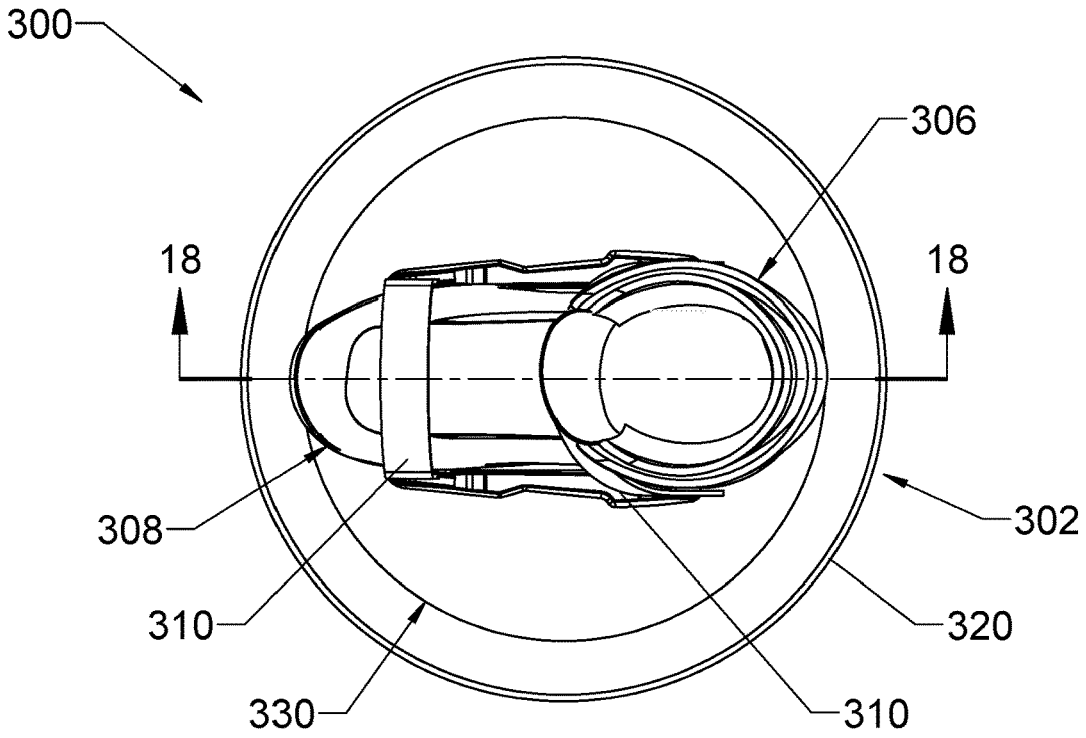
FIG. 17 is a top plan view of the snow ski assembly of FIG. 15.
Figure 18:
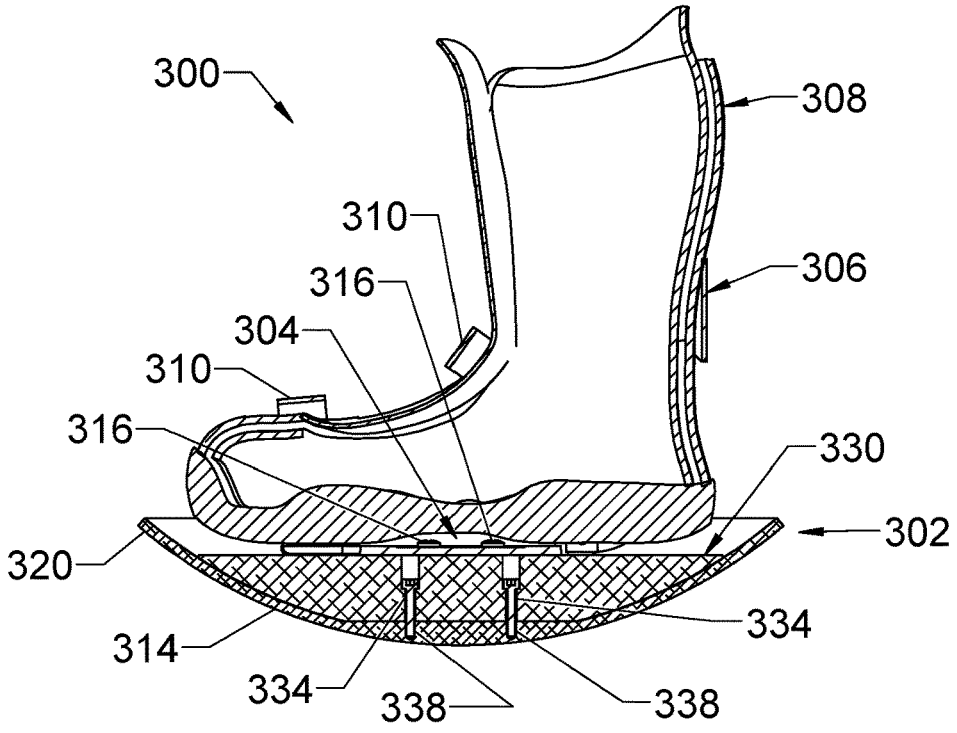
FIG. 18 is a section view of the snow ski assembly of FIG. 15, taken in a plane including line 18-18 in FIG. 17.

With additional reference now to FIGS. 12-14, the ski 202 of the snow ski assembly 200 generally includes a bottom wall 214 having an upturned peripheral region 220 (e.g., an upturned lip, an upturned peripheral edge located toward a perimeter of the bottom wall 214, etc.). The upturned peripheral region 220 of the ski 202 generally extends around a peripheral portion (or perimeter portion) of the bottom wall 214 (e.g., the upturned peripheral region 220 extends generally continuously around the bottom wall 214 of the ski 202, etc.) and is generally free of protrusions and obstructions. And together, the bottom wall 214 and the upturned peripheral region 220 provide the ski 202 with a generally circular (or disk) shape or footprint (when viewed in plan). In other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 220 may vary, for example, to accommodate different movements and acrobatic possibilities by individuals using the ski 202.

Figure 11:
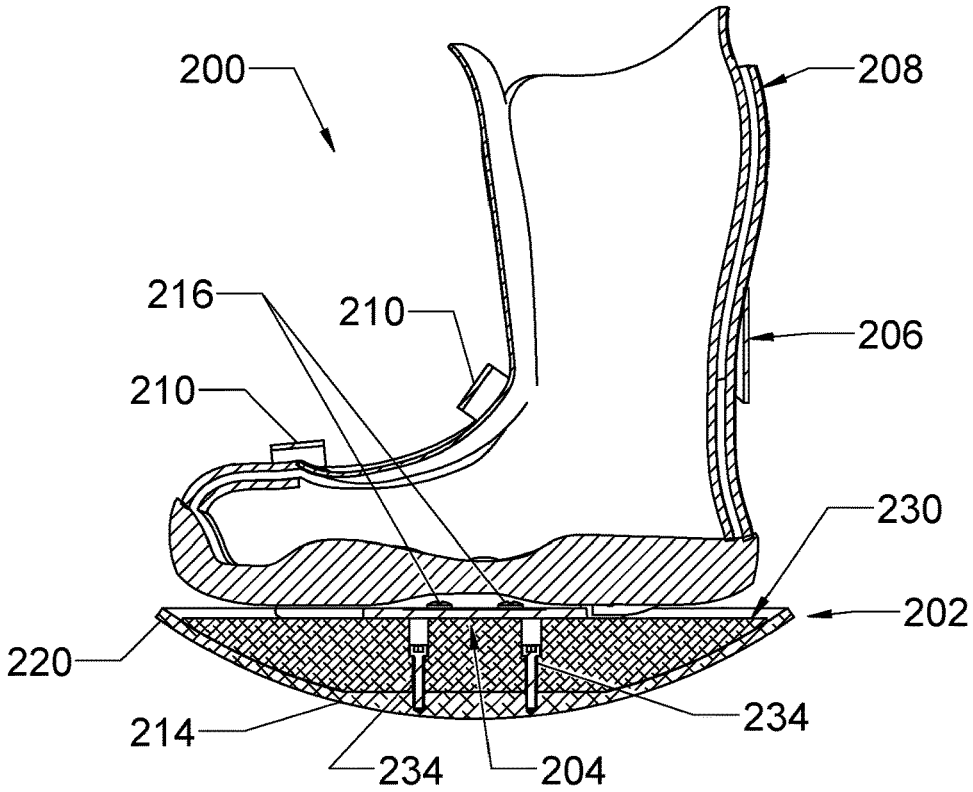
FIG. 11 is a section view of the snow ski assembly of FIG. 8, taken in a plane including line 11-11 in FIG. 10.

The bottom wall 214 of the ski 202 (e.g., a central region of the ski 202, etc.) is generally rounded from the peripheral region 220 on one side of the ski 202 to the peripheral region 220 on the other side of the ski (e.g., defines a generally rounded cross section as shown in FIGS. 11, 13, 14; etc.), and is generally radially symmetric. In the illustrated embodiment, the rounded bottom wall 214 of the ski 202 is generally circular (or arc) shaped and extends/transitions smoothly to the upturned peripheral region 220 generally consistently around the perimeter of the ski 202 (such that, in this embodiment, the upturned peripheral region 220 is an extension of the bottom wall 214 and generally coincides with the bottom wall 214). However, the rounded bottom wall 214 may have other shapes, for example, generally near circular shapes, generally elliptical shapes, generally parabolic shapes, generally hyperbolic shapes, etc. and/or other geometries (e.g., asymmetric geometries, generally symmetric geometries that include asymmetries to help accommodate different movements and acrobatic possibilities, etc.) within the scope of the present disclosure (e.g., to help accommodate different movements and/or acrobatic possibilities using the snow ski assemblies, etc.).

That said, it should again be appreciated that in some embodiments the geometry of the bottom wall 214 and/or the peripheral region 220 of the ski 202 may vary across the ski 202, such that the bottom wall 214, the peripheral region 220, and/or the ski 202 does not have a uniform geometry. The varying geometries of the bottom wall 214 and/or the upturned peripheral region 220 may affect how the bottom wall 214 of the ski 202 interacts with the snow and/or ice, to accommodate different movements and acrobatic possibilities by individuals using the ski 202.

In addition, in some embodiments a thickness of the bottom wall 214 and/or the upturned peripheral portion 220 may vary. For example, a thickness near a perimeter of the ski 202 (e.g., at the upturned peripheral region 220 or at an outer portion of the bottom wall 214, etc.) may be greater than a thickness near a center of the ski 202 (e.g., a central portion of the bottom wall 214, etc.). Alternatively, a thickness of the ski 202 near a perimeter of the ski 202 (e.g., at the upturned peripheral region 220 or an outer portion of the bottom wall 214, etc.) may be less than a thickness near a center of the ski 202 (e.g., a central portion of the bottom wall 214). Other embodiments/implementations may use or have any other suitable thicknesses and/or differences in thicknesses of the bottom wall 214 and/or peripheral region 220 across the ski 202. In this manner, the thickness of the ski 202 may increase or decrease when moving in a direction from the upturned peripheral region 220 towards the central portion of the bottom wall 214. In other embodiments, the thickness of the ski 202 may vary in still other manners, such as one side of the ski 202 being thicker than another side, a center stripe portion of the bottom wall 214 being thicker than the rest of the ski 202, etc. In any case, the varying thickness of the ski 202 as described herein may affect how the bottom wall 214 and/or the peripheral region 220 of the ski 202 interacts with the snow and/or ice, to accommodate different movements and acrobatic possibilities by individuals using the ski 202.

In use of the snow ski assembly 200 (i.e., when the snow ski assembly 200 is worn by the individual on one of the individual's feet), the bottom wall 214 (e.g., a bottom surface of the bottom wall 214, etc.) engages the snow and/or ice during movement of the snow ski assembly 200. And, the upturned peripheral region 220 allows the ski 202 to move without interference from the snow and/or ice (e.g., without digging or biting into the snow and/or ice, etc.). Further, the shape of the ski 202 (as described above) and the positioning of the upturned peripheral region 220 around the entire periphery of the bottom wall 214 allows movement of the ski 202 in any direction, again without such interference from the snow and/or ice (e.g., without the ski 202 digging or biting into the snow and/or ice). However, it should again be appreciated that this does not infer that a user of the snow ski assembly 200 could not, by means of manipulation of his or her body, rotate (e.g., tip, tilt, etc.) the ski assembly 200 such that the upturned peripheral region 220 could be used for control if desired.

While the above embodiment of the ski assembly 200 is again described as being configured to be worn by an individual on one of the individual's feet, with a second snow ski assembly then configured to be worn by the individual on the other one of the individual's feet, in some embodiments, one ski 202 may be adapted to accommodate both feet of an individual (as generally described in connection with the ski assembly 100).

FIGS. 15-21 illustrate another exemplary embodiment of a snow ski assembly 300 according to the present disclosure. The snow ski assembly 300 of this embodiment is similar to the snow ski assembly 200 previously described and illustrated in FIGS. 8-14. For example, the snow ski assembly 300 of this embodiment is again configured to be worn by an individual on one of the individual's feet, with a second snow ski assembly (e.g., another one of snow ski assembly 300, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 300 allows the individual to move in any direction across the snow and/or ice without preference for any one particular direction.

As shown in FIGS. 15-18, the snow ski assembly 300 of this embodiment generally includes a ski 302, a spacer 330, a mounting feature 304, and a binding 306. The spacer 330 couples to the ski 302 within an interior region 332 defined by the ski 302. Fasteners 334 (e.g., screws, etc.) are configured to extend through openings 336 of the spacer 330, and into corresponding openings 338 in a lower portion of the ski 302, to thereby couple the spacer 330 to the ski 302. And, the binding 306 couples to the ski 302 at the mounting feature 304, via the spacer 330, and is configured to secure a boot 308 to the ski 302 so that the individual can wear the ski 302, via the boot 308 and binding 306, on one of the individual's feet. Straps 310 of the binding 306 then help hold the boot 308 in the binding 306. As can be seen, the spacer 330 provides a generally flat surface on which to mount the boot 308, and is configured to elevate the binding 306 generally above the ski 302 so that the boot 308 can be received in the binding 306 without interference from the ski 302. With that said, it should again be appreciated that any suitable binding can be used with the snow ski assembly 300.

The mounting feature 304 of the snow ski assembly 300 includes multiple openings 312 defined in an upper surface of the spacer 330. Fasteners 316 are configured to extend through openings in a lower portion of the binding 306, and into the corresponding openings 312, to couple the binding 306 to the mounting feature 304 (and to the spacer 330 and ski 302). The position of the binding 306 on the ski 302 (and on the spacer 330) can be adjusted, as desired, by moving the fasteners 316 to different ones, or instances, of the openings 312 (which results in a different positioning of the binding 306 on the ski 302). In the illustrated embodiment, the mounting feature 304 includes twelve openings 312, arranged in four groups of three. And four fasteners 316 are used to couple the binding 306 to the mounting feature 304 (with one of the four fasteners 316 positioned in one of the openings 312 of each group, depending on desired positioning of the binding 306 on the ski 302). It should be appreciated that the mounting feature 304 may include a different number and/or arrangement of openings 312, and/or a different number of fasteners 316 may be used to couple the binding 306 to the mounting feature 304, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 304 of the snow ski assembly 300 is again separate from the ski 302. The mounting feature 304 is integrally defined by (e.g., monolithically formed with, etc.) the spacer 330 of the snow ski assembly 300 and then coupled, via the spacer 330, to the ski 302. In other exemplary embodiments, snow ski assemblies may include mounting features separate from spacers and coupled thereto. In addition, in other exemplary embodiments, snow ski assemblies may include spacers (and, in some embodiments, mounting features) integrally defined by (e.g., monolithically formed with, etc.) skis.

With continued reference to FIGS. 15-18, the ski 302 and spacer 330 of the snow ski assembly 300 are sized to receive the boot 308 generally within a footprint of the ski 302. In addition in this embodiment, the spacer 330 is sized such that the upper surface of the spacer 330 is positioned generally below an upper edge of the ski 302 by a distance 324 (FIG. 21) and the boot 308 is received on the spacer 330 partially within the interior region 332 of the ski 302. The illustrated ski 302 has a diameter dimension of about sixteen inches for receiving the correspondingly sized spacer 330 in the interior region 332 of the ski 302, and the correspondingly sized boot 308 thereon. However, the ski 302 and/or the spacer 330 may be sized differently as desired (e.g., the ski 302 may have a diameter dimension greater than or less than about sixteen inches, etc.), for example, to permit production of the ski 302 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches, and spacers configured to fit within interior regions of the skis.

Figure 19:
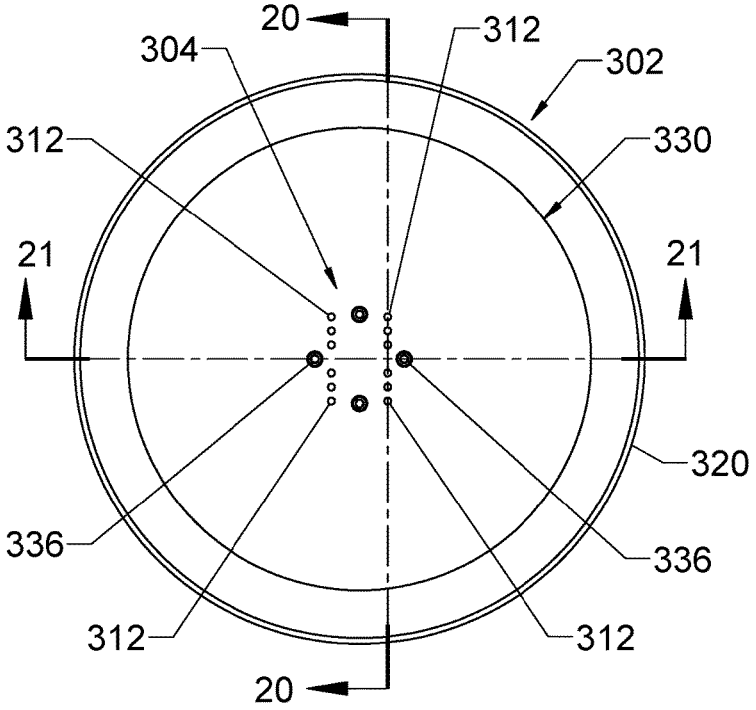
FIG. 19 is a top plan view of a ski of the snow ski assembly of FIG. 15.
Figure 20:
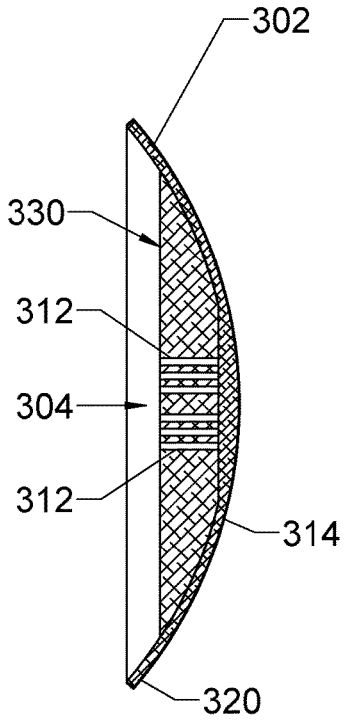
FIG. 20 is a section view of the ski of FIG. 19, taken in a plane including line 20-20 in FIG. 19.
Figure 21:
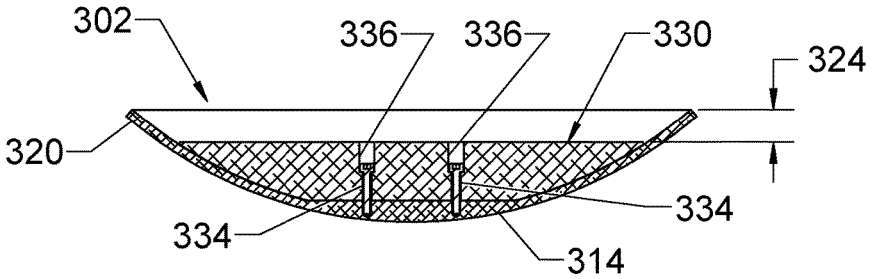
FIG. 21 is a section view of the ski of FIG. 19, taken in a plane including line 21-21 in FIG. 19.
Figure 22:
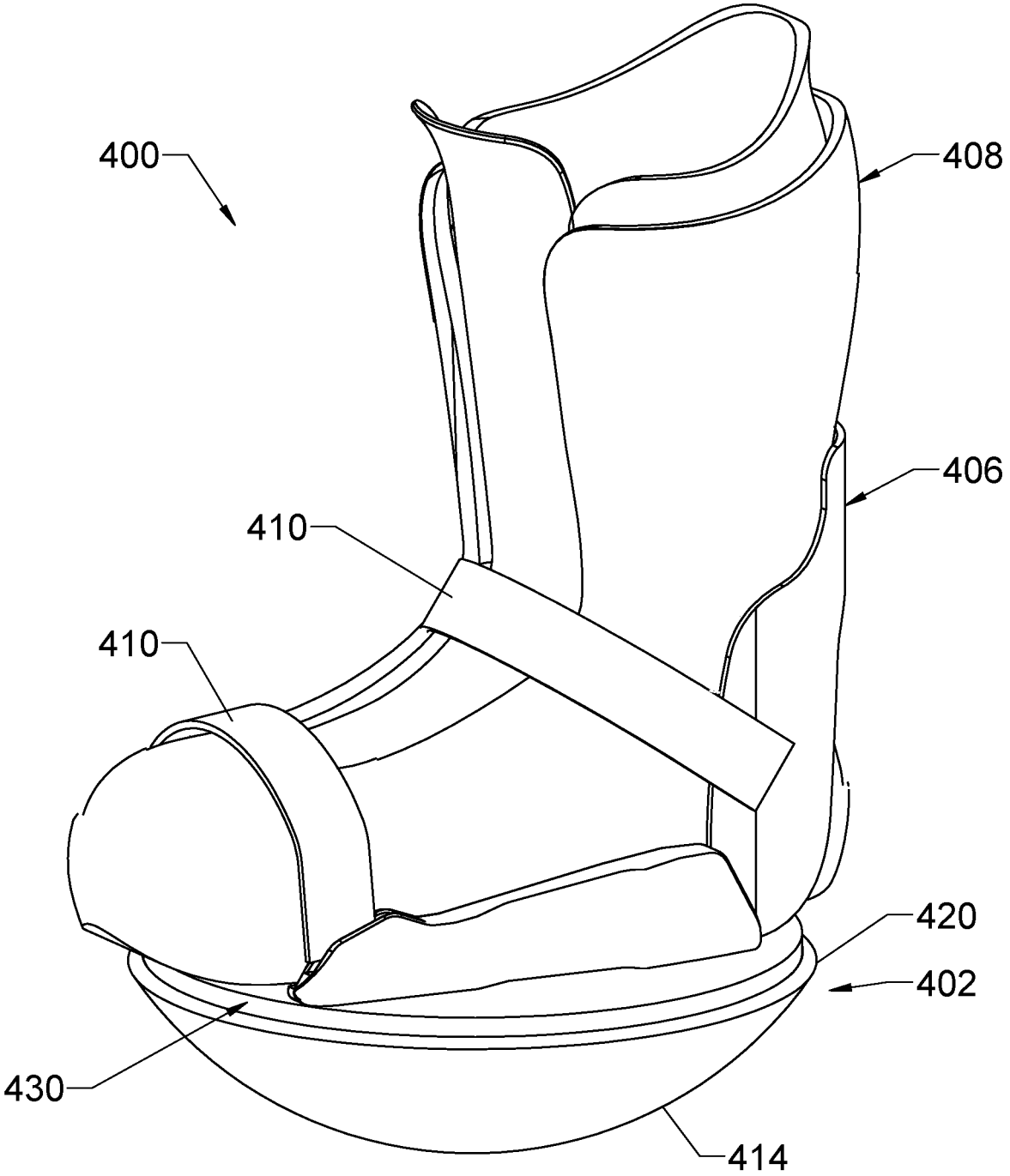
FIG. 22 is an isometric view of still another exemplary embodiment of a snow ski assembly according to the present disclosure.
Figure 23:
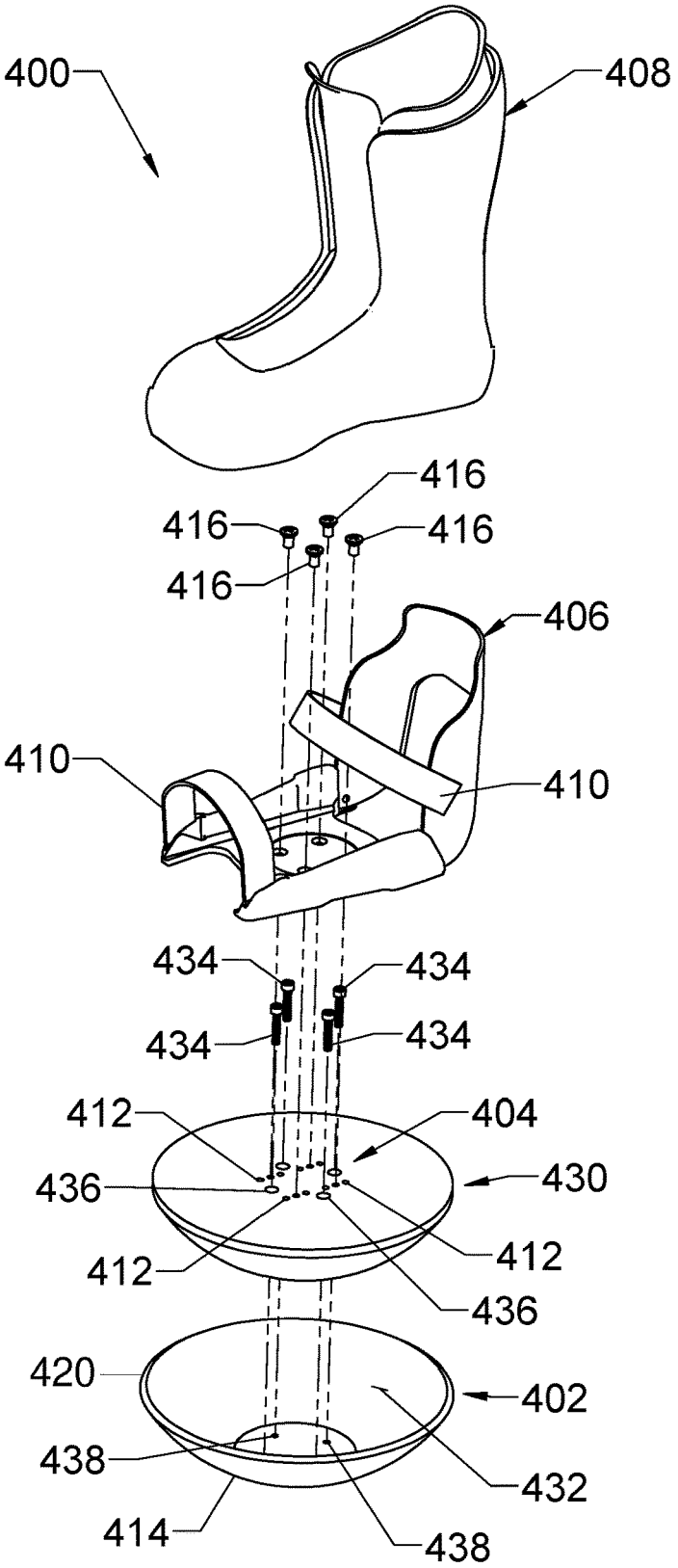
FIG. 23 is an exploded isometric view of the snow ski assembly of FIG. 22.
Figure 24:
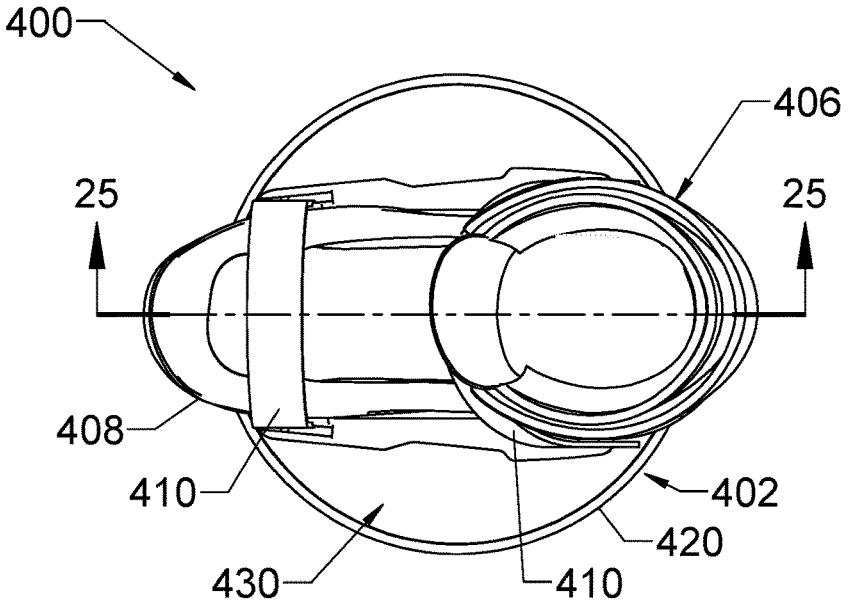
FIG. 24 is a top plan view of the snow ski assembly of FIG. 22.
Figure 25:
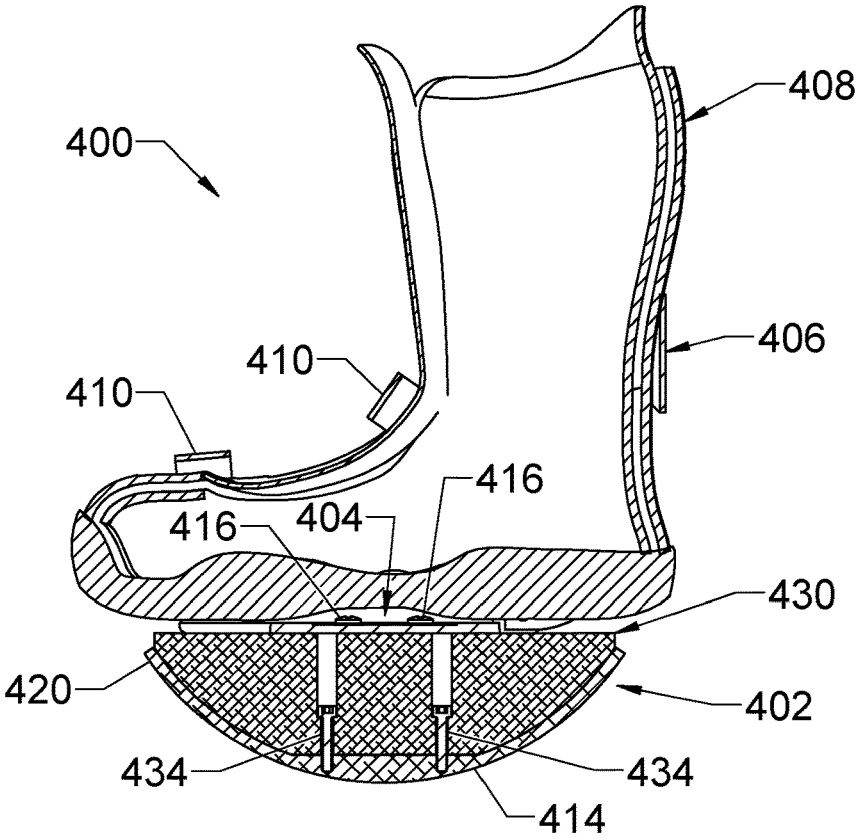
FIG. 25 is a section view of the snow ski assembly of FIG. 22, taken in a plane including line 25-25 in FIG. 24.

With additional reference now to FIGS. 19-21, the ski 302 of the snow ski assembly 300 generally includes a bottom wall 314 having an upturned peripheral region 320 (e.g., an upturned lip portion, an upturned peripheral portion located toward a perimeter of the bottom wall 314, etc.). The upturned peripheral region 320 of the ski 302 generally extends around a peripheral portion (or perimeter portion) of the bottom wall 314 (e.g., the upturned peripheral region 320 extends generally continuously around the bottom wall 314 of the ski 302, etc.) and is generally free of protrusions and obstructions. And together, the bottom wall 314 and the upturned peripheral region 320 provide the ski 302 with a generally circular (or disk) shape or footprint (when viewed in plan). In other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 320 may vary, for example, to accommodate different movements and acrobatic possibilities by individuals using the ski 302.

The bottom wall 314 of the ski 302 (e.g., a central region of the ski 302, etc.) is also generally rounded from the peripheral region 320 on one side of the ski 302 to the peripheral region 320 on the other side of the ski 302 (as viewed in FIGS. 20 and 21), and is generally radially symmetric. In the illustrated embodiment, the rounded bottom wall 314 of the ski 302 is generally circular (or arc) shaped and extends/transitions smoothly to the upturned (and generally rounded) peripheral region 320 generally consistently around the perimeter of the ski 302 (such that, in this embodiment, the upturned peripheral region 320 is a generally symmetric extension of the bottom wall 314 and generally coincides with the bottom wall 314). However, the rounded bottom wall 314 may have other shapes, for example, generally near circular shapes, generally elliptical shapes, generally parabolic shapes, generally hyperbolic shapes, etc. and/or other geometries (e.g., asymmetric geometries, generally symmetric geometries that include asymmetries to help accommodate different movements and acrobatic possibilities, etc.) within the scope of the present disclosure (e.g., to help accommodate different movements and/or acrobatic possibilities using the snow ski assembly 300, etc.).

That said, it should again be appreciated that in some embodiments the geometry of the bottom wall 314 and/or the peripheral region 320 of the ski 302 may vary across the ski 302, such that the bottom wall 314, the peripheral region 320, and/or the ski 302 does not have a uniform geometry. The varying geometries of the bottom wall 314 and/or the upturned peripheral region 320 may affect how the bottom wall 314 of the ski 302 interacts with the snow and/or ice, to accommodate different movements and acrobatic possibilities by individuals using the ski 302.

In addition, in some embodiments a thickness of the bottom wall 314 and/or the upturned peripheral portion 320 may vary. For example, a thickness near a perimeter of the ski 302 (e.g., at the upturned peripheral region 320 or at an outer portion of the bottom wall 314, etc.) may be greater than a thickness near a center of the ski 302 (e.g., a central portion of the bottom wall 314, etc.). Alternatively, a thickness of the ski 302 near a perimeter of the ski 302 (e.g., at the upturned peripheral region 320 or an outer portion of the bottom wall 314, etc.) may be less than a thickness near a center of the ski 302 (e.g., a central portion of the bottom wall 314). Other embodiments/implementations may use or have any other suitable thicknesses and/or differences in thicknesses of the bottom wall 314 and/or peripheral region 320 across the ski 302. In this manner, the thickness of the ski 302 may increase or decrease when moving in a direction from the upturned peripheral region 320 towards the central portion of the bottom wall 314. In other embodiments, the thickness of the ski 302 may vary in still other manners, such as one side of the ski 302 being thicker than another side, a center stripe portion of the bottom wall 314 being thicker than the rest of the ski 302, etc. In any case, the varying thickness of the ski 302 as described herein may affect how the bottom wall 314 and/or the peripheral region 320 of the ski 302 interacts with the snow and/or ice, to accommodate different movements and acrobatic possibilities by individuals using the ski 302.

In use of the snow ski assembly 300 (i.e., when the snow ski assembly 300 is worn by the individual on one of the individual's feet), the bottom wall 314 (e.g., a bottom surface of the bottom wall 314, etc.) again engages the snow and/or ice during movement of the snow ski assembly 300. And, the upturned peripheral region 320 allows the ski 302 to move without interference from the snow and/or ice (e.g., without digging or biting into the snow and/or ice, etc.). Further, the shape of the ski 302 (as described above) and the positioning of the upturned peripheral region 320 around the entire periphery of the bottom wall 314 allows movement of the ski 302 in any direction, again without such interference from the snow and/or ice (e.g., without the peripheral region 320 of the ski 302 digging or biting into the snow and/or ice). However, it should again be appreciated that this does not infer that a user of the snow ski assembly 300 could not, by means of manipulation of his or her body, rotate (e.g., tip, tilt, etc.) the ski assembly 300 such that the upturned peripheral region 320 could be used for control if desired.

While the above embodiment of the ski assembly 300 is again described as being configured to be worn by an individual on one of the individual's feet, with a second snow ski assembly then configured to be worn by the individual on the other one of the individual's feet, in some embodiments, one ski 202 may be adapted to accommodate both feet of an individual (as generally described in connection with the ski assembly 100).

FIGS. 22-28 illustrate another exemplary embodiment of a snow ski assembly 400 according to the present disclosure. The snow ski assembly 400 of this embodiment is again similar to the snow ski assembly 200 previously described and illustrated in FIGS. 8-14. For example, the snow ski assembly 400 of this embodiment is configured to be worn by an individual on one of the individual's feet, with a second snow ski assembly (e.g., another one of snow ski assembly 400, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 400 allows the individual to move in any direction across the snow and/or ice without preference for any one particular direction.

As shown in FIGS. 22-25, the snow ski assembly 400 of this embodiment generally includes a ski 402, a spacer 430, a mounting feature 404, and a binding 406. The spacer 430 couples to the ski 402 within an interior region 432 defined by the ski 402. Fasteners 434 (e.g., screws, etc.) are configured to extend through openings 436 of the spacer 430, and into corresponding openings 438 in a lower portion of the ski 402, to thereby couple the spacer 430 to the ski 402. And, the binding 406 couples to the ski 402 at the mounting feature 404, via the spacer 430, and is configured to secure a boot 408 to the ski 402 so that the individual can wear the ski 402, via the boot 408 and binding 406, on one of the individual's feet. Straps 410 of the binding 406 then help hold the boot 408 in the binding 406. As can be seen, the spacer 430 provides a generally flat surface on which to mount the boot 408, and is configured to elevate the binding 406 generally above the ski 402 so that the boot 408 can be received in the binding 406 without interference from the ski 402. With that said, it should again be appreciated that any suitable binding can be used with the snow ski assembly 400.

The mounting feature 404 of the snow ski assembly 400 includes multiple openings 412 defined in an upper surface of the spacer 430. Fasteners 416 are configured to extend through openings in a lower portion of the binding 406, and into the corresponding openings 412, to couple the binding 406 to the mounting feature 404 (and to the spacer 430 and ski). The position of the binding 406 on the ski 402 (and on the spacer 430) can be adjusted, as desired, by moving the fasteners 416 to different ones, or instances, of the openings 412 (which results in a different positioning of the binding 406 on the ski 402). In the illustrated embodiment, the mounting feature 404 includes twelve openings 412, arranged in four groups of three. And four fasteners 416 are used to couple the binding 406 to the mounting feature 404 (with one of the four fasteners 416 positioned in one of the openings 412 of each group, depending on desired positioning of the binding 406 on the ski 402). It should be appreciated that the mounting feature 404 may include a different number and/or arrangement of openings 412, and/or a different number of fasteners 416 may be used to couple the binding 406 to the mounting feature 404, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 404 of the snow ski assembly 400 is again separate from the ski 402. The mounting feature 404 is integrally defined by (e.g., monolithically formed with, etc.) the spacer 430 of the snow ski assembly 400 and then coupled, via the spacer 430, to the ski 402. And again, in other exemplary embodiments, snow ski assemblies may include mounting features separate from spacers and coupled thereto. In addition, in other exemplary embodiments, snow ski assemblies may include spacers (and, in some embodiments, mounting features) integrally defined by (e.g., monolithically formed with, etc.) skis.

With continued reference to FIGS. 22-25, the ski 402 and spacer 430 of the snow ski assembly 400 are sized such that the boot 408 extends generally beyond a footprint of the ski 402 (e.g., generally beyond an upturned peripheral region 420 of the ski 402, etc.). In addition in this embodiment, the spacer 430 is sized such that the upper surface of the spacer 430 is positioned generally above an upper edge of the ski 402 by a distance 424 (FIG. 28) (e.g., about 0.25 inches, about 0.5 inches, about 1 inch, distances therebetween, other distances such as distances greater than about 1 inch or less than about 0.25 inches, etc.) so that the boot 408 is received on the spacer 430 generally above the ski 402 (e.g., generally above the upper edge of the ski 402, etc.). With that said, the illustrated ski 402 has a diameter dimension of about eight inches and is capable of receiving the correspondingly sized spacer 430 in the interior region 432 of the ski 402 (with the spacer 430 extending partially above the upturned peripheral region 420 of the ski 402), and with the correspondingly sized boot 408 then received on the spacer 430. However, the ski 402 and/or the spacer 430 may be sized differently as desired (e.g., the ski 402 may have a diameter dimension greater than or less than about eight inches, etc.), for example, to permit production of the ski 402 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches, and spacers configured to fit within interior regions of the skis. It should be appreciated that the smaller size of the illustrated ski 402, as compared to the skis previously described and illustrated, may help facilitate different movements and acrobatic possibilities by individuals wearing the ski 402.

Figure 26:
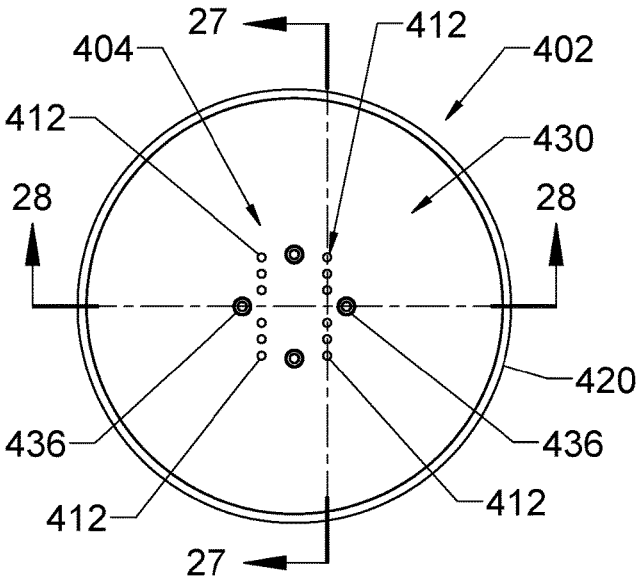
FIG. 26 is a top plan view of a ski of the snow ski assembly of FIG. 22.
Figure 27:
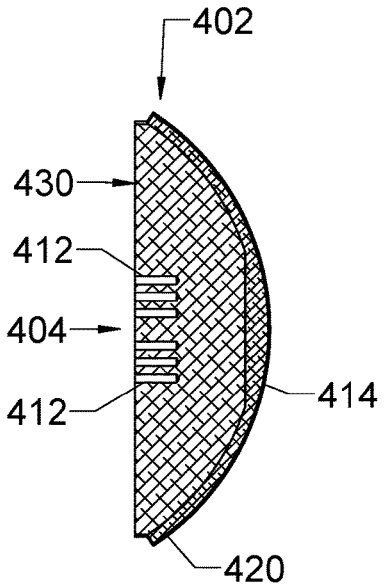
FIG. 27 is a section view of the ski of FIG. 26, taken in a plane including line 27-27 in FIG. 26.
Figure 28:
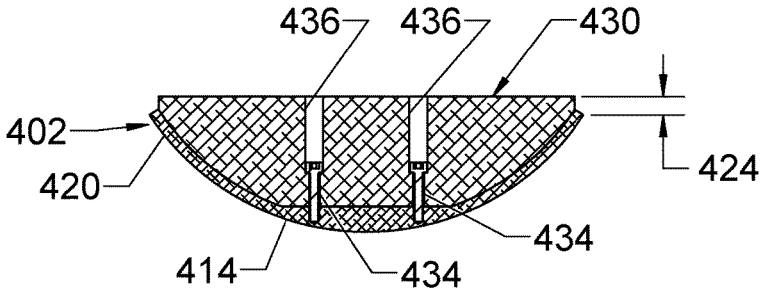
FIG. 28 is a section view of the ski of FIG. 26, taken in a plane including line 28-28 in FIG. 26.
Figure 29:
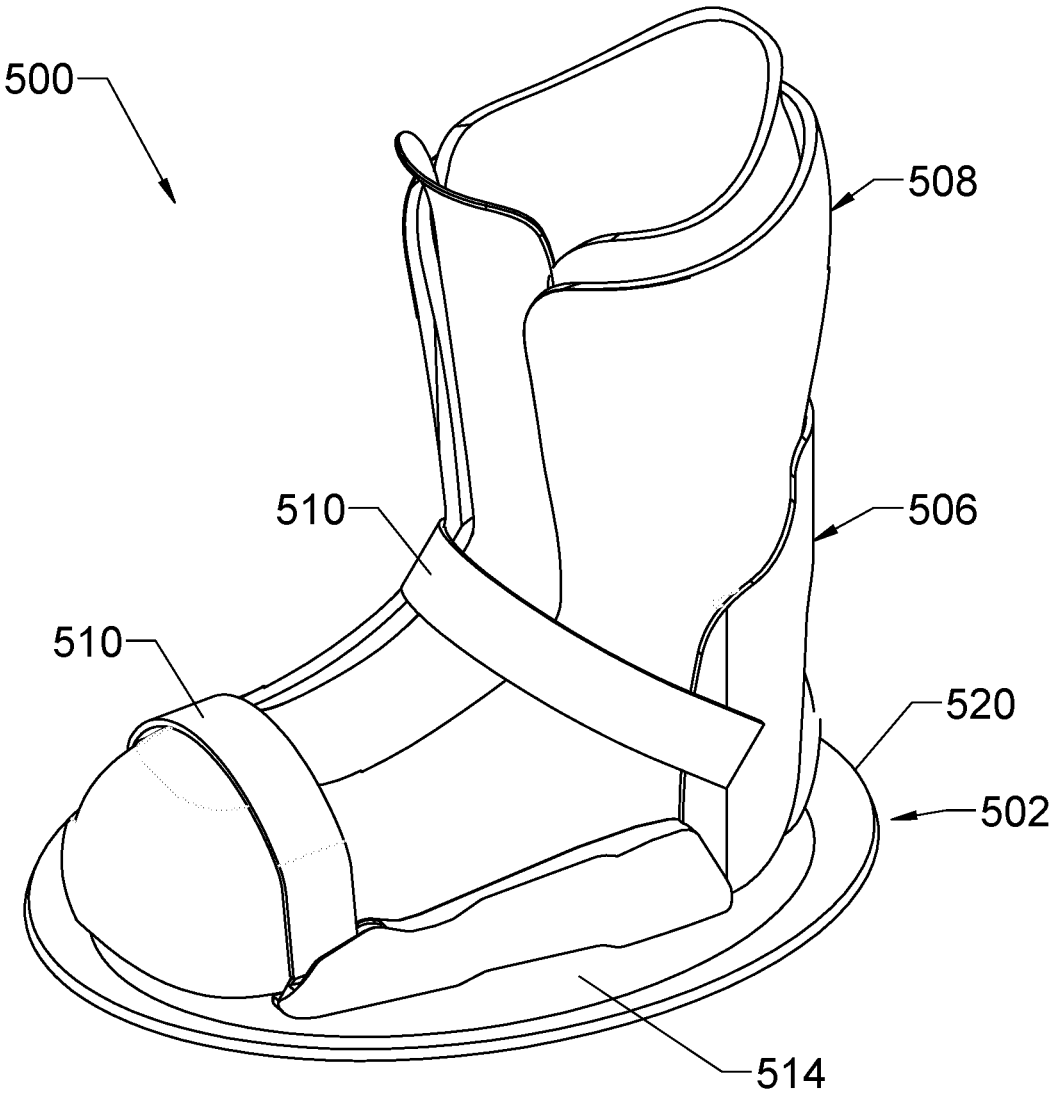
FIG. 29 is an isometric view of another exemplary embodiment of a snow ski assembly according to the present disclosure.
Figure 30:
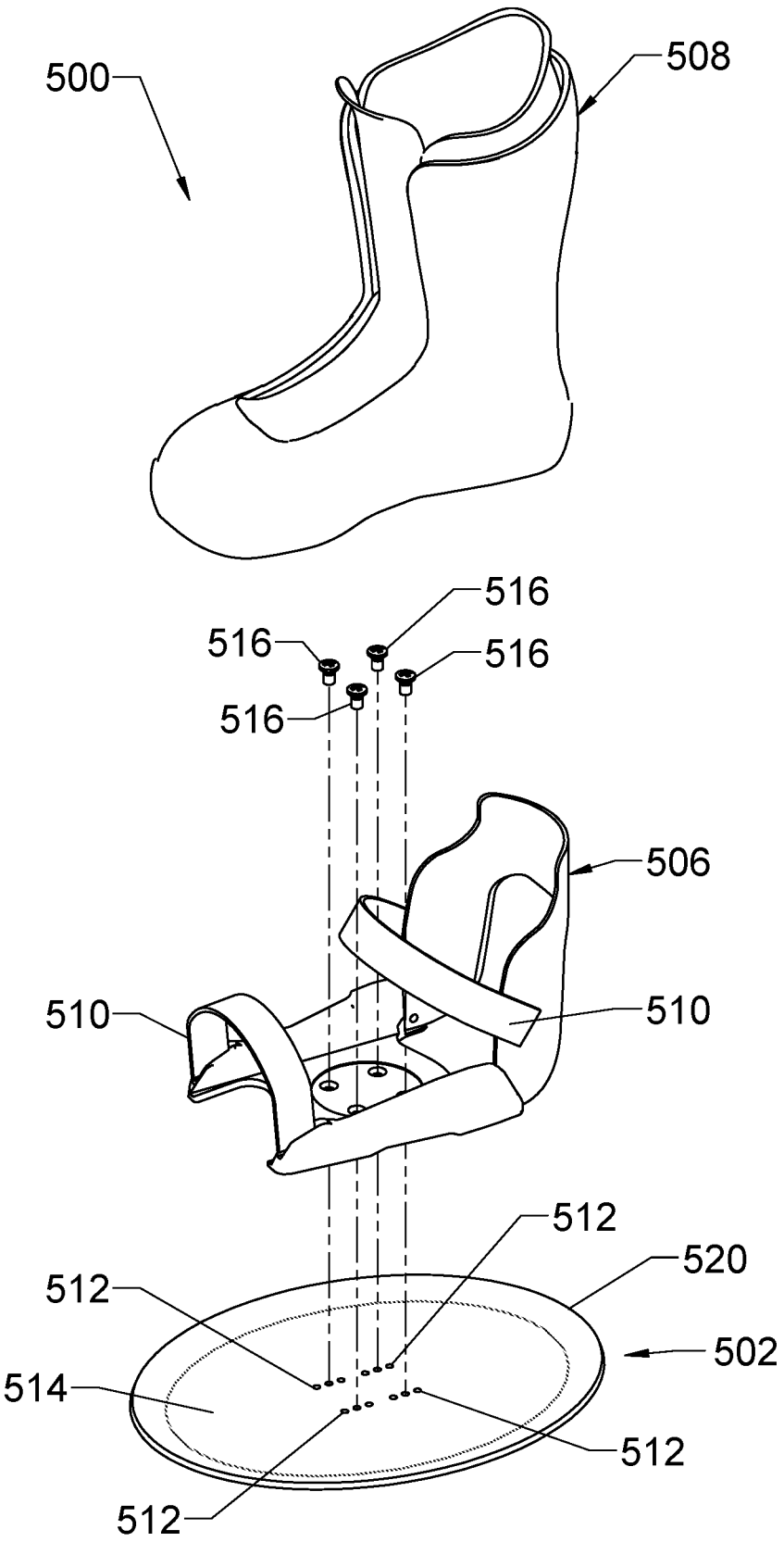
FIG. 30 is an exploded isometric view of the snow ski assembly of FIG. 29.
Figure 31:
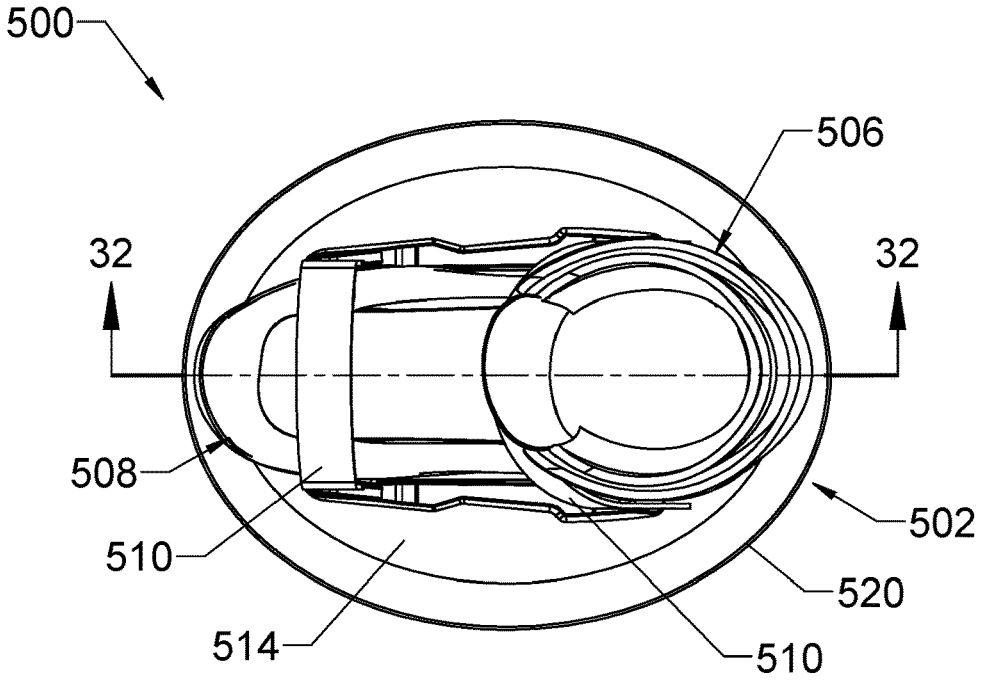
FIG. 31 is a top plan view of the snow ski assembly of FIG. 29.
Figure 32:
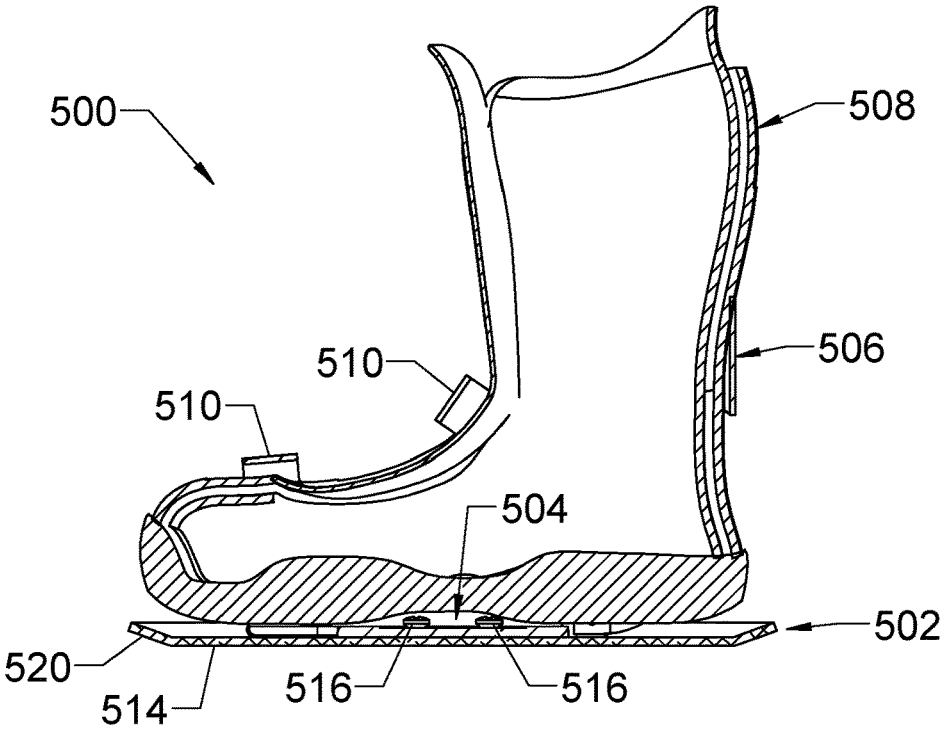
FIG. 32 is a section view of the snow ski assembly of FIG. 29, taken in a plane including line 32-32 in FIG. 31.

With additional reference now to FIGS. 26-28, the ski 402 of the snow ski assembly 400 generally includes a bottom wall 414 having the upturned peripheral region 420 (e.g., an upturned lip portion, an upturned peripheral portion located toward a perimeter of the bottom wall 414, etc.). The upturned peripheral region 420 of the ski 402 generally extends around a peripheral portion (or perimeter portion) of the bottom wall 414 (e.g., the upturned peripheral region 420 extends generally continuously around the bottom wall 414 of the ski 402, etc.) and is generally free of protrusions and obstructions. And together, the bottom wall 414 and the upturned peripheral region 420 provide the ski 402 with a generally circular (or disk) shape or footprint (when viewed in plan). In other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 420 may vary, for example, to accommodate different movements and acrobatic possibilities by individuals using the ski 402.

The bottom wall 414 of the ski 402 (e.g., a central region of the ski 402, etc.) is also generally rounded from one peripheral region 420 of the ski 402 to another peripheral region 420 of the ski (e.g., as viewed in FIGS. 20 and 21), and is generally radially symmetric. In the illustrated embodiment, the rounded bottom wall 414 of the ski 402 is generally circular (or arc) shaped and extends/transitions smoothly to the upturned peripheral region 420 generally consistently (and symmetrically) around the perimeter of the ski 402 (such that, in this embodiment, the upturned peripheral region 420 is rounded and is an extension of the rounded bottom wall 414 and generally coincides with the bottom wall 414). However, the rounded bottom wall 414 may have other shapes, for example, generally near circular shapes, generally elliptical shapes, generally parabolic shapes, generally hyperbolic shapes, etc. and/or other geometries (e.g., asymmetric geometries, generally symmetric geometries that include asymmetries to help accommodate different movements and acrobatic possibilities, etc.) within the scope of the present disclosure (e.g., to help accommodate different movements and/or acrobatic possibilities using the snow ski assembly 400, etc.).

That said, it should again be appreciated that in some embodiments the geometry of the bottom wall 414 and/or the peripheral region 420 of the ski 402 may vary across the ski 402, such that the bottom wall 414, the peripheral region 420, and/or the ski 402 does not have a uniform geometry. The varying geometries of the bottom wall 414 and/or the upturned peripheral region 420 may affect how the bottom wall 414 of the ski 402 interacts with the snow and/or ice, to accommodate different movements and acrobatic possibilities by individuals using the ski 402.

In addition, in some embodiments a thickness of the bottom wall 414 and/or the upturned peripheral portion 420 may vary. For example, a thickness near a perimeter of the ski 402 (e.g., at the upturned peripheral region 420 or at an outer portion of the bottom wall 414, etc.) may be greater than a thickness near a center of the ski 402 (e.g., a central portion of the bottom wall 414, etc.). Alternatively, a thickness of the ski 402 near a perimeter of the ski 402 (e.g., at the upturned peripheral region 420 or an outer portion of the bottom wall 414, etc.) may be less than a thickness near a center of the ski 402 (e.g., a central portion of the bottom wall 414, etc.). Other embodiments/implementations may use or have any other suitable thicknesses and/or differences in thicknesses of the bottom wall 414 and/or peripheral region 420 across the ski 402. In this manner, the thickness of the ski 402 may increase or decrease when moving in a direction from the upturned peripheral region 420 towards the central portion of the bottom wall 414. In other embodiments, the thickness of the ski 402 may vary in still other manners, such as one side of the ski 402 being thicker than another side, a center stripe portion of the bottom wall 414 being thicker than the rest of the ski 402, etc. In any case, the varying thickness of the ski 402 as described herein may affect how the bottom wall 414 and/or the peripheral region 420 of the ski 402 interacts with the snow and/or ice, to accommodate different movements and acrobatic possibilities by individuals using the ski 402.

In use of the snow ski assembly 400 (i.e., when the snow ski assembly 400 is worn by the individual on one of the individual's feet), the bottom wall 414 (e.g., a bottom surface of the bottom wall 414, etc.) again engages the snow and/or ice during movement of the snow ski assembly 400. And, the upturned peripheral region 420 allows the ski 402 to move without interference from the snow and/or ice (e.g., without digging or biting into the snow and/or ice, etc.). Further, the shape of the ski 402 (as described above) and the positioning of the upturned peripheral region 420 around the entire periphery of the bottom wall 414 allows movement of the ski 402 in any direction, again without such interference from the snow and/or ice (e.g., without the peripheral region 420 of the ski 402 digging or biting into the snow and/or ice, etc.). However, it should again be appreciated that this does not infer that a user of the snow ski assembly 400 could not, by means of manipulation of his or her body, rotate (e.g., tip, tilt, etc.) the ski assembly 400 such that the upturned peripheral region 420 could be used for control if desired.

While the above embodiment of the ski assembly 400 is again described as being configured to be worn by an individual on one of the individual's feet, with a second snow ski assembly then configured to be worn by the individual on the other one of the individual's feet, in some embodiments, one ski 202 may be adapted to accommodate both feet of an individual (as generally described in connection with the ski assembly 100).

FIGS. 29-35 illustrate another exemplary embodiment of a snow ski assembly 500 according to the present disclosure. The snow ski assembly 500 of this embodiment is similar to the snow ski assembly 100 previously described and illustrated in FIGS. 1-7. For example, the snow ski assembly 500 of this embodiment is configured to be worn by an individual on one of the individual's feet, with a second snow ski assembly (e.g., another one of snow ski assembly 500, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 500 allows the individual to move in any direction across the snow and/or ice without preference for any one particular direction.

As shown in FIGS. 29-32, the snow ski assembly 500 of this embodiment again generally includes a ski 502, a mounting feature 504, and a binding 506. The binding 506 couples to the ski 502 at the mounting feature 504 and is configured to secure a boot 508 to the ski 502 so that the individual can wear the ski 502, via the boot 508 and binding 506, on one of the individual's feet. The illustrated binding 506 includes straps 510 that secure over, around, etc. the boot 508 to hold the boot 508 (and the individual's foot inside the boot 508) in the binding 506 (and, thus, the ski 502 on the individual's foot). In addition, it should again be appreciated that any suitable binding can be used with the snow ski assembly 500 within the scope of the present disclosure.

The mounting feature 504 of the snow ski assembly 500 includes multiple openings 512 defined in a bottom wall 514 of the ski 502. Fasteners 516 (e.g., screws, etc.) are configured to extend through openings in a lower portion of the binding 506, and into the corresponding openings 512, to couple the binding 506 to the mounting feature 504 (and to the ski 502). The position of the binding 506 on the ski 502 can be adjusted, as desired, by moving the fasteners 516 to different ones, or instances, of the openings 512 (which results in a different positioning of the binding 506 on the ski 502). In the illustrated embodiment, the mounting feature 504 includes twelve openings 512, arranged in four groups of three. And four fasteners 516 are used to couple the binding 506 to the mounting feature 504 (with one of the four fasteners 516 positioned in one of the openings 512 of each group, depending on desired positioning of the binding 506 on the ski 502). It should be appreciated that the mounting feature 504 may include a different number and/or arrangement of openings 512, and/or a different number of fasteners 516 may be used to couple the binding 506 to the mounting feature 504, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 504 is again integrally defined by (e.g., monolithically formed with, etc.) the ski 502 of the snow ski assembly 500. However, as previously stated, in other exemplary embodiments, snow ski assemblies may include mounting features separate from skis and attached thereto.

With continued reference to FIGS. 29-32, the ski 502 of the snow ski assembly 500 is sized to receive the boot 508 generally within a footprint of the ski 502. In particular, the illustrated ski has a generally elliptical shape or footprint, with a dimension along a major axis (or transverse axis) of about sixteen inches and a dimension along a minor axis of about twelve inches for receiving the correspondingly sized boot 508 thereon. However, the ski 502 may be sized differently as desired (e.g., the ski 502 may have a dimension along the major axis of greater than or less than about sixteen inches and/or a dimension along the minor axis of greater than or less than about twelve inches, etc.), for example, to permit production of the ski 502 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis having elliptical shapes with dimensions along major and/or minor axes ranging anywhere from about four inches to about thirty-six inches, etc.

Figure 33:
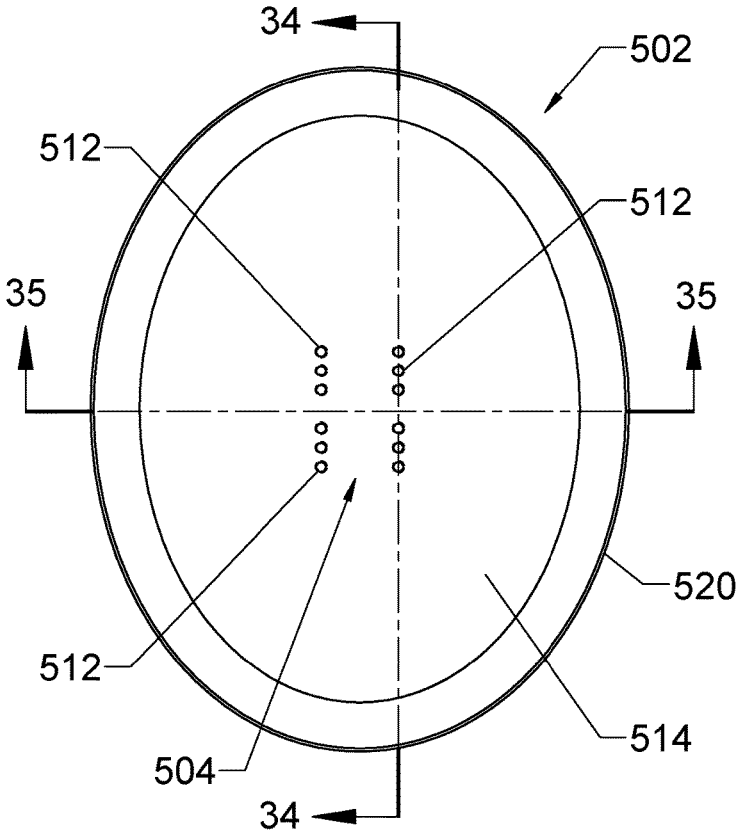
FIG. 33 is a top plan view of a ski of the snow ski assembly of FIG. 29.
Figure 34:
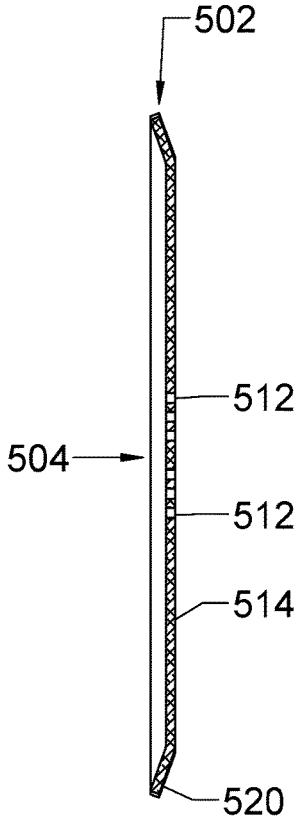
FIG. 34 is a section view of the ski of FIG. 33, taken in a plane including line 34-34 in FIG. 33.
Figure 35:
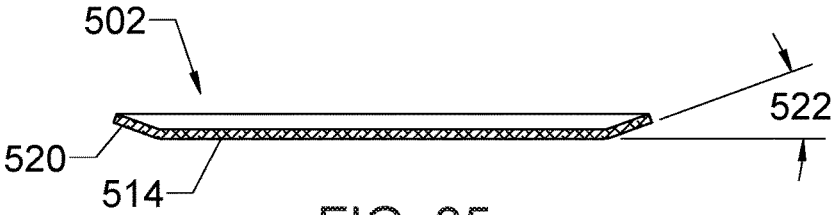
FIG. 35 is a section view of the ski of FIG. 33, taken in a plane including line 35-35 in FIG. 33.

With additional reference now to FIGS. 33-35, the ski 502 of the snow ski assembly 500 generally includes the bottom wall 514 having an upturned peripheral region 520 (e.g., an upturned lip portion, an upturned peripheral portion located toward a perimeter of the bottom wall 514, an upturned sidewall, etc.). The upturned peripheral region 520 of the ski 502 generally extends around a peripheral portion (or perimeter portion) of the bottom wall 514 (e.g., the upturned peripheral region 520 extends generally continuously around the bottom wall 514 of the ski 502, etc.) and is generally free of protrusions and obstructions. Together, the bottom wall 514 and the upturned peripheral region 520 provide the ski 502 with the generally elliptical shape or footprint (when viewed in plan). In other exemplary embodiments, snow ski assemblies may include skis with bottom walls and peripheral regions defining other shapes (e.g., other than elliptical shapes, etc.) when the skis are viewed in plan. Further, it should be appreciated that a size (e.g., a length, etc.) of the upturned peripheral region 520 may vary, for example, to accommodate different movements and acrobatic possibilities by individuals using the ski 502.

The bottom wall 514 of the ski 502 (e.g., a central region of the ski 502, etc.) is generally flat (or planar), and is generally radially symmetric. And, the upturned peripheral region 520 of the ski 502 is generally flat (or linear) along a length of the peripheral region 520 from the flat bottom wall 514 to a perimeter edge of the ski 502. In the illustrated embodiment, the upturned peripheral region 520 forms an angle 522 with the flat bottom wall 514 of about twenty-five degrees (generally consistently around the perimeter of the ski 502). However, the angle 522 may be greater than or less than about twenty-five degrees, as desired (e.g., depending on desired movement of the ski 502 across snow and/or ice, etc.). In addition, in other exemplary embodiments, snow ski assemblies may include skis with bottom walls and/or peripheral regions having geometries, shapes, etc. that are other than generally flat and/or that are asymmetric and/or that include asymmetries (e.g., to help accommodate different movements and/or acrobatic possibilities using the snow ski assemblies, etc.). For example, in such embodiments, the bottom walls and/or the peripheral regions of the skis may include geometries, shapes, etc. that are generally rounded, etc.

That said, it should again be appreciated that in some embodiments the geometry of the bottom wall 514 and/or the peripheral region 520 of the ski 502 may vary across the ski 502, such that the bottom wall 514, the peripheral region 520, and/or the ski 502 does not have a uniform geometry. The varying geometries of the bottom wall 514 and/or the upturned peripheral region 520 may affect how the bottom wall 514 of the ski 502 interacts with the snow and/or ice, to accommodate different movements and acrobatic possibilities by individuals using the ski 502.

In addition, in some embodiments a thickness of the bottom wall 514 and/or the upturned peripheral portion 520 may vary. For example, a thickness near a perimeter of the ski 502 (e.g., at the upturned peripheral region 520 or at an outer portion of the bottom wall 514, etc.) may be greater than a thickness near a center of the ski 502 (e.g., a central portion of the bottom wall 514, etc.). Alternatively, a thickness of the ski 502 near a perimeter of the ski 502 (e.g., at the upturned peripheral region 520 or an outer portion of the bottom wall 514, etc.) may be less than a thickness near a center of the ski 502 (e.g., a central portion of the bottom wall 514, etc.). Other embodiments/implementations may use or have any other suitable thicknesses and/or differences in thicknesses of the bottom wall 514 and/or peripheral region 520 across the ski 502. In this manner, the thickness of the ski 502 may increase or decrease when moving in a direction from the upturned peripheral region 520 towards the central portion of the bottom wall 514. In other embodiments, the thickness of the ski 502 may vary in still other manners, such as one side of the ski 502 being thicker than another side, a center stripe portion of the bottom wall 514 being thicker than the rest of the ski 502, etc. In any case, the varying thickness of the ski 502 as described herein may affect how the bottom wall 514 and/or the peripheral region 520 of the ski 502 interacts with the snow and/or ice, to accommodate different movements and acrobatic possibilities by individuals using the ski 502.

In use of the snow ski assembly 500 (i.e., when the snow ski assembly 500 is worn by the individual on one of the individual's feet), the bottom wall 514 (e.g., a bottom surface of the bottom wall 514, etc.) engages the snow and/or ice during movement of the snow ski assembly 500. And, the upturned peripheral region 520 allows the ski 502 to move without interference from the snow and/or ice (e.g., without digging or biting into the snow and/or ice, etc.). Further, the shape of the ski 502 (as described above) and the positioning of the upturned peripheral region 520 around the entire peripheral portion of the bottom wall 514 allows movement of the ski 502 in any direction, again without such interference from the snow and/or ice (e.g., without the peripheral region 520 of the ski 502 digging or biting into the snow and/or ice, etc.). However, it should again be appreciated that this does not infer that a user of the snow ski assembly 500 could not, by means of manipulation of his or her body, rotate (e.g., tip, tilt, etc.) the ski assembly 500 such that the upturned peripheral region 520 could be used for control if desired.

In addition, in other exemplary embodiments where snow ski assemblies have skis with elliptical shapes (such as snow ski assembly 500), the skis may have bottom walls and/or peripheral regions having geometries, shapes, etc. that are other than generally flat and/or that are asymmetric and/or that include asymmetries (e.g., to help accommodate different movements and/or acrobatic possibilities using the snow ski assemblies, etc.). For example, in such embodiments, the bottom walls and/or the peripheral regions of the skis may include geometries, shapes, etc. that are generally rounded (e.g., generally circular shapes, generally near circular shapes, generally elliptical shapes, generally parabolic shapes, generally hyperbolic shapes, etc.), etc.

It should also be appreciated that snow ski assemblies having skis with elliptical shapes, such as snow ski assembly 500, in some embodiments, may also have configurations that include spacers (in similar fashion to the snow ski assemblies 200, 300, 400). The spacers may be separate from the skis, or integrally defined/formed with the skis.

While the above embodiment of the ski assembly 500 is again described as being configured to be worn by an individual on one of the individual's feet, with a second snow ski assembly then configured to be worn by the individual on the other one of the individual's feet, in some embodiments, one ski 202 may be adapted to accommodate both feet of an individual (as generally described in connection with the ski assembly 100).

It should be appreciated that the skis 102, 202, 302, 402, 502 of the ski assemblies 100, 200, 300, 400, 500 may be adapted to receive any suitable type of binding, conventional or unconventional. For example, the mounting feature of the given ski assembly may be spaced, sized, etc., to accommodate any type of standard ski binding, standard snowboard binding, other type of bindings, etc. Different example mounting features 104, 204, 304, 404 and 504 are described herein, to accommodate example bindings. As should be apparent, though, the example skis described herein may be used with other suitable bindings and mounting features corresponding to the bindings without limitation. For example, in some embodiments the ski of the given ski assembly may be adapted to accommodate unconventional bindings that use other manners of connecting a user's foot to the ski, for example, one or more straps, Velcro®, snaps, sleeves, magnets, etc. In this sense, a binding may include a suitable configuration to couple a user's foot (or feet) to the ski.

Figure 36:
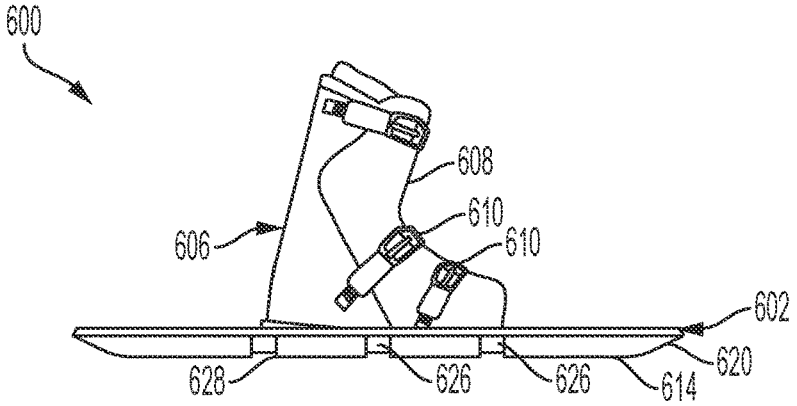
FIG. 36 is a side view of another exemplary embodiment of a snow ski assembly according to the present disclosure.
Figure 37:
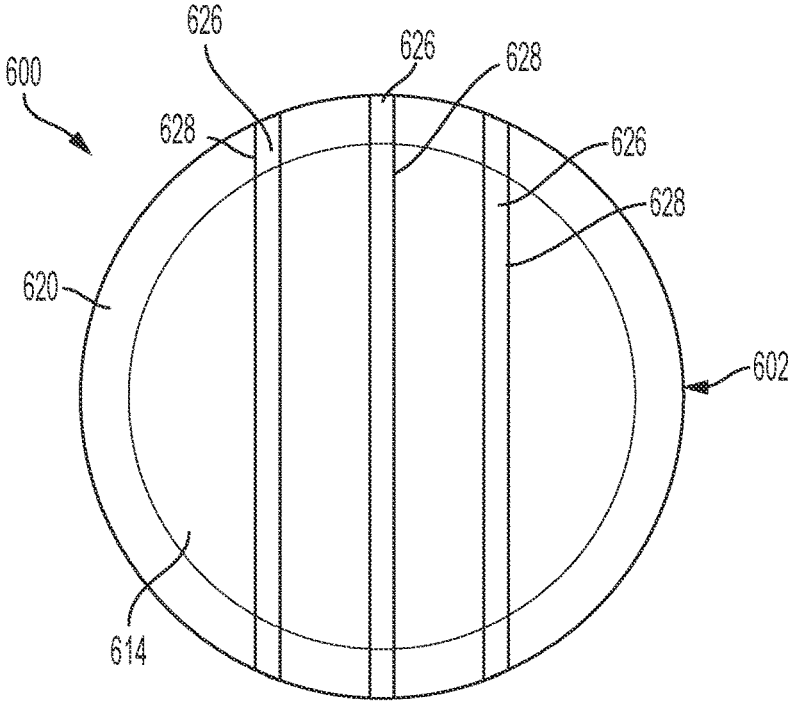
FIG. 37 is a bottom plan view of the snow ski assembly of FIG. 36.
Figure 38:
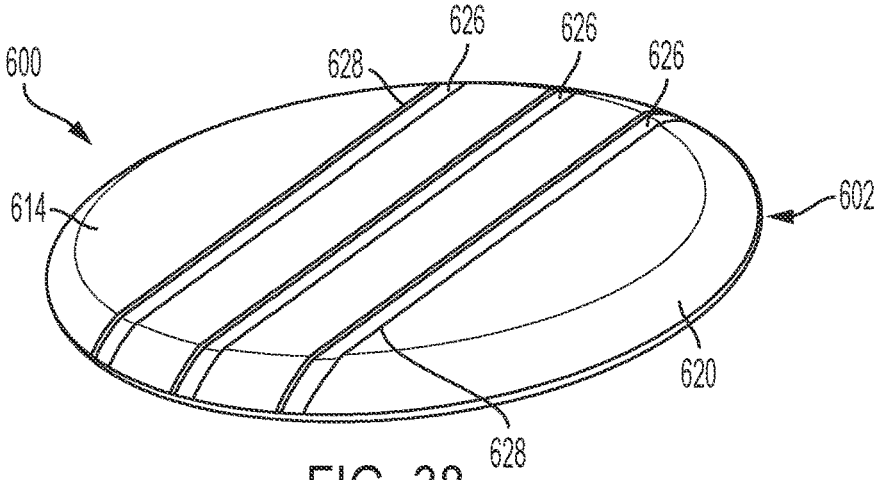
FIG. 38 is a bottom isometric view of the snow ski assembly of FIG. 36.

FIGS. 36-38 illustrate another exemplary embodiment of a snow ski assembly 600 according to the present disclosure. The snow ski assembly 600 of this embodiment is similar to the snow ski assembly 100 previously described and illustrated in FIGS. 1-7. For example, the snow ski assembly 600 of this embodiment is configured to be worn by an individual on one of the individual's feet, with a second snow ski assembly (e.g., another one of snow ski assembly 600, etc.) then configured to be worn by the individual on the individual's other foot. As such, the individual again uses two of the snow ski assemblies to travel (e.g., to move, to slide, etc.) across snow and/or ice as desired, for example, at a ski slope under the force of gravity, etc. However, in some embodiments, one snow ski assembly 600 may be adapted to accommodate both feet of an individual.

The snow ski assembly 600 of this embodiment generally includes a ski 602, and a mounting feature (not visible, but may be substantially the same as mounting feature 104) that couples a binding 606 to the ski 602 (possibly in substantially the same manner as described with respect to the mounting feature 104). The binding 606, then, is configured to secure a boot 608 to the ski 602 so that the individual can essentially wear the ski 602, via the boot 608 and binding 606, on one of the individual's feet. The illustrated binding 606 includes straps 610 that secure over, around, etc. the boot 608 to hold the boot 608 (and the individual's foot inside the boot 608) in the binding 606 (and, thus, the ski 602 on the individual's foot). However, other means (other than straps 610) may be used with the binding 606 for securing the boot 608 in the binding 606 (e.g., friction fittings, clips, other mechanical fasteners, etc.). In addition, it should be appreciated that other bindings may be used with the snow ski assembly 600 within the scope of the present disclosure. In addition, it should be appreciated that the mounting feature may be configured to couple multiple bindings to the ski, so that multiple boots may be secured to the ski 602.

The ski 602 generally includes a bottom wall 614 and an upturned peripheral region 620 (e.g., an upturned lip portion, an upturned peripheral portion located toward a perimeter of the bottom wall 614, an upturned sidewall, etc.). The upturned peripheral region 620 extends generally around a peripheral portion (or perimeter portion) of the bottom wall 614 (e.g., the upturned peripheral region 620 extends generally continuously around the bottom wall 614 of the ski 602, at least partly around the bottom wall 614 with one or more discontinuities or voids in the upturned peripheral region 620 (e.g., one or more crenellations, etc.), uniformly or non-uniformly (e.g., with one or more protrusions, etc.) around the bottom wall 614, etc.). Together, in this embodiment, the bottom wall 614 and the upturned peripheral region 620 provide the ski 602 with a generally circular (or disk) shape or footprint (when viewed in plan). In other exemplary embodiments (as generally described and illustrated herein), snow ski assemblies may include skis with bottom walls and peripheral regions defining other shapes (e.g., elliptical shapes, etc.) when the skis are viewed in plan. Further, it should be appreciated that a size (e.g., a width, etc.) of the upturned peripheral region 620 may vary, for example, to accommodate different movements and acrobatic possibilities by individuals using the ski 602.

The upturned peripheral region 620 of the illustrated ski 602 is generally flat (or linear) along a length of the peripheral region 620 from the flat bottom wall 614 to a perimeter edge of the peripheral region 620 (i.e., a perimeter edge of the ski 602). In the illustrated embodiment, the upturned peripheral region 620 forms an angle with the flat bottom wall 614 of about twenty-five degrees (generally consistently around the perimeter of the ski 602). However, the angle may be greater than or less than about twenty-five degrees, as desired (e.g., depending on desired movement of the ski 602 across snow and/or ice, etc.). In addition, in other exemplary embodiments, snow ski assemblies may include skis with bottom walls and/or peripheral regions having geometries, shapes, etc. that are other than generally flat and/or that are asymmetric and/or that include asymmetries (e.g., to help accommodate different movements and/or acrobatic possibilities using the snow ski assemblies, etc.). For example, in some embodiments, the bottom walls and/or the peripheral regions of the skis may include geometries, shapes, etc. that are generally rounded, not flat, etc.

As described, in this embodiment the bottom wall 614 of the ski 602 (e.g., a central region of the ski 602, etc.) is generally flat (or planar), and is generally radially symmetric. While generally flat (or planar), the bottom wall 614 of the ski 602 also includes multiple control structures 626 extending across at least a portion of the bottom wall 614. In the illustrated embodiment, each control structure 626 includes a generally square channel formed in the bottom wall 614. In addition, each control structure 626 includes one or more edges 628 to engage a snow covered surface to control the movement of the ski 602 (e.g., control, steer, slow, stop, stabilize, etc. the ski 602) during movement of the ski 602 on the snow covered surface. The channel of each control structure 626, then, defines an angle of about ninety degrees (e.g., a right angle, etc.) with the bottom wall 614 to form the edge 628 (generally consistently along the length of the control structure 626). In this way, the edge 628 defines an angular transition between the control structure 626 and the bottom wall 614 for engagement with a snow covered surface to control movement of the ski 602. However, the snow ski assemblies may include skis with recessed control structures having geometries, shapes, etc. that are other than square (e.g., rounded, triangular, etc.) and further may include edges other than those which form a right angle (e.g., greater than or less than ninety degrees, etc.). In addition, in other exemplary embodiments, snow ski assemblies may include skis without angular edges (e.g., a rounded transition between the control structure 626 and the bottom wall 614, etc.). Further, in other exemplary embodiments, snow ski assemblies may include skis with control structures that are formed as structures other than recesses, channels, etc. such as control structures that include protrusions, extensions, etc. extending away from the bottom wall of the skis, or skis with control structures that include a combination of both recesses and protrusions.

While in some embodiments the recessed control structure 626 may be considered as a uniform abnormality along the bottom wall 614, it should be appreciated that a size (e.g., a width, depth, etc.) of the recessed control structure 626 may vary, for example, to accommodate different movements and acrobatic possibilities by individuals using the ski 602. For example, a depth of the recessed control structure 626 near a center of the bottom wall 614 may be greater than a depth of the recessed control structure 626 near the upturned peripheral region 620 of the ski 602. In this manner, a channel or groove of the recessed control structure 626 may become deeper in the direction from the upturned peripheral region 620 towards the center of the bottom wall 614. Alternatively, a depth of the recessed control structure 626 near a center of the bottom wall 614 may be less than a depth of the recessed control structure 626 near the upturned peripheral region 620 of the ski 602. In this manner, a channel or groove of the recessed control structure 626 may become shallower in the direction from the upturned peripheral region 620 towards the center of the bottom wall 614.

In other embodiments, the depth of each of the recessed control structures 626 may vary in other ways, and/or different recessed control structures 626 may have different depths (e.g., a center recessed control structure 626 may be deeper or shallower than outer recessed control structures 626, etc.), etc. Similarly, the geometry of the recessed control structures 626 may vary across the bottom wall 614, such as changing from a square groove to a triangular groove, changing from a rectangular groove to a half circle groove, changing a width of the groove, etc. The varying depths and changing geometries may affect how the bottom wall 614 of the ski 602 interacts with the snow and/or ice, to accommodate different movements and acrobatic possibilities by individuals using the ski 602. As should be apparent, various control structure depth patterns, etc., may be combined with any other features, embodiments, etc. described herein (such as any skis, bindings, mounting features, bottom walls, upturned portions, etc.), without departing from the scope of the present disclosure.

In the illustrated embodiment, the ski 602 includes a symmetric pattern of three generally linear control structures 626 which extend across the bottom wall 614 and the upturned peripheral region 620 of the ski 602. However, in other exemplary embodiments, the number of control structures 626 may be greater than or less than three, as desired (e.g., depending on desired control during movement of the ski 602 across snow and/or ice, etc.) and may be formed in other patterns and/or structures (e.g., asymmetric, crossed or hatched, curved, etc.). In addition, in other exemplary embodiments, the control structures may include structures other than generally linear structures such as generally curved structures, a combination of both generally linear structures and generally curved structures, etc. In the illustrated embodiment, one of the control structures 626 extends across the bottom wall 614 through a central portion, or center, of the ski 602 and the other two control structures 626 extend across the bottom wall 614 through a non-central portion of the ski 602 (e.g., offset from the center of the ski 602, etc.). As can be appreciated, in other exemplary embodiments, control structures may extend across the bottom wall of a ski 602 without passing through or extending across the center of the ski (e.g., control structures positioned in a pattern of concentric rings, a centrally-offset control structure, etc.).

With continued reference to FIGS. 36-38, in the illustrated embodiment, the control structures 626 are defined in the bottom wall 614 and are at least partly disposed in the upturned peripheral region 620. The control structures 626 extend across the bottom wall 614 and the upturned peripheral region 620 of the ski 602 to a perimeter edge of the ski 602. In this way, the control structures 626 generally extend across the entire dimension of the ski 602 (e.g., a length, a width, etc.). However, in other exemplary embodiments, the control structures 626 may only extend across a portion of the ski 602 rather than to a perimeter edge of the ski 602, as desired (e.g., extend across a portion of the bottom wall 614, across the bottom wall 614 only, across the bottom wall 614 and a portion of the upturned peripheral region 620, etc.). In addition, in the illustrated embodiment, the control structures 626 are oriented with respect to the binding 606 and boot 608 in a generally perpendicular configuration (e.g., the control structures 626 extend across the bottom wall 614 in a direction generally perpendicular to the length of the binding 606 and/or the boot 608). However, it should be appreciated that a position (e.g., an orientation, directionality, etc.) of the control structures 626 may vary with respect to the binding 606 and/or the boot 608, for example, to accommodate different movements and acrobatic possibilities by individuals using the ski 602.

In use of the snow ski assembly 600 (i.e., when the snow ski assembly 600 is worn by the individual on one of the individual's feet), the bottom wall 614 (e.g., a bottom surface of the bottom wall 614, etc.) engages the snow and/or ice during movement of the snow ski assembly 600. The control structures 626 (and edges 628) further engage with the snow and/or ice during movement of the snow ski assembly 600 to control, steer, stop, etc. the snow ski assembly 600, as desired. And, the upturned peripheral region 620 allows the ski 602 to move without interference from the snow and/or ice (e.g., without digging or biting into the snow and/or ice, etc.). Further, the shape of the ski 602 (as described above) and the positioning of the upturned peripheral region 620 around the entire peripheral portion of the bottom wall 614 allows movement of the ski 602 in any direction, again without such interference from the snow and/or ice (e.g., without the peripheral region 620 of the ski 602 digging or biting into the snow and/or ice, etc.). However, it should again be appreciated that this does not infer that a user of the snow ski assembly 600 could not, by means of manipulation of his or her body, rotate (e.g., tip, tilt, etc.) the ski assembly 600 such that the upturned peripheral region 620 could be used for control if desired.

Figure 39:
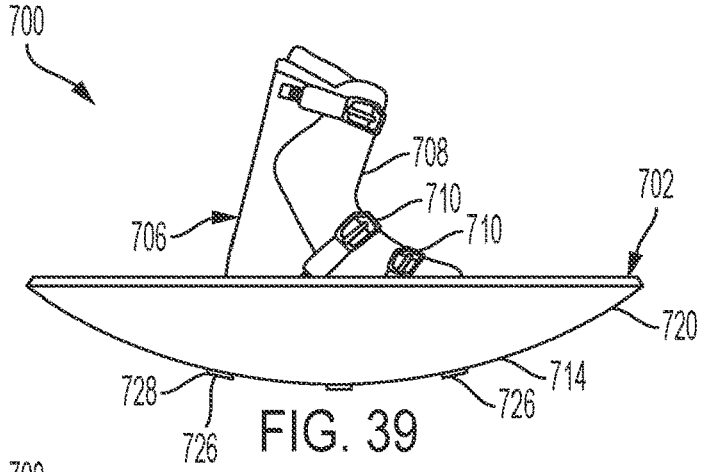
FIG. 39 is a side view of another exemplary embodiment of a snow ski assembly according to the present disclosure.
Figure 40:
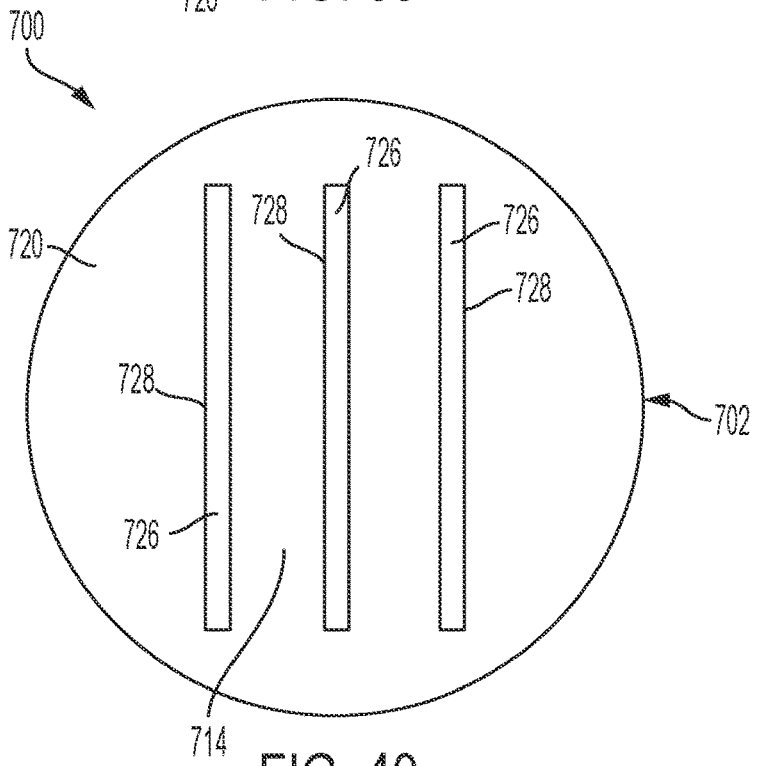
FIG. 40 is a bottom plan view of the snow ski assembly of FIG. 39.
Figure 41:
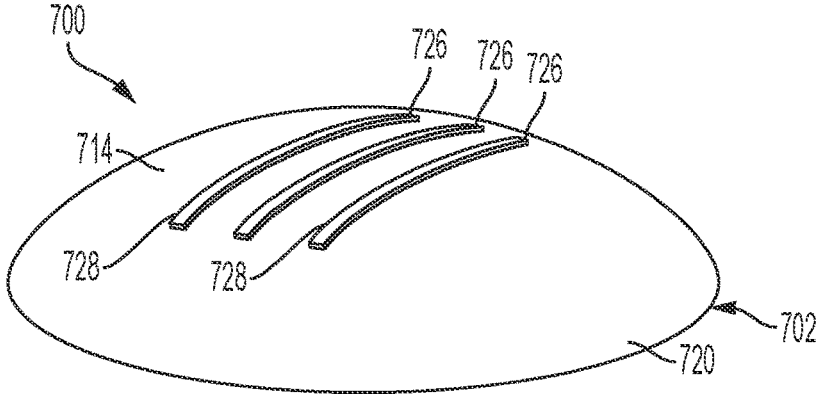
FIG. 41 is a bottom isometric view of the snow ski assembly of FIG. 39.

FIGS. 39-41 illustrate another exemplary embodiment of a snow ski assembly 700 according to the present disclosure. The snow ski assembly 700 of this embodiment is similar to the snow ski assembly 100 previously described and illustrated in FIGS. 1-7. For example, the snow ski assembly 700 of this embodiment is again configured to be worn by an individual on one of the individual's feet, with a second snow ski assembly 700 (e.g., another snow ski assembly 700, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 700 allows the individual to move in any direction across the snow and/or ice without preference for any one particular direction. However, in some embodiments, one snow ski assembly 700 may be adapted to accommodate both feet of an individual.

As shown in FIGS. 39-41, the snow ski assembly 700 of this embodiment again generally includes a ski 702. Although not shown, the snow ski assembly 700 may also include a spacer (similar to spacers 230, 330, 340, 440) and a mounting feature (similar to mounting features 204, 304, 404). The snow ski assembly 700 includes a binding 706 that couples to the ski 702 at the mounting feature, via the spacer, and is configured to secure a boot 708 to the ski 702 so that the individual can wear the ski 702, via the boot 708 and binding 706, on one of the individual's feet. The illustrated binding 706 includes straps 710 that secure over, around, etc. the boot 708 to hold the boot 708 (and the individual's foot inside the boot 708) in the binding 706 (and, thus, the ski 702 on the individual's foot). However, other means may be used with the binding 706 for securing the boot 708 in the binding 706 (e.g., friction fittings, clips, other mechanical fasteners, etc.). In addition, it should be appreciated that any suitable binding can be used with the snow ski assembly 700 within the scope of the present disclosure. It should further be appreciated that the mounting feature may be configured to couple multiple bindings to the ski, so that multiple boots may be secured to the ski 702.

With continued reference to FIGS. 39-41, the ski 702 of the snow ski assembly 700 generally includes a bottom wall 714 having an upturned peripheral region 720 (e.g., an upturned lip, an upturned peripheral edge located toward a perimeter of the bottom wall 714, etc.). The upturned peripheral region 720 of the ski 702 generally extends around a peripheral portion (or perimeter portion) of the bottom wall 714 (e.g., the upturned peripheral region 720 extends generally continuously around the bottom wall 714 of the ski 702, at least partly around the bottom wall 714 with one or more discontinuities or voids in the upturned peripheral region 720 (e.g., one or more crenellations, etc.), uniformly or non-uniformly (e.g., with one or more protrusions, etc.) around the bottom wall 714, etc.). And together, the bottom wall 714 and the upturned peripheral region 720 provide the ski 702 with a generally circular (or disk) shape or footprint (when viewed in plan). In other exemplary embodiments, snow ski assemblies may include skis with bottom walls and peripheral regions defining other shapes or footprints (e.g., elliptical shapes, etc.) when the skis are viewed in plan. Or, snow ski assemblies may include skis with peripheral regions that do not extend uniformity around bottom walls and/or include one or more discontinuities around the bottom walls. Further, it should be appreciated that a size (e.g., a length, etc.) of the upturned peripheral region 720 may vary, for example, to accommodate different movements and acrobatic possibilities by individuals using the ski 702.

The bottom wall 714 of the ski 702 (e.g., a central region of the ski 702, etc.) is generally rounded from the peripheral region 720 on one side of the ski 702 to the peripheral region 720 on the other side of the ski (e.g., defines a generally rounded cross section as shown in FIG. 40, etc.), and is generally radially symmetric. In the illustrated embodiment, the rounded bottom wall 714 of the ski 702 is generally arc shaped and extends/transitions smoothly to the upturned peripheral region 720 generally consistently around the perimeter of the ski 702 (such that, in this embodiment, the upturned peripheral region 720 is an extension of the bottom wall 714 and generally coincides with the bottom wall 714). However, the rounded bottom wall 714 may have other shapes, for example, generally near circular shapes, generally elliptical shapes, generally parabolic shapes, generally hyperbolic shapes, etc. and/or other geometries (e.g., asymmetric geometries, generally symmetric geometries that include asymmetries to help accommodate different movements and acrobatic possibilities, etc.) within the scope of the present disclosure (e.g., to help accommodate different movements and/or acrobatic possibilities using the snow ski assemblies, etc.).

While generally rounded, the bottom wall 714 of the ski 702 also includes multiple control structures 726 (e.g., protrusions, extensions, etc.) extending away from the bottom wall 714 of the ski 702 and extending across at least a portion of the bottom wall 714. Each control structure 726 includes one or more edges 728 to engage a snow covered surface to control the movement of the ski 702 (e.g., control, steer, slow, stop, and/or stabilize the ski 702) during movement of the ski 702 on the snow covered surface. In the illustrated embodiment, the control structure 726 includes a protrusion extending away from the bottom wall 714 having a generally rectangular cross section and including two edges 728 along the length of the control structure 726. However, in other exemplary embodiments, control structures may include protrusions having cross sections other than rectangular (e.g., square, triangular, polygonal, rounded, etc.) and may have a greater or fewer number of edges than the ski assembly 700. For example, a control structure having a triangular cross section may include only one edge while a control structure having a rounded cross section (e.g., semi-circular, elliptical, etc.) may not include an edge. Further, in the illustrated embodiment, the control structure 726 defines an angle of ninety degrees (e.g., a right angle) with the bottom wall 714 at the transition between the control structure 726 and the bottom wall 714. However, the transition between the control structure 726 and the bottom wall 714 may be other than a right angle (e.g., an angular transition of greater than or less than ninety degrees, a rounded transition, etc.). In other exemplary embodiments, snow ski assemblies may include skis with control structures that are formed as structures other than protrusions such as control structures that include recesses, channels, etc. defined in the bottom wall 714. In addition, snow ski assemblies may include skis with control structures that include a combination of both recesses and protrusions.

Further, while in some embodiments the protruded control structure 726 may be considered as a uniform abnormality along the bottom wall 714, it should be appreciated that a size (e.g., a width, height, etc.) of the protruded control structure 726 may vary, for example, to accommodate different movements and acrobatic possibilities by individuals using the ski. For example, a height of the protruded control structure 726 near a center of the bottom wall 714 may be greater than a height of the protruded control structure 726 near the upturned peripheral region 720 of the ski 702. In this manner, a ridge of the protruded control structure 726 may become taller in the direction from the upturned peripheral region 720 towards the center of the bottom wall 714. Alternatively, a height of the protruded control structure 726 near a center of the bottom wall 714 may be less than a height of the protruded control structure 726 near the upturned peripheral region 720 of the ski 702. In this manner, a ridge of the protruded control structure 726 may become shorter in the direction from the upturned peripheral region 720 towards the center of the bottom wall 714.

In other embodiments, the height of the protruded control structure 726 may vary in other ways, and/or different protruded control structures 726 may have different heights (e.g., a center protruded control structure 726 may be taller or shorter than outer protruded control structures 726), etc. Similarly, the geometry of the protruded control structures 726 may vary across the bottom wall 714, such as changing from a square ridge to a triangular ridge, changing from a rectangular ridge to a half circle ridge, changing a width of the ridge, etc. The varying depths and changing geometries may affect how the bottom wall 714 of the ski 702 interacts with the snow and/or ice, to accommodate different movements and acrobatic possibilities by individuals using the ski 702. As should be apparent, various control structure height patterns may be combined with any other features, embodiments, etc. described herein (such as any skis, bindings, mounting features, bottom walls, upturned portions, etc.), without departing from the scope of the present disclosure.

Further, in the illustrated embodiment, the ski 702 includes a symmetric pattern of three generally linear control structures 726 which extend across the bottom wall 714 of the ski 702. However, in other exemplary embodiments, the number of control structures 726 may be greater than or less than three, as desired (e.g., depending on desired control during movement of the ski 702 across snow and/or ice, etc.) and may be formed in other patterns and/or structures (e.g., asymmetric, crossed or hatched, curved, concentric rings, etc.). In addition, in other exemplary embodiments, the control structures may include structures other than generally linear structures such as generally curved structures and/or a combination of both generally linear structures and generally curved structures. In the illustrated embodiment, one of the control structures 726 extends across the bottom wall 714 through a central portion, or center, of the ski 702 and the other two control structures 726 extend across the bottom wall 714 through a non-central portion of the ski 702 (e.g., offset from the center of the ski 702). As can be appreciated, in other exemplary embodiments, control structures may extend across the bottom wall of a ski without passing through or extending across the center of the ski (e.g., control structures positioned in a pattern of concentric rings, a centrally-offset control structure, etc.).

The control structures 726 are defined in the bottom wall 714 of the ski 702. In the illustrated embodiment, the linear control structures 726 do not extend to a perimeter edge of the ski 702. In this way, the control structures 726 generally extend across only a portion of the ski, but not across an entire dimension of the ski 702 (e.g., a length, a width, etc.). For example, the control structures 726 extend across the bottom wall 714 of the ski 702 without extending to the perimeter edge of the ski 702 by extending across only a portion of the bottom wall 714, across the entire bottom wall 714, or across the entire bottom wall 714 and at least partly across the upturned peripheral region 720. However, in other exemplary embodiments, the control structures 726 may extend across an entire dimension of the ski 702 (e.g., to a perimeter edge of the ski 702), as desired. In addition, in the illustrated embodiment, the control structures 726 are oriented with respect to the binding 706 and the boot 708 in a generally perpendicular configuration (e.g., such that the control structures 726 extend across the bottom wall 714 in a direction that is generally perpendicular to a length of the binding 706 and/or boot 708). However, it should be appreciated that a position (e.g., an orientation, directionality etc.) of the control structures 726 may vary with respect to the mounting feature 704, for example, to accommodate different movements and acrobatic possibilities by individuals using the ski 702.

In use of the snow ski assembly 700 (i.e., when the snow ski assembly 700 is worn by the individual on one of the individual's feet), the bottom wall 714 (e.g., a bottom surface of the bottom wall 714, etc.) engages the snow and/or ice during movement of the snow ski assembly 700. The control structures 726 (and edges 728) further engage with the snow and/or ice during movement of the snow ski assembly 700 to control, steer, stop, etc. the snow ski assembly 700, as desired. And, the upturned peripheral region 720 allows the ski 702 to move without interference from the snow and/or ice (e.g., without digging or biting into the snow and/or ice, etc.). Further, the shape of the ski 702 (as described above) and the positioning of the upturned peripheral region 720 around the entire periphery of the bottom wall 714 allows movement of the ski 702 in generally any direction.

FIGS. 42-48 illustrate exemplary embodiments of snow ski assemblies including various patterns of control structures according to the present disclosure. The control structures illustrated in FIGS. 42-48 are arranged in various patterns on bottom walls and/or upturned peripheral portions of snow ski assemblies to allow for controlling movement of the ski on a snow covered surface (e.g. to steer, slow, stop, stabilize, etc. the snow ski assemblies during use).

Figure 42:
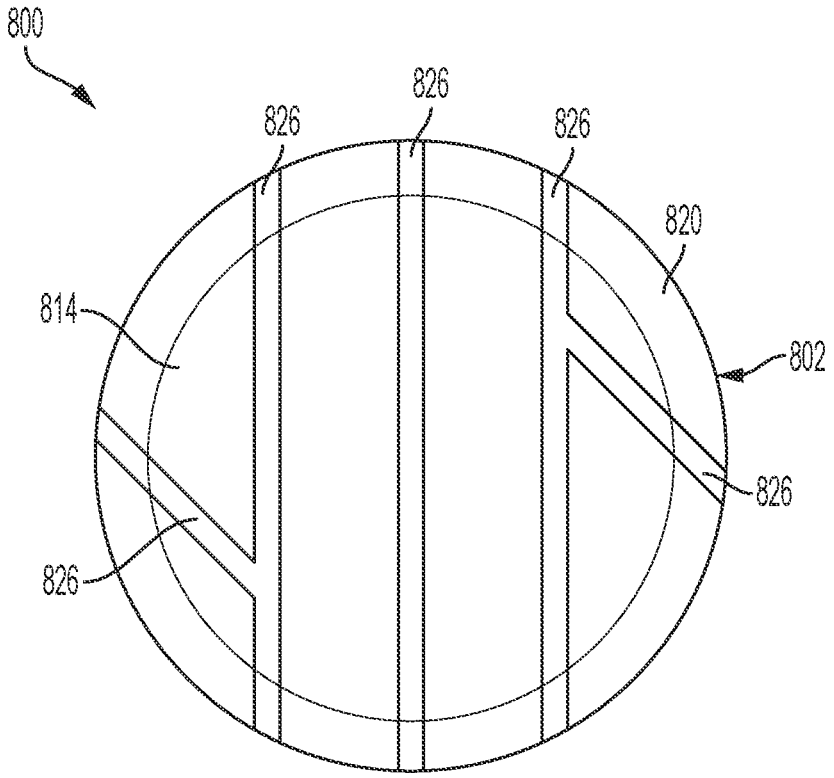
FIG. 42 is a bottom plan view of another exemplary embodiment of a snow ski assembly according to the present disclosure.

FIG. 42 illustrates an example snow ski assembly 800 that includes a ski 802 having a bottom wall 814 and an upturned peripheral region 820 extending entirely around a perimeter of the bottom wall 814. And together, the bottom wall 814 and the upturned peripheral region 820 provide the ski 802 with a generally circular (or disk) shape or footprint (when viewed in plan). However, in other exemplary embodiments, snow ski assemblies may include skis with bottom walls and peripheral regions defining other shapes or footprints (e.g., elliptical shapes, etc.) when the skis are viewed in plan. As shown in FIG. 42, the ski 802 of this embodiment includes control structures 826 extending across the bottom wall 814 and the upturned peripheral region 820 to a perimeter edge of the ski 802. The control structures 826 may be formed as recesses defined in the bottom wall 814 (e.g., similar to control structures 626), as protrusions extending away from the bottom wall 814 of the ski 802 (e.g., similar to control structures 726), or as a combination of both recesses and protrusions. In addition, the control structures 826 may include at least one edge (similar to edge 628, 728) or may have rounded or non-angular configurations (e.g., no edges, etc.).

In the illustrated embodiment, the control structures 826 are generally linear structures and include a pattern of multiple control structures 826. One of the control structures 826 extends across the bottom wall 814 through a central portion, or center, of the ski 802 and the other control structures 826 extend across the bottom wall 814 through a non-central portion of the ski 802 (e.g., offset from the center of the ski 802). As shown in the illustrated embodiment, the non-central control structures 826 are branched, forked, etc. (e.g., two linear control structures 826 are adjoining) for example, to control a movement of the ski 802 during use of the ski 802. In addition, in other exemplary embodiments, the control structures 826 include structures other than generally linear structures, for example, generally non-linear and/or curved structures (to enable control of different movements performed by individuals using the ski 802). Further, the control structures 826 may be oriented as desired with respect to a binding and/or boot associated with the ski assembly 800 (e.g., in a generally perpendicular configuration, in a generally parallel configuration, in a different configuration to accommodate different movements and acrobatic possibilities by individuals using the ski 802, etc.).

Figure 43:
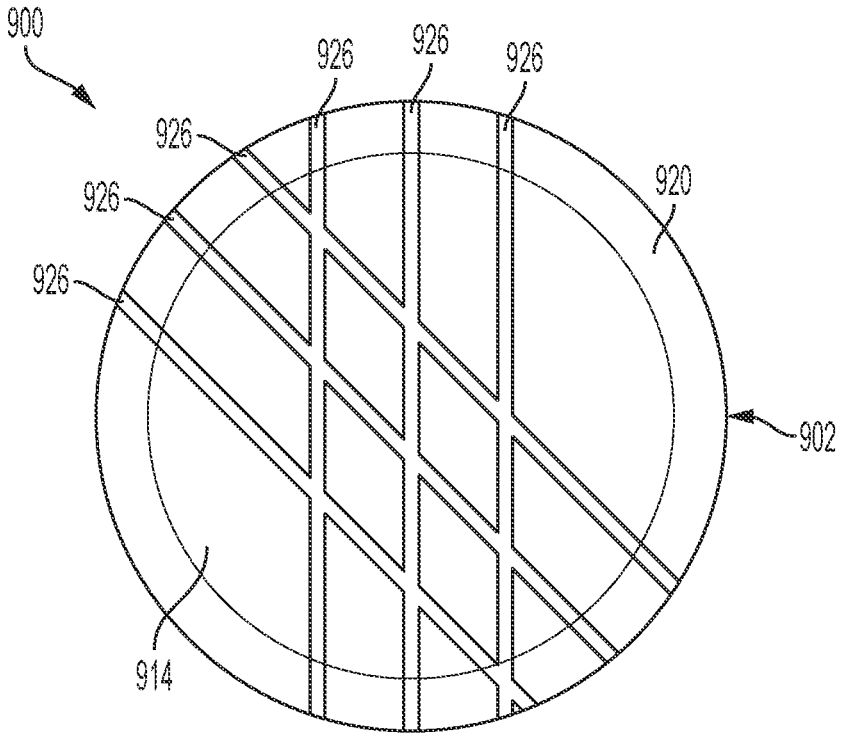
FIG. 43 is a bottom plan view of another exemplary embodiment of a snow ski assembly according to the present disclosure.

FIG. 43 illustrates an example snow ski assembly 900 that includes a ski 902 having a bottom wall 914 and an upturned peripheral region 920 extending entirely around a perimeter of the bottom wall 914. And together, the bottom wall 914 and the upturned peripheral region 920 provide the ski 902 with a generally circular (or disk) shape or footprint (when viewed in plan). However, in other exemplary embodiments, snow ski assemblies may include skis with bottom walls and peripheral regions defining other shapes or footprints (e.g., elliptical shapes, etc.) when the skis are viewed in plan. As shown in FIG. 43, the ski 902 of this embodiment again includes control structures 926 extending across the bottom wall 914 and the upturned peripheral region 920 to a perimeter edge of the ski 902. The control structures 826 may be formed as recesses defined in the bottom wall 914 (e.g., similar to control structures 626), as protrusions extending away from the bottom wall 914 of the ski 902 (e.g., similar to control structures 726), or as a combination of both recesses and protrusions (either uniform or not). In addition, the control structures 926 may include at least one edge (similar to edge 628, 728) or may have rounded or non-angular configurations.

In the illustrated embodiment, the control structures 926 are each generally linear structures and include a pattern of multiple control structures 926. The control structures 926 are positioned in a generally crossed or hatched pattern on the ski 902. As shown in the illustrated embodiment, a first set of the control structures 926 are angled with respect to a second set of the control structures 926 such that the first and second sets of control structure 926 intersect or overlap. The first and second sets of control structures 926 each include three control structures 926. However, in other exemplary embodiments, the first and second sets of control structures may include a different number of control structures (e.g., greater or fewer than three) and/or the first set of control structures may include a different number of control structures than the second set. In addition, in some exemplary embodiments, the control structures 926 include structures other than generally linear structures, for example, generally non-linear and/or curved structures (to enable control of different movements performed by individuals using the ski 902). Further, the control structures 926 may be oriented as desired with respect to a binding and/or boot associated with the ski assembly 900 (e.g., in a generally perpendicular configuration, in a generally parallel configuration, in a different configuration to accommodate different movements and acrobatic possibilities by individuals using the ski 902, etc.)

Figure 44:
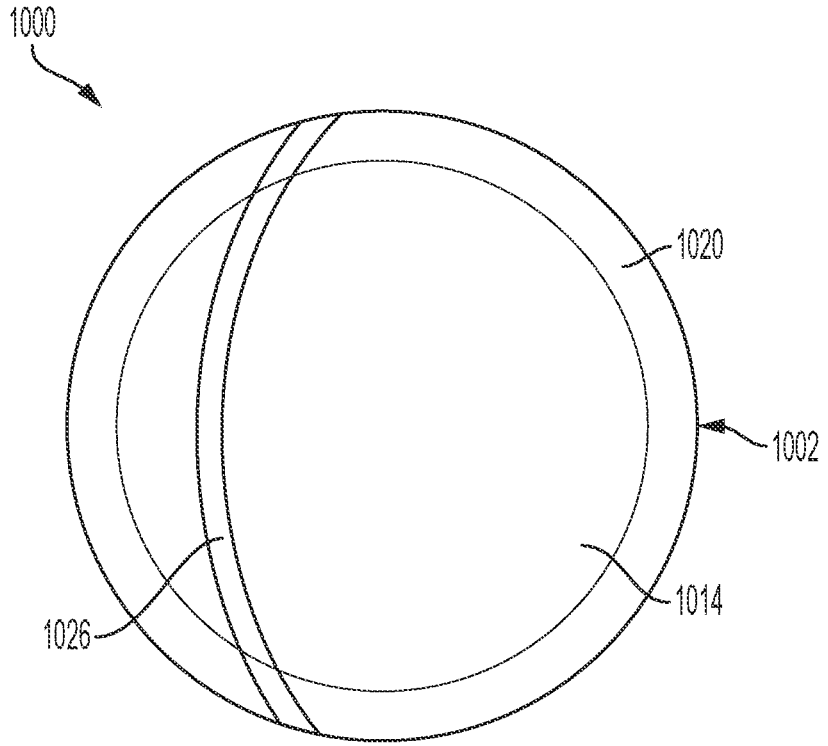
FIG. 44 is a bottom plan view of another exemplary embodiment of a snow ski assembly according to the present disclosure.

FIG. 44 illustrates a snow ski assembly 1000 that includes a ski 1002 having a bottom wall 1014 and an upturned peripheral region 1020 extending entirely around a perimeter of the bottom wall 1014. And together, the bottom wall 1014 and the upturned peripheral region 1020 provide the ski 1002 with a generally circular (or disk) shape or footprint (when viewed in plan). However, in other exemplary embodiments, snow ski assemblies may include skis with bottom walls and peripheral regions defining other shapes or footprints (e.g., elliptical shapes, etc.) when the skis are viewed in plan. As shown in FIG. 44, the ski 1002 of this embodiment includes a control structure 1026 extending across the bottom wall 1014 and the upturned peripheral region 1020 to a perimeter edge of the ski 1002. The control structure 1026 may be formed as a recess defined in the bottom wall 1014 (e.g., similar to control structure 626) and/or as a protrusion extending away from the bottom wall 1014 of the ski 1002 (e.g., similar to control structure 726). In addition, the control structure 1026 may include at least one edge (similar to edge 628, 728) or may have a rounded or non-angular configuration.

In the illustrated embodiment, the control structure 1026 includes one generally curved structure (e.g., rounded, circular, elliptical, etc.) extending across the bottom wall 1014 and is generally offset from a central portion, or center, of the ski 1002. However, in other exemplary embodiments, more than one curved control structure and/or other shaped control structure may be included on the ski 1002 and/or may be positioned through the center of the ski 1002 (e.g., to enable control of different movements performed by individuals using the ski 1002). For example, the ski 1002 may include a control structure 1026 disposed toward one side of the ski 1002 (as shown in FIG. 44) and another control structure 1026 similarly deposed toward the other side of the ski 1002 (where the two control structures 1026 do or do not cross, etc.). Further, the control structure 1026 may be oriented as desired with respect to a binding and/or boot associated with the ski assembly 1000 (e.g., in a generally perpendicular configuration, in a generally parallel configuration, in a different configuration to accommodate different movements and acrobatic possibilities by individuals using the ski 1002, etc.).

Figure 45:
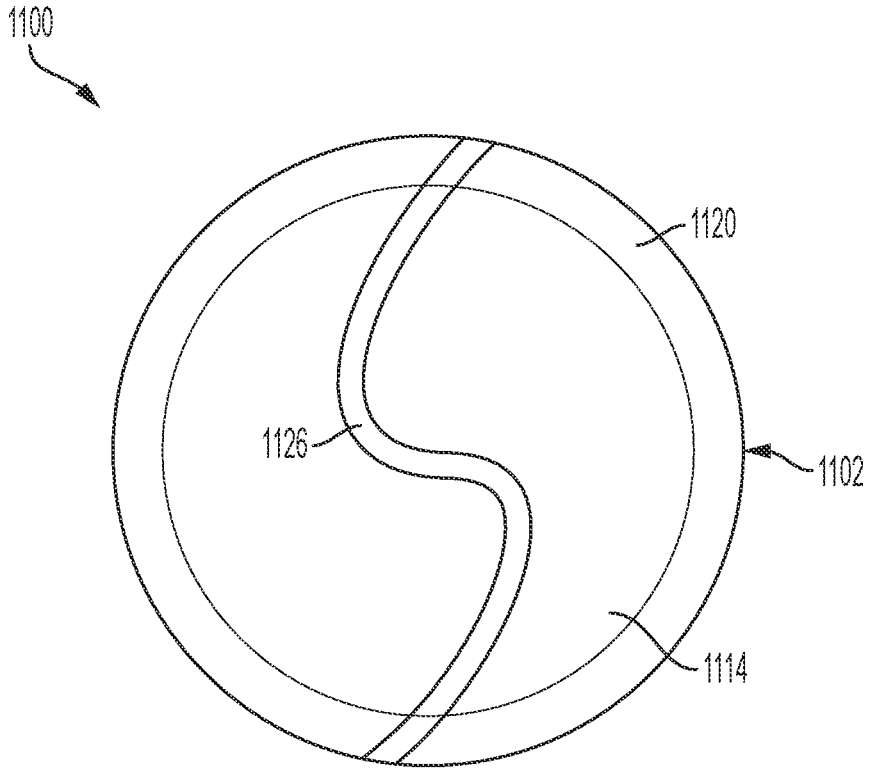
FIG. 45 is a bottom plan view of another exemplary embodiment of a snow ski assembly according to the present disclosure.

FIG. 45 illustrates a snow ski assembly 1100 that includes a ski 1102 having a bottom wall 1114 and an upturned peripheral region 1120 extending entirely around a perimeter of the bottom wall 1114. And together, the bottom wall 1114 and the upturned peripheral region 1120 provide the ski 1102 with a generally circular (or disk) shape or footprint (when viewed in plan). However, in other exemplary embodiments, snow ski assemblies may include skis with bottom walls and peripheral regions defining other shapes or footprints (e.g., elliptical shapes, etc.) when the skis are viewed in plan. As shown in FIG. 45, the ski 1102 of this embodiment includes a control structure 1126 extending across the bottom wall 1114 and the upturned peripheral region 1120 to a perimeter edge of the ski 1102. The control structure 1126 may be formed as a recess defined in the bottom wall 1114 (e.g., similar to control structure 626) and/or as a protrusion extending away from the bottom wall 1114 of the ski 1102 (e.g., similar to control structure 726). In addition, the control structure 1126 may include at least one edge (similar to edge 628, 728) or may have rounded or non-angular configurations.

In the illustrated embodiment, the control structure 1126 includes one generally curved structure (e.g., S-shaped, sinusoidal, etc.) and the control structure 1126 extends across the bottom wall 1114 through a central portion, or center, of the ski 1102. However, in other exemplary embodiments, more than one S-shaped curved control structure may be included on the ski 1102, the control structure 1126 may be positioned offset from the center of the ski 1102 (e.g., to enable control of different movements performed by individuals using the ski 1102), the control structure 1126 may be uniform or not uniform in shape, the control structure 1126 may not be continuous (e.g., the control structure 1126 may have one or more discontinuities such as a dashed structure, etc.), etc. Further, the control structure 1126 may be oriented as desired with respect to a binding and/or boot associated with the ski assembly 1100 (e.g., in a generally perpendicular configuration, in a generally parallel configuration, in a different configuration to accommodate different movements and acrobatic possibilities by individuals using the ski 1002, etc.)

Figure 46:
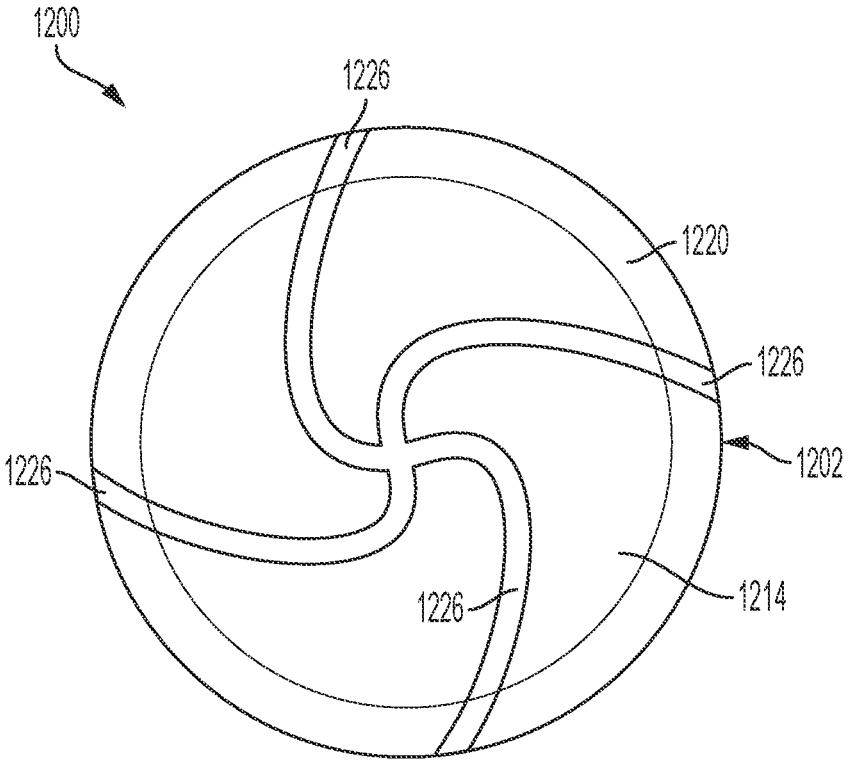
FIG. 46 is a bottom plan view of another exemplary embodiment of a snow ski assembly according to the present disclosure.

FIG. 46 illustrates a snow ski assembly 1200 that includes a ski 1202 having a bottom wall 1214 and an upturned peripheral region 1220 extending entirely around a perimeter of the bottom wall 1214. And together, the bottom wall 1214 and the upturned peripheral region 1220 provide the ski 1202 with a generally circular (or disk) shape or footprint (when viewed in plan). However, in other exemplary embodiments, snow ski assemblies may include skis with bottom walls and peripheral regions defining other shapes or footprints (e.g., elliptical shapes, etc.) when the skis are viewed in plan. As shown in FIG. 46, the ski 1202 of this embodiment includes control structures 1226 extending across the bottom wall 1214 and the upturned peripheral region 1220 to a perimeter edge of the ski 1202. The control structures 1226 may be formed as recesses defined in the bottom wall 1214 (e.g., similar to control structures 626), as protrusions extending away from the bottom wall 1214 of the ski 1202 (e.g., similar to control structures 726), or as a combination of both recesses and protrusions. In addition, the control structures 1226 may include at least one edge (similar to edge 628, 728) or may have rounded or non-angular configurations.

In the illustrated embodiment, the control structures 1226 are generally curved and include a pattern of multiple control structures 1226. Each curved control structure 1226 generally adjoins, intersects, etc. one or more other curved control structure. 1126. In the illustrated embodiment, the control structures 1226 are positioned in a generally asymmetric pattern. However, in other exemplary embodiments, snow ski assemblies may include skis having symmetric patterns of curved control structures. In addition, in other exemplary embodiments, the control structures 1226 include structures other than generally curved structures, for example, generally linear structures (e.g., to enable control of different movements performed by individuals using the ski 1202).

Figure 47:
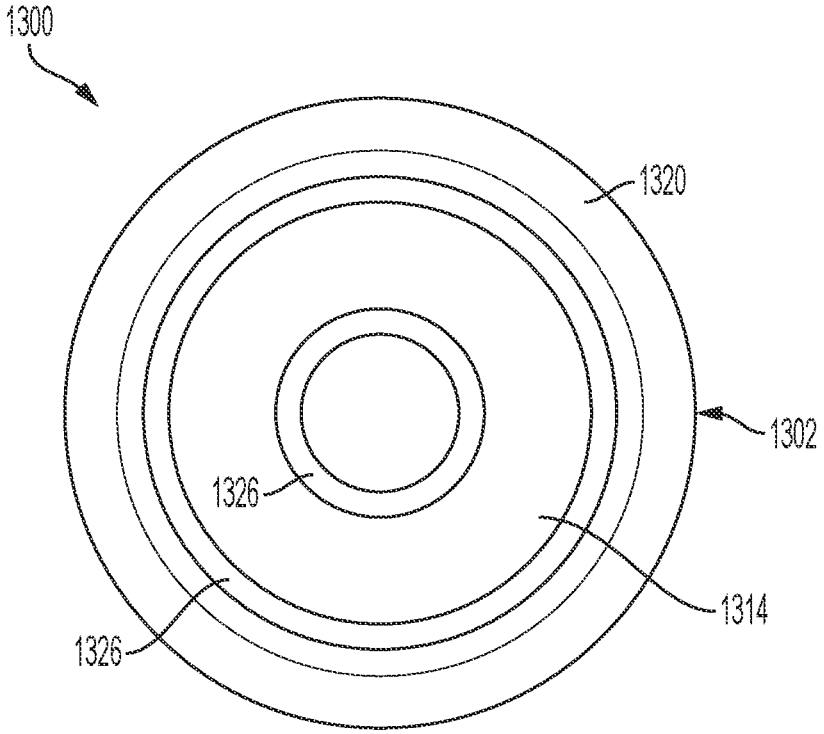
FIG. 47 is a bottom plan view of another exemplary embodiment of a snow ski assembly according to the present disclosure.

FIG. 47 illustrates a snow ski assembly 1300 that includes a ski 1302 having a bottom wall 1314 and an upturned peripheral region 1320 extending entirely around a perimeter of the bottom wall 1314. And together, the bottom wall 1314 and the upturned peripheral region 1320 provide the ski 1302 with a generally circular (or disk) shape or footprint (when viewed in plan). However, in other exemplary embodiments, snow ski assemblies may include skis with bottom walls and peripheral regions defining other shapes or footprints (e.g., elliptical shapes, etc.) when the skis are viewed in plan. As shown in FIG. 47, the ski 1302 of this embodiment includes control structures 1326 extending across at least the bottom wall 1314 and at least partly disposed in the upturned peripheral region 1320 to a perimeter edge of the ski 1302. The control structures 1326 may be formed as recesses defined in the bottom wall 1314 (e.g., similar to control structures 626), as protrusions extending away from the bottom wall 1314 of the ski 1302 (e.g., similar to control structures 726), or as a combination of both recesses and protrusions. In addition, the control structures 1326 may include at least one edge (similar to edge 628, 728) or may have rounded or non-angular configurations.

In the illustrated embodiment, the control structures 1326 are generally curved structures and include a pattern of multiple control structures 1326. The control structures 1326 include multiple concentric rings (e.g., circular, elliptical, etc.). While two ring control structures 1326 are depicted in the illustrated embodiment, a greater or fewer number of ring control structures 1326 may be included on the ski 1302, as desired. In addition, in other exemplary embodiments, snow ski assemblies may include patterns of control structures other than concentric rings such as non-concentric rings and/or intersecting rings, etc. Further, as shown in the illustrated embodiment, both ring control structures 1326 are disposed in the bottom wall 1314 of the ski 1302. In addition, in other exemplary embodiments, at least one of the ring control structures 1326 may be positioned at least partly in the upturned peripheral region 1320 (e.g., entirely in the upturned peripheral region 1320, where the bottom wall 1314 meets the upturned peripheral region 1320, etc.). While the control structures 1326 are depicted as curved rings, in other exemplary embodiments, the control structures 1326 may be formed as non-linear and/or polygonal rings (e.g., square, rectangular, etc.) for example, to enable control of different movements performed by individuals using the ski 1302).

Figure 48:
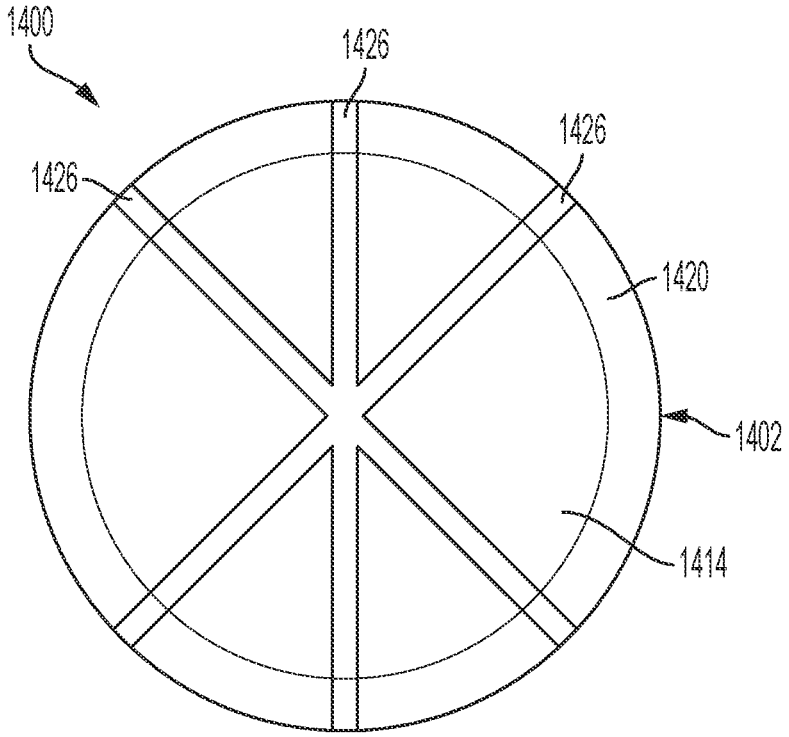
FIG. 48 is a bottom plan view of another exemplary embodiment of a snow ski assembly according to the present disclosure.

FIG. 48 illustrates an example snow ski assembly 1400 that includes a ski 1402 having a bottom wall 1414 and an upturned peripheral region 1420 extending entirely around a perimeter of the bottom wall 1414. And together, the bottom wall 1414 and the upturned peripheral region 1420 provide the ski 1402 with a generally circular (or disk) shape or footprint (when viewed in plan). However, in other exemplary embodiments, snow ski assemblies may include skis with bottom walls and peripheral regions defining other shapes or footprints (e.g., elliptical shapes, etc.) when the skis are viewed in plan. As shown in FIG. 48, the ski 1402 of this embodiment includes control structures 1426 extending across the bottom wall 1414 and the upturned peripheral region 1420 to a perimeter edge of the ski 1402. The control structures 826 may be formed as recesses defined in the bottom wall 1414 (e.g., similar to control structures 626), as protrusions extending away from the bottom wall 1414 of the ski 1402 (e.g., similar to control structures 726), or as a combination of both recesses and protrusions. In addition, the control structures 1426 may include at least one edge (similar to edge 628, 728) or may have rounded or non-angular configurations.

In the illustrated embodiment, the control structures 1426 are generally linear and include a symmetric pattern of multiple control structures 1426. The control structures 1426 extend radially outward from a central point, or center, of the bottom wall 1414 to a perimeter edge of the ski 1402. However, in other exemplary embodiments, the control structures 1426 extend outwards towards the perimeter edge of the ski 1402 from a non-central point of the ski 1402 (e.g., a point located on the upturned peripheral portion of the ski 1402, etc.). In addition, in some exemplary embodiments, the control structures 1426 include structures other than generally linear structures, for example, generally non-linear and/or curved structures (to accommodate different movements and acrobatic possibilities by individuals using the ski 1402).

In some embodiments, the control structures 1426 may have a randomized pattern (e.g., a random pattern of grooves, protrusions, etc. as designed by a random computer algorithm, etc.). Random control structures 1426 may be combined with geometrical control structures 1426 in various implementations. The various random and geometrical control structures 1426 may affect how the bottom wall 1414 of the ski 1402 interacts with the snow and/or ice, to accommodate different movements and acrobatic possibilities by individuals using the ski 1402. As should be apparent, various control structure random patterns and geometries may be combined with any other features, embodiments, etc. described herein (such as any skis, bindings, mounting features, bottom walls, upturned portions, etc.), without departing from the scope of the present disclosure.

In various exemplary embodiments of the present disclosure, the generally symmetric designs of the skis may allow for professional and amateur individuals to use the snow ski assemblies, as they will provide new opportunities for body movement and acrobatics that have not heretofore been possible with conventional snow skis and snowboards. In addition, it can be appreciated that individuals of all ages, sizes and skill levels can us the snow ski assemblies, and that such use may help teach balance and coordination while also making possible different body movements and acrobatics.

In various exemplary embodiments of the present disclosure, the snow ski assemblies are self-contained units that are generally easy to transport or convey to desired locations. In addition, the binding mounting features included with various exemplary embodiments of the snow ski assemblies can be of either universal type or, in some embodiments, proprietary type, enabling easy use of the snow ski assemblies with either generally available boots or with pre-existing equipment, as desired.

It should be appreciated that various components of snow ski assemblies of the present disclosure can be made from any desired suitable materials. For example, skis of the snow ski assemblies may be constructed from (without limitation) natural or man-made materials including, for example, metals, plastics, natural organic substances (e.g. wood, etc.), combinations thereof, etc.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that exemplary embodiments may be embodied in many different forms, and that neither should be construed to limit the scope of the disclosure. In some exemplary embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9, and so forth.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A snow ski assembly for use by an individual to slide across a snow covered surface, the snow ski assembly comprising:

a circular ski configured to slide across a snow covered surface, the ski including a bottom wall for engaging the snow covered surface and an upturned peripheral region extending at least partly around the bottom wall, wherein the bottom wall of the ski defines a circular footprint and includes at least one control structure extending across at least a portion of the bottom wall, the at least one control structure configured to control a movement of the ski on the snow covered surface; and a mounting feature configured to couple a binding to the bottom wall of the ski, such that an individual can position a foot in the binding and use the ski to slide across the snow covered surface.

2. The snow ski assembly of claim 1, wherein the at least one control structure includes at least one recess defined in the at least a portion of bottom wall of the ski.

3. The snow ski assembly of claim 2, wherein the at least one recess defines a depth, and wherein the depth of the at least one recess varies across said at least a portion of the bottom wall.

4. The snow ski assembly of claim 1, wherein the at least one control structure includes at least one protrusion extending away from the bottom wall of the ski.

5. The snow ski assembly of claim 4, wherein the at least one protrusion defines a height, and wherein the height of the at least one protrusion varies across said at least a portion of the bottom wall.

6. The snow ski assembly of claim 1, wherein the at least one control structure includes at least one edge configured to engage the snow covered surface to control the movement of the ski on the snow covered surface.

7. The snow ski assembly of claim 1, wherein the at least one control structure extends across the bottom wall of the ski and is disposed at least partly in the upturned peripheral region.

8. The snow ski assembly of claim 7, wherein the at least one control structure extends to an outer edge of the ski.

9. The snow ski assembly of claim 1, wherein the at least one control structure is generally linear.

10. The snow ski assembly of claim 1, wherein the at least one control structure is generally curved.

11. The snow ski assembly of claim 1, wherein the bottom wall of the ski defines a thickness, and wherein the thickness varies across the bottom wall of the ski.

12. The snow ski assembly of claim 1, wherein the at least one control structure includes multiple control structures, and wherein at least one of the multiple control structures defines a recess and at least another one of the multiple control structures defines a protrusion.

13. A circular snow ski for use by an individual to slide across a snow covered surface, the snow ski comprising:

a bottom wall defining a circular footprint for engaging a snow covered surface, the bottom wall including at least one recess extending across at least a portion of the bottom wall, the at least one recess configured to control a movement of the snow ski on the snow covered surface, and wherein the at least one recess is non-linear; and an upturned peripheral region extending at least partly around a perimeter of the bottom wall to facilitate sliding movement of the snow ski across the snow covered surface.

14. The snow ski of claim 13, wherein the at least one recess includes at least one edge configured to engage the snow covered surface to control the movement of the snow ski on the snow covered surface.

15. The snow ski of claim 13, wherein the at least one recess extends across the bottom wall and is disposed at least partly in the upturned peripheral region.

16. The snow ski of claim 15, wherein the at least one recess extends to an outer edge of the ski defined by the upturned peripheral region.

17. The snow ski of claim 13, wherein the at least one recess is generally curved.

18. The snow ski of claim 13, wherein the at least one recess includes a first recess and a second recess, and wherein the first recess intersects the second recess.

19. The snow ski of claim 18, wherein a depth of the first recess and/or second recess varies across said at least a portion of the bottom wall.

20. The snow ski assembly of claim 1, further comprising a spacer associated with the mounting feature and configured to elevate the mounting feature generally above the bottom wall of the ski.

21. A snow ski assembly for use by an individual to slide across a snow covered surface, the snow ski assembly comprising:

a ski configured to slide across a snow covered surface, the ski including a bottom wall for engaging the snow covered surface and an upturned peripheral region extending at least partly around the bottom wall, wherein the bottom wall of the ski includes at least one control structure extending across at least a portion of the bottom wall and configured to control a movement of the ski on the snow covered surface, the at least one control structure defining a non-linear shape; and a mounting feature configured to couple a binding to the bottom wall of the ski, such that an individual can position a foot in the binding and use the ski to slide across the snow covered surface;

wherein the at least one control structure includes a recess defining a depth, and wherein the depth of the recess varies across said at least a portion of the bottom wall.

22. The snow ski assembly of claim 21, wherein the at least one control structure further includes a protrusion defining a height, and wherein the height of the protrusion varies across said at least a portion of the bottom wall.

23. A snow ski assembly for use by an individual to slide across a snow covered surface, the snow ski assembly comprising:

a ski configured to slide across a snow covered surface, the ski including a bottom wall for engaging the snow covered surface and an upturned peripheral region extending at least partly around the bottom wall, wherein the bottom wall of the ski includes at least first and second control structures extending across at least a portion of the bottom wall and configured to control a movement of the ski on the snow covered surface, the first control structure intersecting the second control structure; and a mounting feature configured to couple a binding to the bottom wall of the ski, such that an individual can position a foot in the binding and use the ski to slide across the snow covered surface.

24. The snow ski assembly of claim 23, wherein the first control structure and/or the second control structure includes a recess defining a depth, and wherein the depth of the recess varies across said at least a portion of the bottom wall.

25. The snow ski assembly of claim 23, wherein the first control structure and/or the second control structure includes a protrusion defining a height, and wherein the height of the protrusion varies across said at least a portion of the bottom wall.

26. A snow ski assembly for use by an individual to slide across a snow covered surface, the snow ski assembly comprising:

a ski configured to slide across a snow covered surface, the ski including a bottom wall for engaging the snow covered surface and an upturned peripheral region extending at least partly around the bottom wall, wherein the bottom wall of the ski includes at least one control structure extending across at least a portion of the bottom wall and configured to control a movement of the ski on the snow covered surface, the at least one control structure defining a non-linear shape; and a mounting feature configured to couple a binding to the bottom wall of the ski, such that an individual can position a foot in the binding and use the ski to slide across the snow covered surface;

wherein the at least one control structure includes a protrusion defining a height, and wherein the height of the protrusion varies across said at least a portion of the bottom wall.

* * * * *